US006161769A

United States Patent [19]

Kircher et al.

[11] Patent Number: 6,161,769

[45] Date of Patent: Dec. 19, 2000

[54] ADJUSTABLE SNOW MAKING TOWER

[75] Inventors: Everett Frank Kircher, Boyne Falls; John Dean McGregor, Harbor Springs; James Simon Milbrandt, Pellston; William James Waugaman, Grosse Pointe; Joel Maurice Woods, Harper Springs, all of Mich.

[73] Assignee: Boyne USA, Inc., Boyne Falls, Mich.

[21] Appl. No.: 09/211,323

[22] Filed: Dec. 15, 1998

Related U.S. Application Data

[60] Provisional application No. 60/069,746, Dec. 16, 1997.

[51] Int. Cl.[7] ..... F25C 3/04

[52] U.S. Cl. ..... 239/2.2; 239/14.2; 239/276; 239/280.5; 239/135; 239/407; 239/418; 239/433; 239/565; 248/122.1; 248/161

[58] Field of Search ..... 239/2.2, 14.1, 239/14.2, 128, 135, 139, 276, 280, 280.5, 281, 407, 418, 433, 550, 556, 560, 565, 566, 581.1; 248/122.1, 125.1, 125.2, 161, 413

[56] References Cited

U.S. PATENT DOCUMENTS

| | | | |
|---|---|---|---|
| 2,676,471 | 4/1954 | Pierce, Jr. . | |
| 2,968,164 | 1/1961 | Hanson . | |
| 3,567,117 | 3/1971 | Eustis . | |
| 3,610,527 | 10/1971 | Ericson . | |
| 3,703,991 | 11/1972 | Eustis et al. . | |
| 3,706,414 | 12/1972 | Dupre . | |
| 3,733,029 | 5/1973 | Eustis et al. . | |
| 3,814,319 | 6/1974 | Loomis | 239/14.2 X |
| 3,822,825 | 7/1974 | Dupre . | |
| 3,948,442 | 4/1976 | Dewey . | |
| 3,952,949 | 4/1976 | Dupre . | |
| 3,964,682 | 6/1976 | Tropeano et al. . | |
| 3,979,061 | 9/1976 | Kircher . | |
| 4,004,732 | 1/1977 | Hanson . | |
| 4,105,161 | 8/1978 | Kircher . | |
| 4,194,689 | 3/1980 | Ash . | |
| 4,199,103 | 4/1980 | Dupre . | |
| 4,275,833 | 6/1981 | Fairbank . | |
| 4,749,127 | 6/1988 | Ash | 239/14.2 |
| 4,813,597 | 3/1989 | Rumney et al. . | |
| 5,004,151 | 4/1991 | Dupre . | |
| 5,154,348 | 10/1992 | Ratnik et al. | 239/14.2 |
| 5,360,163 | 11/1994 | Dupre | 239/281 X |
| 5,593,090 | 1/1997 | Werner | 239/14.2 X |
| 5,667,137 | 9/1997 | Dupre | 239/14.2 |
| 5,823,427 | 10/1998 | Dupre et al. | 239/14.2 |

*Primary Examiner*—Andres Kashnikow
*Assistant Examiner*—Steven J. Ganey
*Attorney, Agent, or Firm*—Reising, Ethington, Barnes, Kisselle, Learman & McCulloch, P.C.

[57] ABSTRACT

Method and apparatus for making snow by generating water spray from a triple array of multiple nozzle sub-boom branch-pipes transversely protruding from the upper end of a main boom of a pivotably adjustable snow making pipe tower. Three air jet streams, one for each branch pipe, are simultaneously discharged under high pressure into and sequentially through the throats of each associated multiple stack of water sprays issuing from each set of branch pipe nozzles to thereby form multiple spray plumes of atomized and seeded water all directed forwardly from the upper end of the tower pipe. The water pipe may be an elliptical aluminum extrusion with two interior air tubes respectively controllably feeding large and small diameter air jet arrays to thereby provide a range of air jet water spray interaction. The pipe tower may be pivotally raised and lowered by a block-and-tackle or chain fall type drive mechanism that may be recoupled to the tops of a lifting pole and tower pipe for bodily raising the entire tower pipe and its support pipe telescopically on a ground support pole. Spreader-supported guy wires may be used to brace the tower pipe and also provide an electrical deicing circuit. Air jet control, blow-out valving and water drain conduit arrangements are disclosed, and also universally adjustable ground support systems for the pipe tower, including an underground-fed combined telescopic hydraulic ram forming air and water conduits.

62 Claims, 16 Drawing Sheets

FIG. 1A
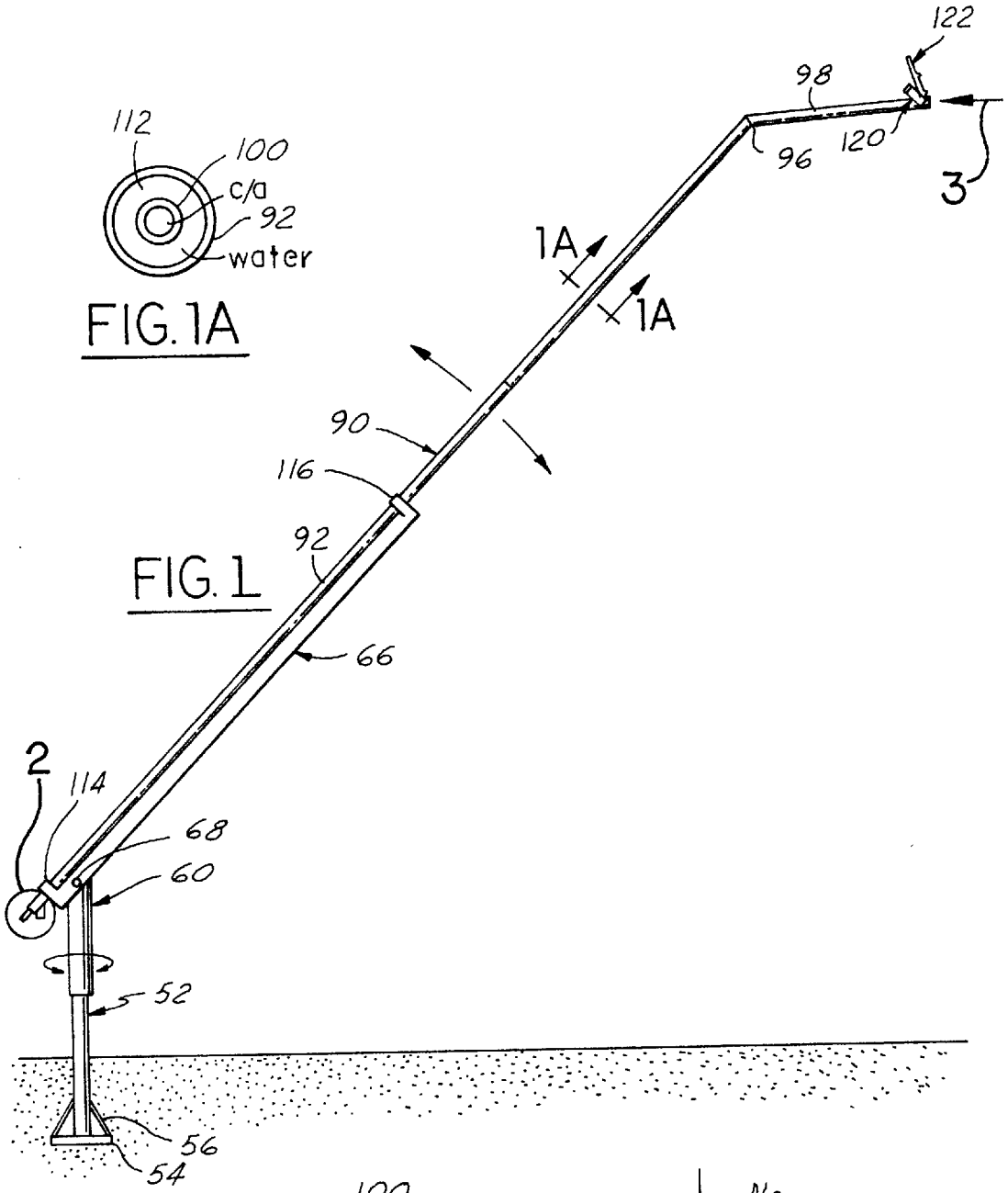
FIG. 1
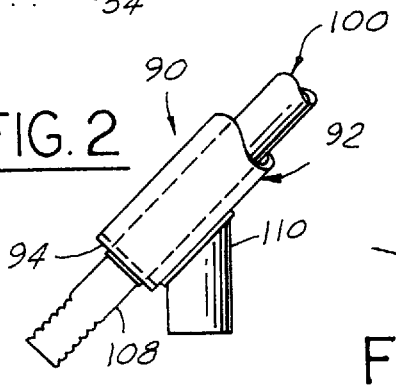
FIG. 2
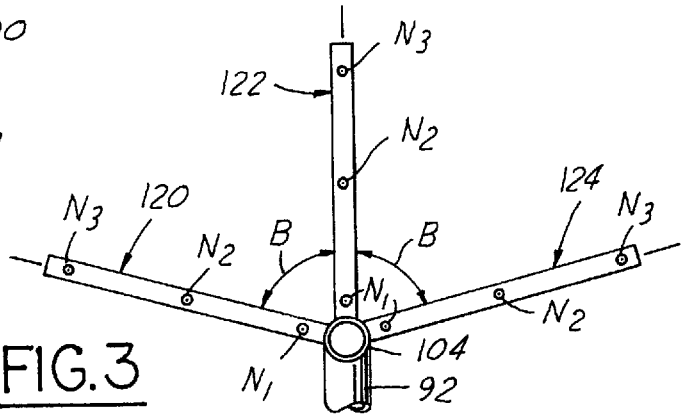
FIG. 3

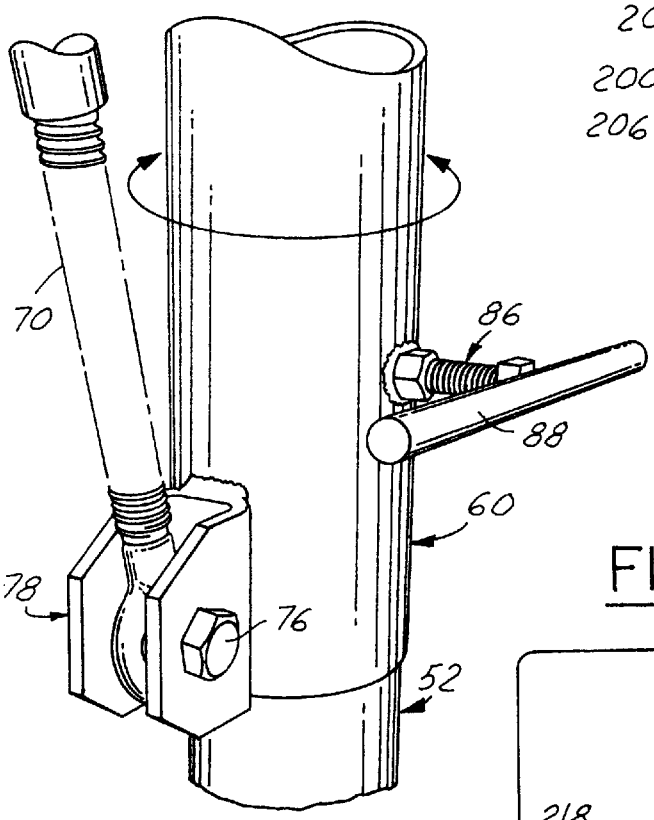
FIG. 18
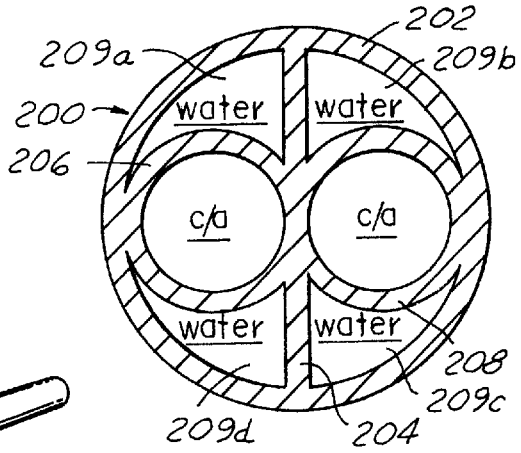
FIG. 19
FIG. 20
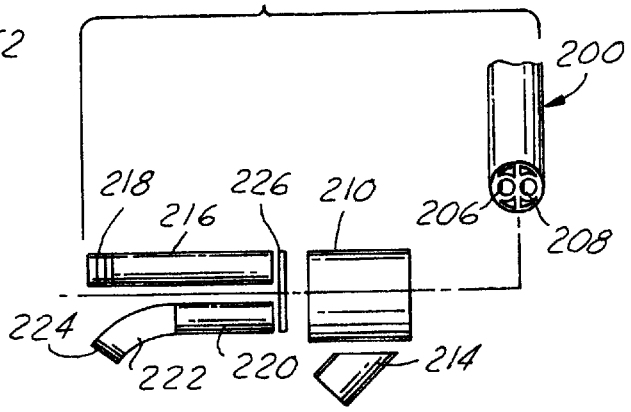
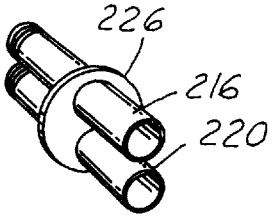
FIG. 21
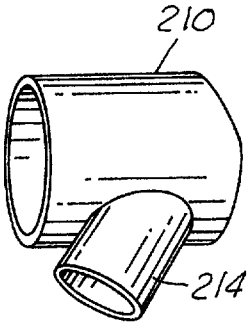
FIG. 22
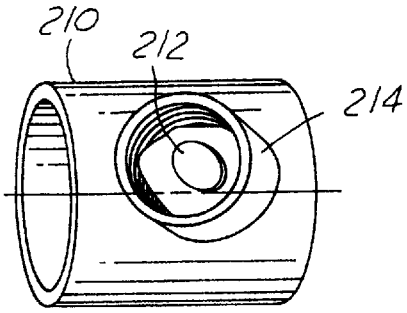
FIG. 24
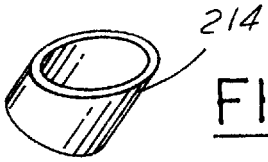
FIG. 23

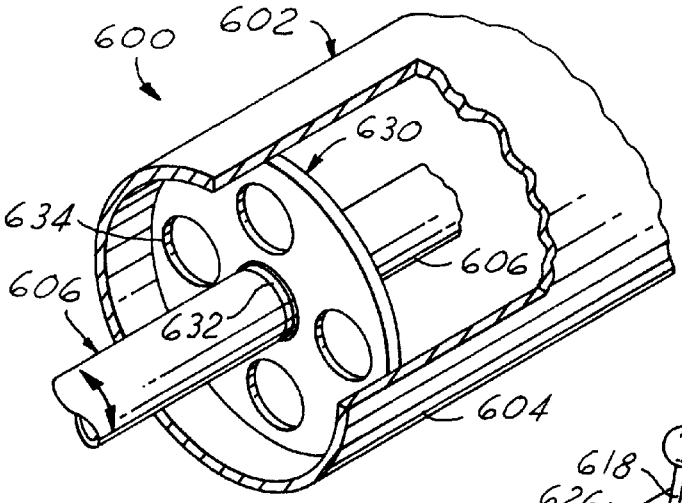
FIG. 39
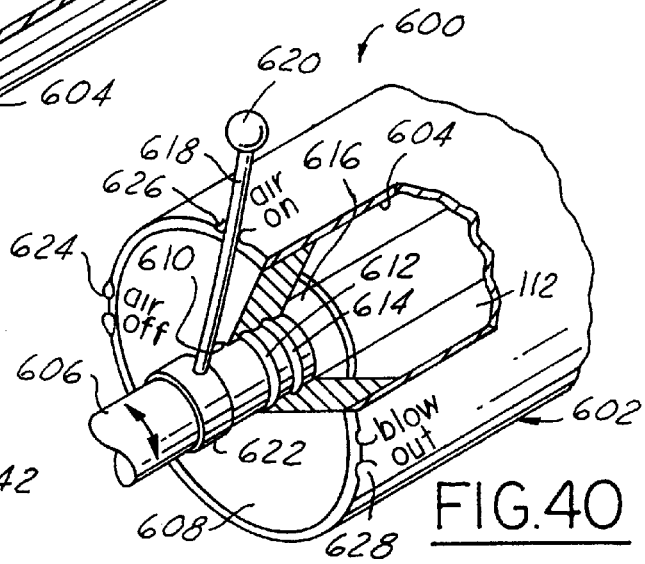
FIG. 40
FIG. 41
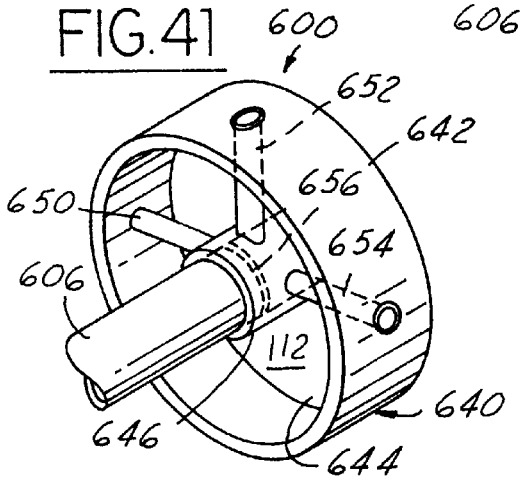
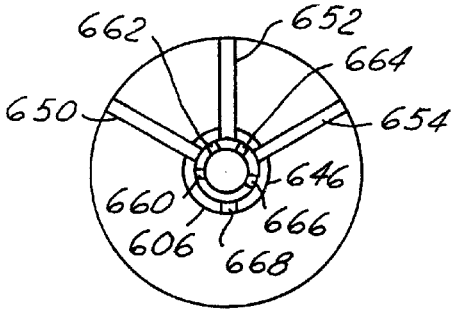
FIG. 42A AIR-OFF
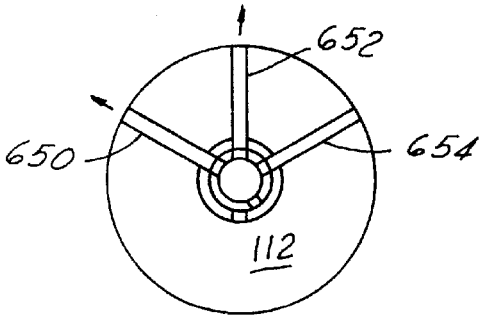
FIG. 42B
AIR-ON
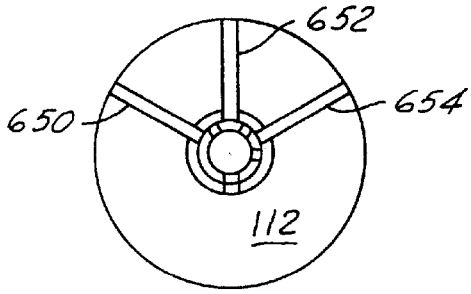
FIG. 42C
BLOW-OUT

ADJUSTABLE SNOW MAKING TOWER

This is a regular United States patent application filed pursuant to 35 USC Section 111 (a) and claiming the benefit under 35 USC Section 119 (e) (1) of U.S. Provisional Application Ser. No. 60/069,746 filed Dec. 16, 1997 pursuant to 35 USC Section 111 (b).

FIELD OF THE INVENTION

The present invention relates generally to the art of snow making and an improved method and apparatus for artificially making large volumes of high quality snow suitable for skiing, and more particularly to universally adjustable snow making pipe towers for ski slopes.

BACKGROUND OF THE INVENTION

Numerous systems have been developed for artificially producing snow wherein water and air under pressure are in some manner mixed and commingled. The principle involved is to reduce the size of water particles to the smallest size possible, typically by high pressure discharge of water through an atomizing nozzle orifice and augmented by injection of compressed air directly or indirectly with the water or mixing with air using deflectors and baffles within a mixing chamber.

Artificial snow is formed from seed crystals. Preferably, these seed crystals are formed from the expansion of compressed air expelled into the atmosphere within and around which minute water particles freeze and form artificial snow. The air, being compressed, is at a higher temperature than normal ambient winter air conditions and when expelled to ambient will expand to atmospheric pressure while simultaneously dropping greatly in temperature. Because of the refrigerating effect of such pressure reduction, if there is a high quantitative level of moisture vapor present in the compressed air, such moisture vapor upon expansion will condense, immediately forming seed crystals necessary for seeding atomized water spray particles for snow making. Of course, impingement of the expanding compressed air stream upon associated atomizing-spray-generated water particles also form such seed crystals. These seed crystals are immediately formed because of the extremely low temperature condition obtained through the expansion of the air together with the freezing effect of atmospheric conditions of winter, that is, temperatures below 32° F. The seed crystals thus formed can be combined with the remaining water particles of the atomized water spray in a manner to form more artificial snow.

In connection with the atomizing of water for snow making, the water particle size should be as small as possible, because if such particles are too large, depending on ambient weather conditions and the ratio of water to air mixture, they will produce ice or sleet particles which are unsatisfactory for desirable skiing conditions. Also, the greater the water pressure at the discharge nozzle, the smaller the water particles or moisture droplets upon nozzle discharge.

There is no question that the most expensive operational cost component in any practical snow making system is the cost of generating the compressed air, which represents about 90 percent of the costs of consummables in the making of snow. In particular, compressor equipment necessary for an entire ski slope is very expensive to purchase and operate. Even in the face of these air compressor costs, it can be readily seen from the foregoing that these costs are further augmented by the efficiency loss of air pressure delivered to the system and discharged at the snow nozzles.

If these efficiency losses can be reduced in combination with a reduction of the amount of air pressure needed at the discharge nozzle, cost and operational expense of compressor and pump equipment can be substantially reduced while utilizing the pumping equipment of the snow making system at optimum efficiency levels. Air compressor costs cannot be eliminated, as compressed air is needed (except at very low ambient air temperatures and low humidity) because of the ability of the compressed air upon expansion into ambient to provide seed crystals. But these costs can at least be reduced through the optimum employment of equipment and the reduction of compressed air needed in snow making.

The art and science of producing artificial snow, or ice crystals physically resembling natural snow, has grown in importance over the last forty or so years with the increased interest in wintertime sports, most notably skiing. An accompanying concern in view of the vagaries of climatic conditions at the geographic location of most ski resorts is the ability to produce the maximum quantity, as well as quality, of artificial snow as efficiently as possible, particularly in view of the need to minimize the energy consumption per unit of artificial snow produced.

One of the earliest methods developed for producing artificial snow comprised mixing compressed air and water within a nozzle to effect particle formulation upon spraying of the internally-formed air/water particle mixture into the atmosphere at a temperature at or below freezing. Such a method and snow making "snow gun" is disclosed in Pierce, U.S. Pat. No. 2,676,471 issued in 1954. Although this Pierce snow gun method can cause snow crystals to be formed even at ambient air temperatures slightly above 32° F., it nevertheless is operationally inefficient and consumes a considerable amount of energy. The Pierce snow maker "snow gun", which internally mixes compressed air with water within a spray nozzle, also is highly susceptible to nozzle clogging. Furthermore, such Pierce snow gun units depend upon the force of the compressed air to move the crystallized snow beyond the immediate area of the nozzle. The volume of compressed air required per unit volume of deposited snow is therefore quite high, resulting in poor energy utilization.

A substantial improvement over snow guns in making artificial snow was disclosed in Hanson U.S. Pat. No. 2,968,164 issued in 1962. Water droplets were sprayed directly into a high volume of moving air, at or below freezing temperature, which was generated by a platform-mounted fan. It was also found such snow formation could be improved by directing "seeding crystals", produced by combining compressed air and water internally in a spray nozzle (i.e., using a snow gun seeder), into the moving air flow into which the water droplets had been sprayed.

Following these basic Pierce and Hanson developments in the art, various improvements have been made, primarily in particular combinations and refinements in the manner in which seeding crystals are formed and injected, and how water droplets are introduced into a moving air-stream and the manner in which snow machines are constructed, mounted and elevated.

Thus in the late 1960's and early 1970s the Hanson-type of fan snow-making machine and method became commercially available in the form of fan-type snow making machines wherein a high-powered, electric-motor-driven fan, mounted within a cowling provided a substantially unidirectional high volume movement of air, and an array of water spray nozzles outside of the fan cowling provided water spray to be injected into the high volume movement at a rate and in a quantity sufficient to cause crystallization of the spray and deposition of the crystals as artificial snow. More particularly, Eustis et al U.S. Pat. Nos. 3,567,117; 3,703,991; and 3,733,029 disclosed such a snow making machine and method (sold commercially under the trademark "HEDCO"®) whereby the fan generated movement of air directed from within a tunnel-like housing in which were provided both nozzles combining compressed air and water to form seeding crystals and a water nozzle. The related Dewey U.S. Pat. No. 3,948,442 disclosed a snow making machine with a motor-driven fan housed in a duct-like housing which also contained a nozzle for producing seeding crystals, while an array of water nozzles were provided in even distribution around the entire 360 degree circumference of the opening of the housing through which the airstream flows.

Another type of fan snow maker was disclosed in Ericson U.S. Pat. No. 3,610,527 wherein the atomizing technique involves movement of a film of water over the surfaces of a multi-blade fan, so as to effect improved evaporation and formation of snow without requiring use of compressed air for seeding or otherwise, this snow maker having been successfully commercialized under the trademark "SNOW-STREAM"®.

In the aforementioned HEDCO snow making machine constructed pursuant to the aforementioned Eustis et al. and Dewey patents a large fan is employed to move the crystallized snow beyond the area of the nozzle. However, compressed air and water are still internally mixed within one seeding (snow gun) nozzle and water is added to the fan-moved air by a second exterior nozzle. The seeding nozzles are disposed within the protective cowling of the fan, thereby resulting in additional difficulties in repairing clogged nozzles.

To overcome such problems, Everett Kircher invented (in early 1972) an improved fan snow maker as disclosed in Kircher U.S. Pat. No. 3,979,061. The Kircher '061 patent snow machine provided a dual array of nozzles surrounding the outside circumference of the opening of a duct within which a motor-driven fan generated an airstream. The inner array of nozzles injected high pressure water spray into the fan-propelled ambient air stream and the outer array of nozzles, arrayed individually in close proximity to each of the water nozzles, injected compressed air into the water spray of an adjacent water nozzle and also into the air stream. By so causing an "external" mixing in ambient of the expanding compressed air jet with an associated plume of water spray droplets, an increased volume of high quality snow is achieved by such plurality of water and air nozzles arrayed about the periphery of the high volume fan-propelled air flow movement. The respective nozzles are thus so disposed that each water spray is intersected and scattered by a high velocity air stream at the outer boundary of the main air movement. To achieve maximum scattering of water spray particles, the several high velocity air nozzles were spaced outwardly from the water spray nozzles so that the high velocity air streams convergently intersect the water sprays at relatively narrow acute angles tending to force the spray particles forward and into the center of the high volume air movement. The high velocity water spray and associated high velocity air stream are thus directed into a large volume air movement at first and second convergent angles with respect to the direction of movement thereof. The high velocity air stream intersects the water spray at a point remote from their respective nozzles to thereby achieve maximum dispersion of water particles throughout the unidirectional high volume air movement per unit volume of compressed air.

Thus an important feature provided by the Kircher '061 invention is preventing mixture of the water spray with high pressure compressed air until after both streams are in an unconfined state, i.e., "external" mixing and concurrent seed generation. This not only helps break up the water spray into finer particles, but also helps to better disperse the particles into and throughout the high volume movement of low pressure air in ambient atmosphere. Simultaneously, through the refrigeration effect of the rapidly expanding unconfined compressed air, seeding particles are generated at the point of intermixture of the water droplets of the air stream. Equally important, since there is no intermixture of air and water either within the nozzles or within the cowling, there is no chance for icing conditions to occur within any confined line, nozzle, passageway or the like. Hence the apparatus is relatively clog-free in operation.

As another feature, the Kircher '061 apparatus also eliminates the necessity of air and water pressure balancing in the respective air and water nozzle supply conduits, and thus permits maximum possible water pressure to be used at each individual snow machine. This is particularly advantageous in a down-hill line up of such machines fed from a common water supply hydrant system. Also, the greater the water pressure, the better the atomization of the water into fine particles of water. Consequently, less compressed air need be utilized in the snow making process if pressure balancing is not a factor. This results in the reduction of the amount of compressed air necessary in the snow making operation, thereby reducing the operational expense, in particular, of that element in the snow making operation which is the most expensive. Again, the '061 patent accomplishes this by not mixing the air directly with the water in a mixing chamber or within intercommunicating conduits in the machine per se, but rather by applying all compressed air externally (i.e., after it leaves the confines of its nozzle orifice and is unconfined in the ambient atmosphere) to similarly unconfined water fog produced after the high pressure water exits its water discharge nozzle. Also, the discharged air is directed to the throat of the water fog produced by the water nozzle.

Subsequently, the Dupre U.S. Pat. No. 3,822,825 apparatus utilized this '061 patent external air/water mix principle as applied to an array of air and water nozzles mounted at a high elevation on the upper end of an upright snow making water spray pipe tower. By so providing a compressed air nozzle adjacent and above a water atomizing nozzle for external mixing, as in the Kircher '061 patent invention and in the Dupre '825 patent, better snow making conditions can be obtained for two principal reasons. First, the compressed air, upon being expelled from the air nozzle into the atmosphere, is greatly reduced in temperature, causing it to give up its moisture in the form of seed crystals. These seed crystals form almost instantaneously. The air nozzle is positioned in a manner to be narrowly convergently directed into the throat of the water fog produced by the water nozzle to bombard as well as forwardly propel the water particles, which in many cases are as small as 200 microns or less, thereby uniting with these water particles to make snow particles or produce more seed crystals necessary in making snow.

It also should be understood that with all types of snow making apparatus "dwell time" is a critical parameter. In order to make artificial snow, the tiny atomized water particles need something to unite with other than falling through the ambient atmosphere. This is because of the surface tension of these minute water particles. Upon contact with one or more seed crystals, however, the surface tension of the water particles is broken and the unification of the seed crystal or crystals with the water particles will produce a multitude of snow flake-like crystals. This process continually occurs as the seed crystals and water particles intermingle during their fall to the ground. In this connection, it is important to provide for optimum conditions, which is governed by the best atomized spray possible to produce the smallest water particles as possible upon discharge, while not sacrificing the maximum distance or "throw" of discharge from the snow machine. Thus, optimum area of snow coverage is obtained, by providing maximum dwell time in which the seed crystals and tiny atomized water particles may completely commingle and unite to form snow prior to reaching the ground. Upwardly directed fan machines can accommodate these dwell time and throw factors fairly well with ground level mounting, but rather early on both snow guns and external mix and water nozzles were tower mounted in order to achieve such desirable dwell times.

Secondly, the expanding air from the air nozzle will help shred the atomized water particles into smaller and finer particles or droplets. This will permit the unification of many times more seed crystals with water particles for artificially forming snow skiing conditions.

In summary, in both external mix snow making fan and pipe tower apparatus, as well as in internal mix snow guns, the compressed air performs these functions; upon expansion:

1. it shreds the atomized water particles, either within or outside of the spray nozzle, into finer water particles;
2. it implants seed crystals in the atomized water spray or fog; and
3. it cools the entire discharge zone to an extremely cold condition highly desirable for snow making. This temperature at discharge has been known to be as low as minus 100° F.

The Kircher '061 patent also discloses a "blow out" feature to dry the water conduit and spray nozzle system. After the water manifold is disconnected from the water source and the inlet aperture to the water manifold is opened to drain water therefrom, such blow out is accomplished by valving that directly connects the compressed air supply line leading to an air nozzle to an associated water nozzle such that a high velocity stream of compressed air is diverted from the air nozzle into the water nozzle and into water supply system of the snow machine, thereby driving the water from the system and preparing the water system for dry shut-down. That is, turning a three-way valve to the blow out position forces water in both directions from its point of entry into this valve so as to blow water out the ends of the water nozzles as well as to blow the water out of the water manifold via the open inlet. Hence, in a relatively short time, the water nozzles and the water manifold can be dried so that they do not freeze and clog during shut down.

The provision of the aforementioned low volume, high pressure air nozzles in snow making apparatus thus enables artificial snow to be made under adverse climatic conditions; i.e., when the dry bulb temperature is between 25° and 32° F. and the relative humidity between about 60 and 100 per cent. This result is believed to accrue from the aforementioned combined action of the refrigerating and dispersing effects of the high velocity, high pressure air stream.

Of course, as further pointed out in Kircher '061, when conditions are favorable for making artificial snow, as when the ambient air temperature is well below freezing, and the humidity is also low, the quantity of high pressure air can be cut down, i.e., the air/water ratio water-enriched, by reducing the number of compressed air nozzles in operation and even all entirely shut off, and good quality snow will still result merely from the mixture of water spray into the main air stream and ambient atmosphere. Conversely, as conditions worsen for producing artificial snow, the air/water ratio can be adjustably leaned out by having the additional air jets cut back into operation while the snow making machine continues in operation.

In this regard yet another feature of the paired three-way valving arrangement of the Kircher '061 patent is that it also enables the air/water ratio to be water-enriched by supplying high pressure water to any selected number of air nozzles to convert them to operate as additional water nozzles when conditions are very favorable to making snow; i.e., at the aforementioned very low temperature and humidity conditions when snow can be made with maximum discharge of water and a minimum amount of dispersion of water particles. This water "supercharging" feature thus further augments the flexibility of the apparatus of the Kircher '061 invention to meet a wide variety of snow making conditions.

It will be seen that this optional water supercharging use mode of additional water spray nozzles in the Kircher '061 patent snow making machine thus insures full utilization of the air discharged under pressure through the remaining open compressed air nozzle orifices that remain paired with associated water spray nozzles. By so discharging additional water under pressure through at least one additional water nozzle positioned adjacent to the first water nozzle which emits the spray interacting with the associated air jet stream, such that the additional water spray is directed into the resultant plume to interact therewith in ambient, the quantity of excellent quality snow produced may be greatly increased with the same compressed air consumption but without this addition of the extra "supercharging" water undesirably forming ice.

The foregoing "water supercharging" feature of the Kircher '061 patent was also subsequently applied to a rotatable and pivotable (universally manually adjustable) tower-supported snow gun array in the Tropeano et al U.S. Pat. No. 3,964,682. Likewise, in the Dupre U.S. Pat. No. 5,004,151 this water "supercharging" principle was applied to the earlier Dupre '825 patent external mix snow tower apparatus by providing additional water nozzles oriented to spray convergently into the ambient plume generated by paired air and water nozzles arrayed at the upper end of the snow tower.

It also has been long recognized as a general principle in the snow making art that the quantity of snow produced is a function of the amount of water used. However, under ambient air conditions of given temperature and humidity and for a particular rate of high-volume air movement, whether wind or fan-produced, only a limited amount of water may be sprayed onto the air movement and result in a high-quality, dry snow. Excess water may cause either a "dribble effect" with either fan-machines or snow making pipe towers or a deposit of undesirably wet snow, or both. Thus, there is a trade-off between snow quantity and quality for a given apparatus which varies in accordance with climatic conditions.

Accordingly, Hanson U.S. Pat. No. 4,004,732 added powered rotational and pivoting (oscillating) movement under an automatic control system to the Kircher '061 patent fan snow machine to better optimize snow making under varying climatic conditions. Then, as disclosed in Kircher et al U.S. Pat. No. 4,105,161, an improved and commercially successful method and fan-type snow making apparatus was made available (as sold under the trademarks "BOYNE SNOWMAKER"® and "HIGHLANDER"®) wherein the water nozzles are grouped in an accurate array entirely above the center line of the air stream and a deflector is used in combination therewith to direct a lower portion of the air stream upwardly toward these nozzles, for the purpose of reducing "dribble" and increasing the loft of the snow produced and propelled outward in the air stream. The Kircher et al '161 patent snow making machine also utilizes a seeding nozzle preferably cooperatively located within the "shadow" of the deflector to improve snow particle formation without re-introducing a dribble effect.

Of course, as indicated previously, it was also recognized early on in the snow making art that if the height of the snow maker above ground is increased, the quality of the snow increases due to the longer dwell time (the period of time from when the seed crystals are formed in the plume in front of the nucleator nozzles to the time that they reach the ground in the form of snow flakes). Thus, at least by the mid 1980's it was also common practice to elevate the aforementioned fan-type "BOYNE SNOWMAKER" and "HIGHLANDER" snow machine by tower mounting them, and likewise providing for pivotal (vertical plane) and rotational (horizontal plane) universal motion of these fan-type snow makers on their tower mounts.

Moreover, as early as in 1972, Dupre U.S. Pat. No. 3,706,414 disclosed a snow making system utilizing high snow pipe towers having discharge nozzles at the top of the tower that operated without fan-assist. Pressurized air and water are introduced at the bottom of each tower of the system where they are commingled to reduce the water into fine water particles which are discharged from the top of the tower approximately 35 feet above the ground and produce the seed crystals necessary to produce snow. The advantage obtained from this system is that, even without fan augmented dwell time, due to the tower height a characteristically long dwell time can be obtained, that is, the time between the time the seed crystals are formed upon discharge into the ambient atmosphere and the time the snow crystals, as formed from the seed crystals, finally settle upon the ground. Under suitable climatic conditions, this lengthy dwell time provides for sure and sufficient seed crystal formation of the atomized discharge as well as complete formation of good, well frozen snow crystals upon settling to the ground. Also, this system of high pipe snow towers does not usually interfere with recreational use of the ski slope, as skiers can use the slope while the snow making process is in progress. Further, a larger area of snow coverage can be efficiently obtained. Another advantage of pipe snow towers is low manufacturing cost and also reduced maintenance cost, in that once this snow making tower system is installed, little or no further maintenance costs will be incurred as the life of the system is as long as the life of the pipe employed in the system.

The later Dupre U.S. Pat. Nos. 3,822,825 and 3,952,949, in addition to utilizing the aforementioned Kircher '061 patent feature of external mix (in ambient) of compressed air and water spray to cause snow making "fog" at the top of the snow making tower, provided an improvement in such elevated snow making pipe towers by disposing the compressed air supply line within the water pipe that formed the tower so that the air line is isolated from the water line while at the same time it is protected from freezing ambient atmosphere by the surrounding water until the air reaches its discharge orifice to ambient at the top of tower.

Subsequently, the 1980 Dupre U.S. Pat. No. 4,199,103 provided a snow making pipe tower having the Dupre '825 patent features as well as greater "snow throwing" adjustability by providing a ground support pivot mount for the lower end of the snow making tower that also provided some rotational (swinging of the pipe in a horizontal plane) capability in addition to the swinging-in-a-vertical-plane pivotal adjustment capability. The later (1994) Dupre U.S. Pat. No. 5,360,163 improved the tower adjustment capability of the Dupre '103 patent adjustable snow making tower by detachably mounting the tower pipe on a support arm that is pivotally mounted on a rotatable support pipe that in turn telescoped onto a fixed ground support pole, and by manually adjusting the pivot angle of the tower pipe with a jackscrew coupled between the support tube and pivotal tower pipe, albeit generally in the manner of the manually and universally adjustable snow gun tower construction of the aforementioned Tropeano et al '682 patent.

Still another type of snow making apparatus known in the patented prior art, but apparently not commercially prevalent or practical, is represented by the U.S. patents to Ash U.S. Pat. No. 4,194,689; Fairbank U.S. Pat. No. 4,275,833; Rumney et al U.S. Pat. No. 4,813,597 and Werner U.s. Pat. No. 5,593,090. In general, the snow making devices disclosed in these patents employ a horizontally elongated piping array of side-by-side water spray nozzles either operating generally in manner of the aforementioned internal mix compressed air and water snow gun devices or, as in some vertical nozzle array pipe snow towers, with water spray nozzles alone augmented by chemical water supply snow making additives, and with the horizontal array being either stationary or rotatable and either ground or tower mounted.

In any event, it is well recognized in the snow making industry that the fan-type snow makers remain today as the most efficient commercially available means (in terms of operating costs) of producing artificial snow in quantity, particularly under adverse snow making conditions when snow is most needed, i.e., at elevated wet bulb temperatures (at least in the case of the aforementioned Kircher et al '161 patent fan-type machines). Nevertheless, the adjustable snow making pipe towers, as exemplified by the aforementioned Dupre patents, as well as portable single nozzle snow guns, remain less expensive to manufacture and maintain and thus can economically augment artificial snow making when snow making conditions are more favorable. Accordingly, in modern sophisticated snow making management as practiced at larger ski resorts today, there may be found a judicious operational mix of all three types of commercially prevalent snow makers, i.e., (1) single nozzle portable snow guns, as used primarily for limited bare spot and ski lift station "touch-up" throughout the ski season, (2) multiple-nozzle fan-type snow making machines (both ground and tower supported) for most economical operation under adverse snow making conditions to generate at high output the majority of artificial snow in building the pre-season and early season "base", and (3) the less expensive to manufacture and maintain, vertical array multiple nozzle type, snow making pipe towers (either fixed or adjustable mount) for cold weather snow making and thus primarily to augment mid-season snow production.

OBJECTS OF THE INVENTION

Accordingly, among the objects of the present invention are to provide an improved adjustable snow making pipe tower, and an improved method of making artificial snow utilizing the same, that provide all of the tower "snow throw" universal adjustment capability advantages, and more, of the aforementioned universally adjustable tower mounting of Tropeano et al '682 and Dupre '163 patents, the anti-freeze-up advantages of externally mixing of compressed air and water spray as featured in the aforementioned Kircher '061 and Dupre '825 patents, and an improvement in the heat exchange and anti-freeze up, air pipe-within-water pipe, economizer capability of the aforementioned Dupre '825 patent, while at the same time providing improved snow making performance and operational economy, providing greater strength-to-weight ratio in the tower pipe structures, thereby lowering cost and enabling greater pipe lengths and thus greater height, wider throw area, and longer dwell time providing adjustability of air-to-water ratio in operation, providing improved ground mount tower height adjustment features, and as further options, providing adjustable wind-controlled tower orientation in operation, in-use de-icing capability and water conduit and nozzle blow-out drying at shut down.

BRIEF DESCRIPTION OF THE DRAWINGS

The foregoing as well as additional objects, features and advantages of the present invention will become apparent from the following detailed description of the best mode, appended claims and accompanying drawings wherein:

FIG. 1 is a simplified side elevational view of a first embodiment of an adjustable snow making tower constructed in accordance with the present invention shown in one of its operative, universally adjustable snow making positions.

FIG. 1A is a cross sectional view taken on the line 1A—1A of FIG. 1.

FIG. 2 is a fragmentary side elevational view of the portion of the structure encompassed by the circle 2 in FIG. 1.

FIG. 3 is an end elevational view of the upper end of the pipe snow making tower looking in the direction of the arrow 3 of FIG. 1.

FIG. 18 is a fragmentary perspective view of the ground support pole, and associated support pipe, jack screw and set screw of the structure shown in FIG. 14 but greatly enlarged thereover.

FIG. 19 is a radial cross section through the main pipe extrusion of a second embodiment adjustable snow making tower also constructed in accordance with the present invention.

FIG. 20 is a fragmentary part plan-part perspective exploded view of the components of the lower end of the main pipe assembly of the second embodiment snow making tower structure.

FIG. 21 is a perspective view of a subassembly of the two inlet air pipes and associated end wall disk components shown in FIG. 20.

FIG. 22 is a perspective view of the subassembly of the collar and water inlet pipe component shown in FIG. 20.

FIG. 23 is a perspective view of the water inlet pipe component of the subassembly of FIG. 22.

FIG. 24 is another perspective view of the subassembly shown in FIG. 22.

FIGS. 39, 40 and 41 are fragmentary perspective views of portions of a sixth embodiment adjustable snow making tower construction of the invention; FIG. 39 showing a portion of the rotatable air pipe supported in a perforated disk within the confines of the outer main water pipe conduit of the tower pipe, FIG. 40 illustrating the lower end of the pipe with a control handle for rotating the air pipe about its axis to various operating positions thereof, and FIG. 41 illustrating the upper end cap of the main pipe with the rotary air pipe and cooperative rotary valve.

FIGS. 42A, 42B and 42C are cross sectional views diagrammatically respectively illustrating the three operational modes ("air-off", "air-on" and "blow-out") of the rotary valve of FIG. 41.

DETAILED DESCRIPTION OF THE PREFERRED EMBODIMENTS OF THE INVENTION

First Embodiment Adjustable Snow Making Tower

Figure 16:
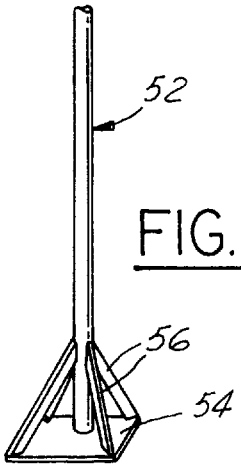
FIG. 16 is a perspective view of the ground support pole and associated ground anchor platform and stabilizing struts of the ground pole subassembly.

Referring in more detail to the accompanying drawings, FIGS. 1–18 illustrate the construction and components and operation of a first embodiment of an adjustable snow making tower 50 of the present invention. Tower 50 is comprised of a ground support structure which, in the first embodiment, includes a substantially vertical support pole 52 (FIGS. 1, 14, 16 and 18) which may be a conventional cylindrical steel pipe of, for example, four to six inches in outer diameter and some ten to twelve feet in overall length. The bottom end of pole 52 is welded to a rectangular anchor plate 54 and braced thereon by four gusset struts 56 as shown in FIGS. 1 and 16. The lower half of pole 52 along with the anchor plate 54 and associated struts 56 are buried in the ground so that approximately only four to five feet of pole 52 protrude above the ground surface 58 (FIG. 1). Support pole 52 must be securely anchored into the ground because tower 50 must support a good deal of structural weight (approximately 1500–2000 lbs) and additional water-fill weight. In addition, during operation water is being ejected from the snow making tower nozzles supported at the upper end of the structure of the present invention at very high pressures (e.g., 100–500 psi) and at angles relative to the vertical extent of the tower, thereby creating varying backward thrusts at high elevations on the tower.

Figure 14:
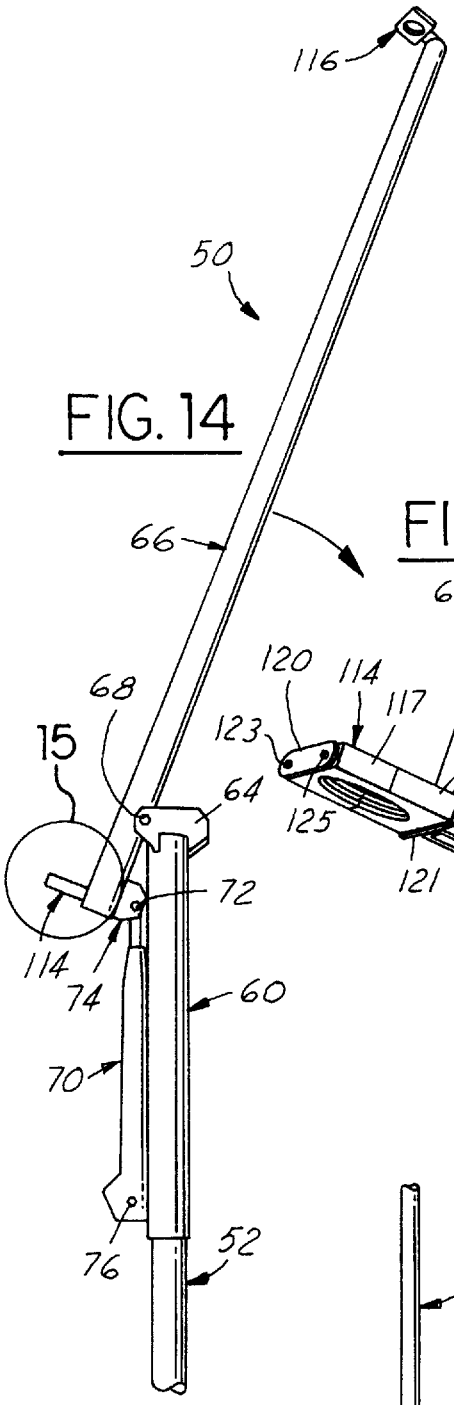
FIG. 14 is a fragmentary side elevational view illustrating the ground support pole, associated support pipe telescopically mounted thereon and the box beam pipe cradle and jackscrew subassembly of the adjustable snow making tower of FIG. 1.
Figure 15:
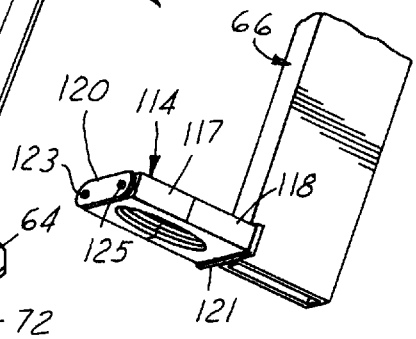
FIG. 15 is an enlarged fragmentary perspective view of the portion encompassed by the circle 15 in FIG. 14.
Figure 17:
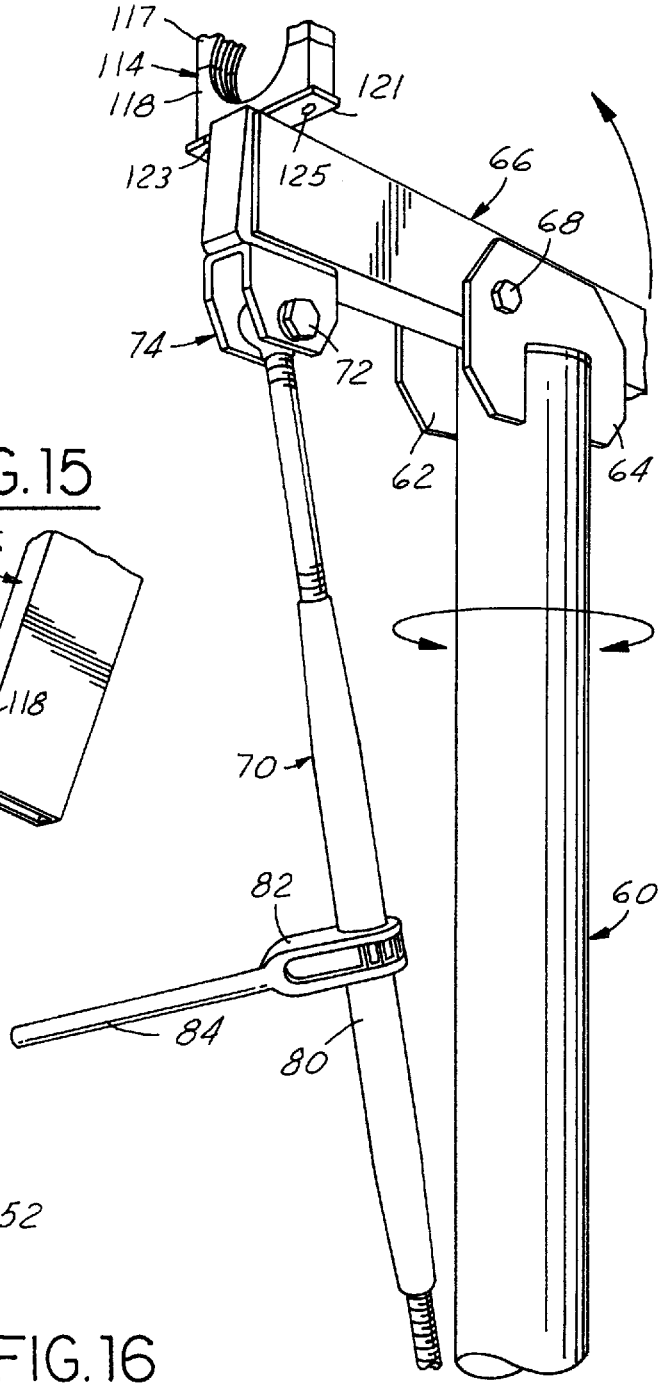
FIG. 17 is a fragmentary perspective view of a portion of the tower support structure shown in FIG. 14 and greatly enlarged thereover, and with the cradle pivoted to a horizontal position by the associated jackscrew.

A support pipe 60 is coaxially telescopically received over support pole 52 for support thereon and for free rotation thereon about the vertical pole axis through a full 360°, as indicated by the rotational direction arrow in FIGS. 17, and 18. A main pipe support bracket is carried at the upper end of support pipe 60 and consists of a pair of steel plates 62 and 64 mounted in parallel, spaced apart relationship by welding the plates at notched cut outs to the exterior of pole 60, as shown in FIGS. 14 and 17. Bracket plates 62, 64 pivotally support a cradle box beam 66 (FIGS. 1, 14, 15 and 17) for swinging in a vertical plane about a pivot axis provided by an axle bolt 68 that extends through the plates and beam, and that is oriented generally in vertical alignment with the rear side of pipe 60 (left hand side as viewed in FIG. 14). This permits cradle 66 to be pivoted to swing in a vertical plane from a substantially horizontal orientation shown in FIG. 17 upwardly to an angle of about 70° from horizontal, i.e., to the maximum elevated position shown in FIG. 14.

A conventional two-way screwjack 70 of the turn buckle type has its upper end eye fixed by a pivot bolt 72 to a U-bracket 74 welded to the underside of cradle 66 at the rear end thereof (FIGS. 14 and 17). As best seen in FIG. 18, the axially opposite, lower end of jack 70 has its eye pivotally fastened by a pivot bolt 76 to a U-bracket 78 welded to the exterior of pipe 60 adjacent the lower end thereof. The internally threaded sleeve 80 of jack 70 carries a ratchet mechanism 82 operated by a handle 84 which is manually swung back and forth to ratchet rotate sleeve 80 to take up or extend the jack in order to selectively drive cradle 66 through the aforementioned range of vertical pivotal movement in a vertical plane about pivot pin 68, and also to securely hold the cradle at any given selected angle in its swing range. Preferably, the protruding threads of pivot bolts 72 and 76 are upset or blocked by a tack weld in order to permanently affix jack 70 in its mounted position so the jack cannot become detached by bolt 72, 76 being loosened by vibration or operating forces. Preferably the main pivot bolt 68 is likewise permanently thread-locked against loosening.

Jack 70 is substantially self-locking due to the frictional resistance of its turn buckle threads. However, jack 70 may be positively locked against loosening by leaving the conventional reversing trip latch (not shown) of twoway ratchet mechanism 82 set in the tightening position so that retrograde self-loosening rotation of sleeve 80 will swing handle 84 against pipe 60 and thereby prevent further loosening.

Due to the swivel mount of pipe 60 on pole 52, cradle 66 can be rotated to a range of 360° about the vertical axes of the pipe/pole mount and may be locked in any selected position in this range of horizontal swinging movement by a set screw 86 (FIG. 18) having a T-handle 88 manually operating the set screw to lock and release the same. The inner end of set screw 86 that protrudes through pipe 60 and abuttingly engages the outside surface of pole 52 and is tightened thereagainst to lock pipe 60 against rotation on pole 52.

Referring to FIGS. 1–7, snow making tower 50 also includes, as a principal component, an elongated tower pipe assembly 90 that is permanently mounted on cradle 66, as shown in FIG. 1. Pipe assembly 90 comprises an outer aluminum alloy pipe 92 that, for example, may be two inches in outside diameter and of circular cross section. Outer pipe 92 is fabricated to extend for a suitable straight length, of say thirty feet, from its lower end cap 94 (FIG. 2) to an upper angle junction at 96 (FIG. 1) with a relatively short (e.g., approximately five feet) extension portion 98, that is inclined with its axis angled downwardly at 45° to the straight length axis of pipe 92.

Figure 5:
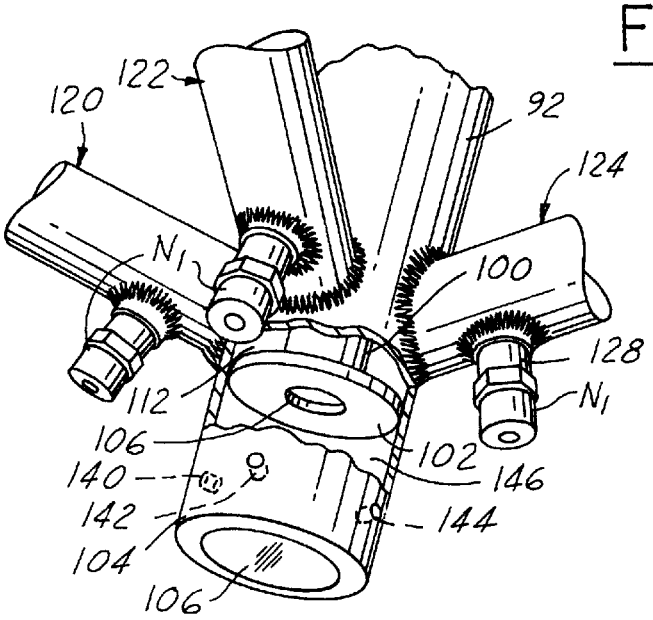
FIG. 5 is a fragmentary perspective view of the portion encompassed by the circle 5 in FIG. 4 and enlarged in scale thereover.
Figure 7:
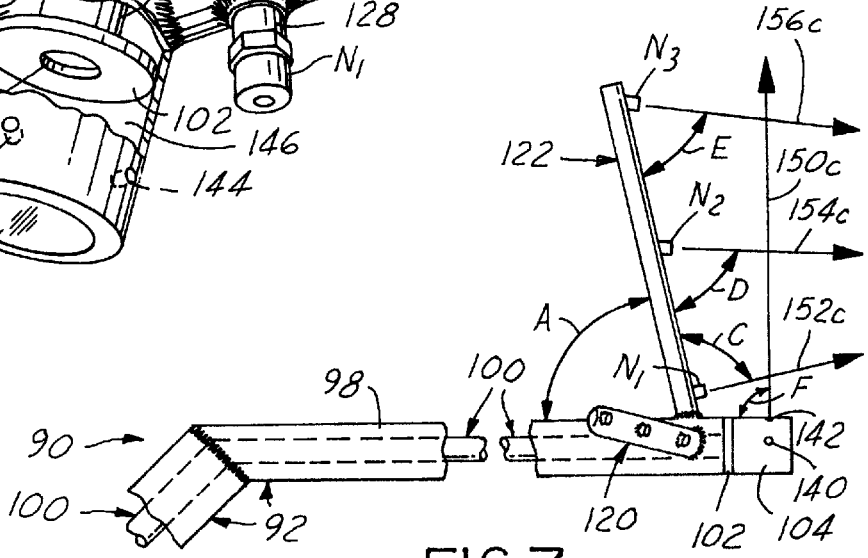

Pipe assembly 90 also includes an interior air conduit pipe 100 (FIGS. 1A and 2), of say one inch outside diameter, that is supported generally concentrically within the interior of pipe 92, as by perforated support disks 630 of the type shown in FIG. 39 and discussed in more detail hereinafter. Interior air pipe 100 also extends concentrically within the angled pipe extension 98 (FIG. 7) and terminates at its upper end at a circular ported partition disk 102. Disk 102 is welded to the upper end of pipe 92 and forms the inner end wall of an air manifold end cap 104 that is closed at its outer end by a circular disk 106 welded thereto (FIGS. 5 and 7). The open upper end of air pipe 100 is welded to disk 102 and encircles in sealed relation a central opening 106 in disk 102 so as to admit compressed air from pipe 100 into the manifold air chamber formed within the end cap 104.

Figure 27:
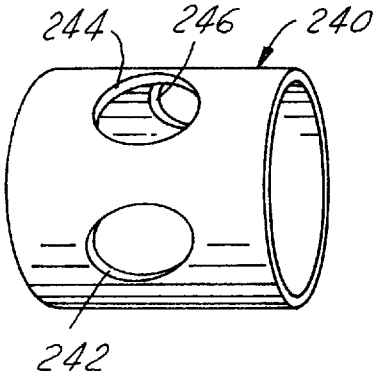
FIG. 27 is a perspective view of the ported collar component of the subassemblies shown in FIGS. 25 and 26 shown by itself.
Figure 27A:
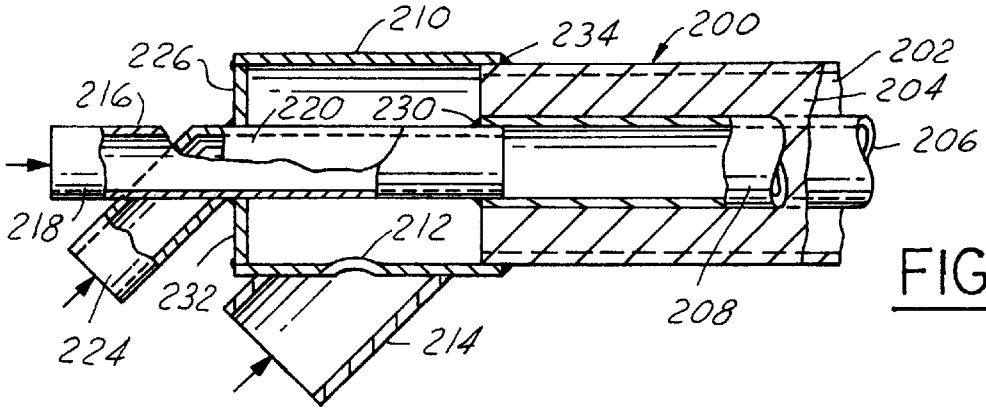
FIG. 27A is a fragmentary longitudinal center cross sectional assembly view of the components shown in FIGS. 20–24.
Figure 27C:
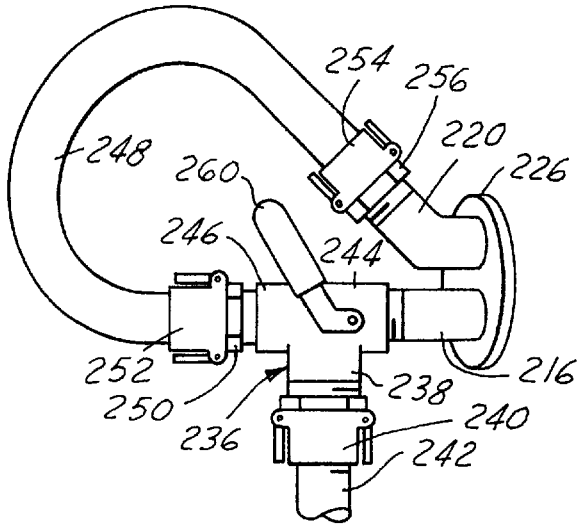
FIG. 27C is a simplified fragmentary perspective view illustrating the air hose supply coupling connection to a three-way valve connected to the dual inlet air pipes of the main pipe components of FIGS. 20, 21, and 27A.

As shown in FIG. 2 the lower inlet end 108 of air pipe 100 sealably protrudes through end cap 94 of water pipe 92 and is suitably threaded to receive a conventional quick-clamp for coupling a compressed air supply hose thereon (not shown), but of the type shown at 240, 242 in FIG. 27C. Compressed air is thus supplied to the lower end of air pipe 100 which in turn conducts the compressed air through pipe assembly 92 into the air chamber of end cap 104. The lower end of outer pipe 92 is also provided with a water inlet coupling 110 which may be a one and a half inch diameter threaded coupling cut at 45° and butt welded to the underside of pipe 92 to communicate with a one and a quarter inch hole that is cut in the pipe before welding the coupling to the pipe. Coupling 112 likewise is externally threaded to receive a quick-connect hose coupling fitting adapter of conventional construction (not shown). The outlet of a higher pressure water supply hose is thus coupled to pipe 92 via inlet fitting 110 to feed water in the annular conduit space 112 formed between the exterior of air pipe 100 and the interior of water pipe 92 (FIG. 1A). Air tube 100 is likewise constructed of aluminum alloy pipe for good heat transfer between the compressed air within pipe 100 and the water in conduit space 112 surrounding pipe 100.

Pipe assembly 90 is supported on cradle 66 by a pair of commercially available WELD-MOUNT vibration dampening clamps 114 and 116 (FIGS. 1, 14, 15 and 17). These clamp assemblies include a pair of matching plastic clamp blocks 117 and 118 (FIG. 15) that each respectively carry a metal welding plate 120 and 121. Clamp blocks 117 and 118 each have semicircular openings with a series of grooves formed therein to form a tight gripping and resilient clamping surface that, in assembly of blocks 117 and 118, securely grips the exterior surface of water pipe 92 and helps absorb vibration. The lower plate 121 is welded to the top surface of box beam 66 to fixedly mount lower clamp parts 118 of clamps 114 and 116 on cradle 66. Pipe assembly 90 is laid into parts 118 and then the upper clamp parts 117 assembled about the upper portion of the pipe in registry with clamp parts 118. A pair of machine bolts 123 and 125 are inserted through plate 120 and registering passageways in clamp parts 117 and 118, and then threaded tightly at their lower ends through welding plate 121 so as to protrude downwardly therefrom as shown in FIG. 17. Bolts 123 and 125 are preferably thread locked by either upsetting the protruding threads or tack welding the same in order to permanently (non-detachably) secure pipe assembly 90 on cradle 66. Moreover, clamps 114 and 116 are also designed to prevent rotation of pipe assembly 90 about its longitudinal axis in order to maintain the proper orientation of the triple sub-boom nozzle "tree" at the upper end of pipe assembly 90 relative to a horizontal plane, i.e., the orientation as shown in FIGS. 1, 3 and 4–7 of the array of water spray nozzles shown therein.

In accordance with one of the principal features of the present invention, and as shown by way of example applied to first embodiment snow tower 50, the upper end of the pipe assembly 90 carries three nozzle sub-boom pipes 120, 122 and 124 cantilever mounted by welding their inner ends to outer main boom pipe 92 (FIG. 5) so as to extend therefrom with their respective longitudinal axes mutually divergent, as best seen in FIG. 3. Each of the sub-boom pipes 120, 122 and 124 is closed by a suitable cap plug at its outer end and its inner open end registers with an associated hole in pipe 92 to thereby communicate each sub-boom with the water supply chamber 112 slightly upstream of disk 102.

Figure 4:
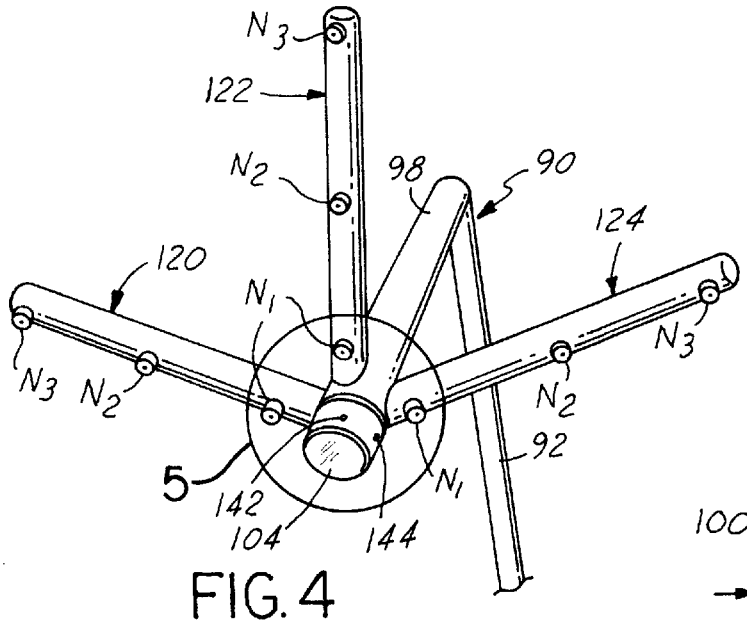
FIG. 4 is a perspective view of the upper end of the pipe snow making tower, also looking in the direction generally of the arrow 3 in FIG. 1.
Figure 6:
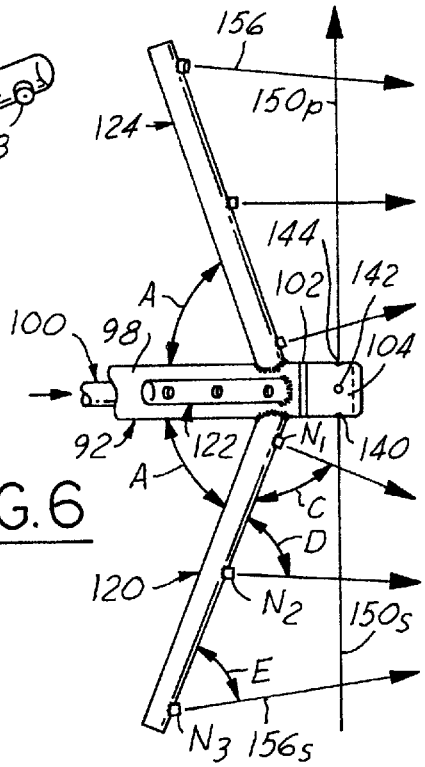
FIGS. 6 and 7 are a fragmentary top plan and side elevational views respectively of the upper end of the pipe snow making tower of FIG. 1, and enlarged in scale thereover.

Preferably, as best seen in FIG. 3, the center sub-boom 122 is oriented with its axis extending generally vertically in a plane coincident with the axis of pipe assembly extension 98, but as seen in FIG. 7, is raked backwardly from perpendicularity to longitudinal axis of extension 98 at the included angle A, in the order of 70°, between the axis of sub-boom 122 and that of the main boom extension 98. Likewise, as best seen in FIG. 6, the starboard (right hand as viewed from the ground mount) and port (left hand as likewise viewed) sub-booms 120 and 124 are raked backwardly to define a like included angle A between their respective axes and that of boom extension 98.

As best seen in FIG. 3, the included angle B between the axes of mutually adjacent sub-booms 120, 122 and 124 in the plane of the drawing is preferably 75° so that the axes of starboard and port sub-booms 120 and 124 have an upward inclination from horizontal of about 15°. It thus will be seen that from this orientation of the three sub-booms, that each is self draining under the effect of gravity and system shutdown, and this preferred self draining orientation is preserved by the anti-rotation clamping of pipe assembly 90 on cradle 66 as described previously.

Figure 27B:
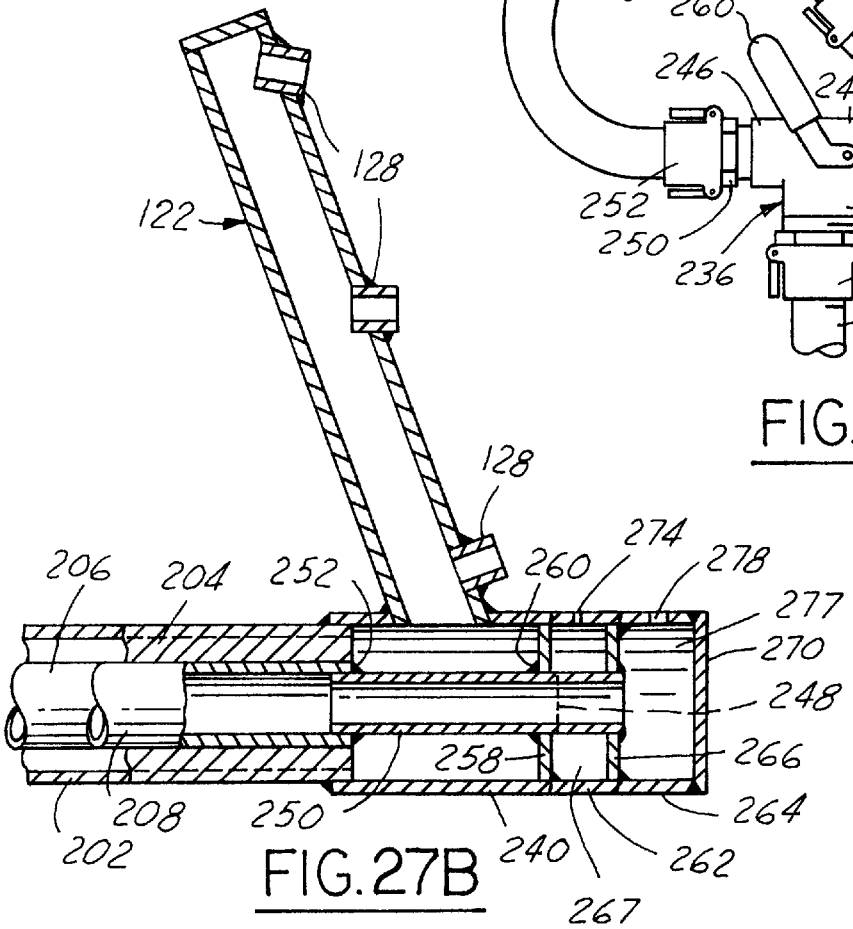
FIG. 27B is a fragmentary longitudinal center cross sectional assembly view of the components shown in FIGS. 25–27.

Each of the sub-booms 120, 122 and 124 carries three commercially available water spray atomizing nozzles $N_1$, $N_2$ and $N_3$ that are each mounted an associated threaded coupling part 128 inserted into a hole cut in the associated sub-boom with its axis oriented at a given angle with respect to the nozzle boom axis (see also FIG. 27B in this regard). In one working example, each sub-boom 120–124 has a fourteen inch axial protrusion length from the outboard surface of water pipe 92. The axis of the inboard nozzle $N_1$ from tube 92 is one inch, and the center-to-center distances between mutually adjacent nozzles is six inches. The respective angulation of the axis of each of the nozzles relative to the axis of its associated sub-boom is shown in the angle diagrams of FIGS. 6 and 7. The inboard nozzle $N_1$ has its axis oriented at included angle C, preferably a 90° angle, nozzle $N_2$ an acute included angle of D, preferably 70°, and nozzle $N_3$ is oriented with its axis at an included angle of E, preferably 60°. Hence, as best seen in FIG. 7, the axis in the inboard nozzle $N_1$ is angled at a 20° angle divergent from the axis of pipe extension portion 98, the central nozzle $N_2$ has its axis extending parallel to the axis of extension 98 and the outboard nozzle $N_3$ has its axis oriented at a convergent included angle of 10° relative to the axis of extension 98.

In one working experimental prototype of the first embodiment tower 50, the middle nozzle $N_2$ and inboard nozzle $N_1$ were each "SCOT" brand fan nozzles Model No. 50-10 (50° fan angle and 5/64 inch orifice size), whereas the outboard nozzles $N_3$ were Model MP 78 hollow cone nozzles rated to produce a cone angle of approximately 50° and having the same orifice size as the 50-10 fan nozzles.

Figure 10:
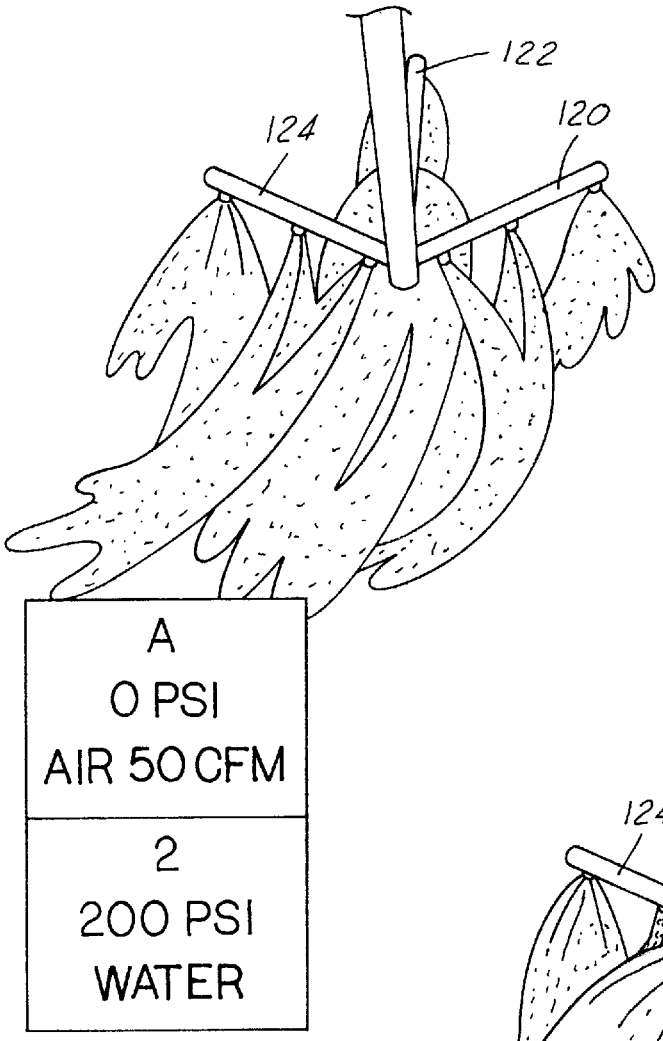

As thus far described, snow making tower 50 can operate as a water-only snow making machine by merely connecting a water supply hose between inlet coupling 110 and a source of supply of pressurized water, such as the hydrant connected along the water supply line of a ski resort snow making water system. When water is supplied to the nine snow making nozzles of the three nozzle boom via the annular water channel 112 in conduit pipe assembly 90 at 300 psi, the aforementioned nozzle array will create nine individual water sprays with a total output therefrom of approximately 24–25 gallons per minute. The atomized water spray thus generated is shown in a test photo, FIG. 12. FIG. 10 is a test photo showing water-only operation at water pressure of 200 psi, and FIG. 8 is a test photo showing water-only operation with water pressure of 150 psi.

Figure 8:
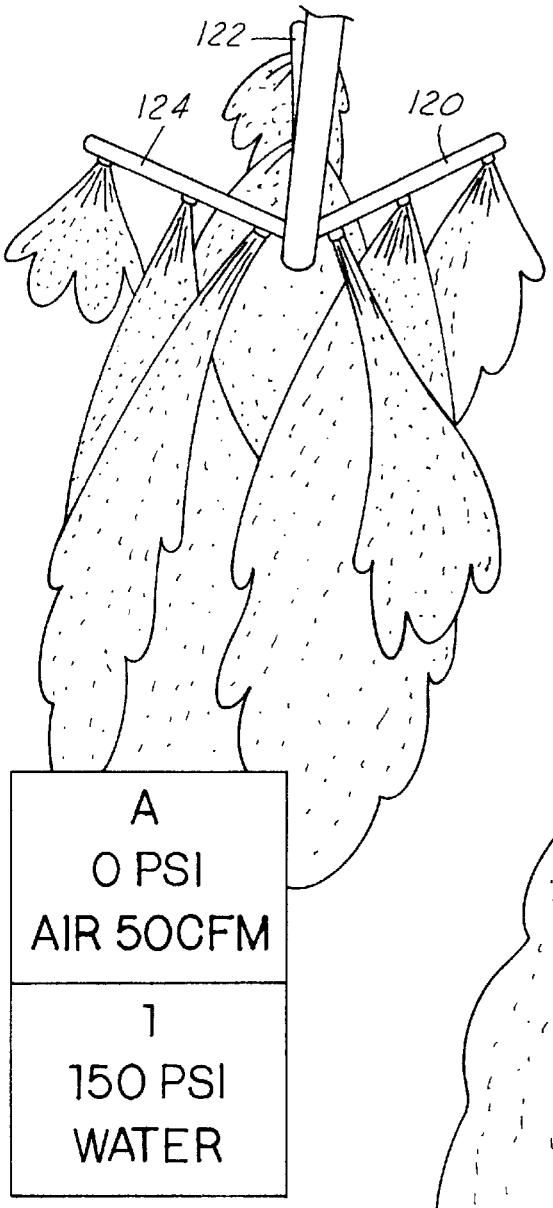
FIGS. 8 and 9, 10 and 11, and 12 and 13 are three pairs of companion photo prints respectively illustrating actual operation of the adjustable snow making tower embodiment of FIGS. 1–7 when supplied with compressed air and pressurized water at the values shown in these respective photo prints, the photos being taken from below and behind the upper end of the pipe tower.
Figure 8A:
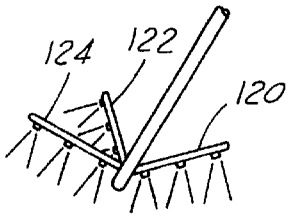
FIGS. 8A and 9A are diagrammatic illustrations respectively accompanying the associated FIGS. 8 and 9 to help indicate the respective directions of the water spray issuing individually from each of the nine nozzles of the three nozzle pipe sub-booms at the upper end of the main pipe boom of the tower (FIG. 8*a*),as well as the direction of the three compressed air jets issuing individually from the three air orifices in the upper end of the main pipe and each generally perpendicularly intersecting the water spray issuing from each of the associated three nozzles (FIG. 9A).

FIG. 8A is a corresponding diagrammatic drawing for FIG. 8 operation. It will be seen in each instance that throughout this range of water pressures abundant, finely divided, atomized water particles are created by each of the nine nozzles to form a well diversified plume of individual spray patterns that are initially separated from one another and gradually coalesce to a widely dispersed fine fog some ten, twenty or thirty feet out from the nozzle booms, depending upon wind conditions. Preferably tower 50 is rotated about the axis of ground pole 52 to orient the axis of pipe assembly 90 downwind generally parallel to the prevailing wind direction. However, operation can still be successfully effected in a cross wind condition as illustrated by the conditions in the photo of FIG. 10, wherein the wind is blowing from right to left as viewed in the photo. Of course, making good quality snow under such water-only operation requires very low temperature and low humidity ambient atmospheric conditions.

When the water supply is shut down and the water supply hose disconnected from water inlet 110, it will be seen from the orientation of the components of tower 50 in FIG. 1, which is a typical operating position, all of the water will be gravitationally drained from the sub-booms into the main boom water channel and thence down the annular water channel 112 and out the open water inlet 110 to spill on the ground. This occurs in a rather rapid manner, thereby avoiding freeze up of the water spray nozzles and water conduits leading to the same.

In accordance with another principal feature of the invention, snow making pipe tower 50 is provided with a unique system for supplying and ejecting compressed air for generating seeding crystals and for promoting further break up and disintegration of the water spray issuing from each of the nine spray nozzles $N_1$, $N_2$ and $N_3$ of the triple array of sub-booms 120, 122 and 124. Thus, as best seen in FIGS. 4–7, three air jet orifice passageways 140, 142, and 144 are drilled radially through the cylindrical wall of end cap 104 with their respective axes oriented individually in alignment with associated sub-booms 120, 122, and 124, as viewed in the plane of the drawings in FIG. 3. Thus, starboard and port passages 140 and 144 are each inclined upwardly from horizontal at an angle of 15°, and the axis of the center orifice 142 extends vertically in the plane defined by the axes of sub-boom 122 and pipe assembly 92. By way of example in the first embodiment snow making tower 50, each of these orifices has a diameter of 7/64 inches. Thus when a compressed air supply hose is coupled to the inlet 108 of air conduit 100 and a compressed air line hydrant valve opened to admit compressed air from the compressed air supply source, compressed air will be fed by pipe 100 through the orifice 106 into the air chamber 146 formed in end cap 104 between disk 106 and end cap plate 106 (FIG. 5), and then will issue from each of the three orifices, namely starboard, center and port orifices 140, 142 and 144 respectively, into ambient as corresponding high velocity narrow air stream jets $\mathbf{150}_s$, $\mathbf{150}_c$ and $\mathbf{150}_p$ oriented in the direction of their respective orifice axes.

Referring more particularly to the semi schematic diagram provided in FIG. 7, the theoretical path of the air jet issuing from the center orifice 142 is shown by the arrow line $\mathbf{150}_c$. The theoretical center axis of the water spray issuing from each of the water spray atomizing nozzles $N_1$, $N_2$, $N_3$ of center sub-boom 122 is shown respectively by the arrow lines $\mathbf{152}_c$, $\mathbf{154}_c$ and $\mathbf{156}_c$. Due to the radial orientation of orifice 142 it will be seen that the included angle between air jet $\mathbf{150}_c$ and the axis of boom extension 98 (angle F in FIG. 7) is 90°. It will also be seen that air jet $\mathbf{150}_c$ intersects the axis $\mathbf{152}_c$ of the water spray from the inboard nozzle $N_1$ at an included angle of 70°. The included angle of intersection of air jet $\mathbf{150}_c$ with water spray axis $\mathbf{154}_c$ issuing from the middle nozzle $N_2$ is 90°, and the included angle of intersection of air jet $\mathbf{150}_c$ with the water spray axis $\mathbf{156}_c$ issuing from outboard nozzle $N_3$ is 110°. Thus, the theoretical average angle of air jet intersection with the three central sub-boom water sprays is 90°. It will also be noted that in this embodiment the air jet $\mathbf{150}_c$ centrally intersects each of the water spray fan patterns because the three nozzles on each sub-boom in this embodiment are aligned so that their water spray axes are co-planar with one another as well as with the associated air jet. As shown in FIG. 6, the same coplanar air/water intersection angulation is likewise produced with respect to the air jets $\mathbf{150}_s$ and $\mathbf{150}_p$ and three associated water sprays concurrently issuing from each of the other two sub-booms, i.e., starboard sub-boom 120 and port sub-boom 124.

Figure 9:
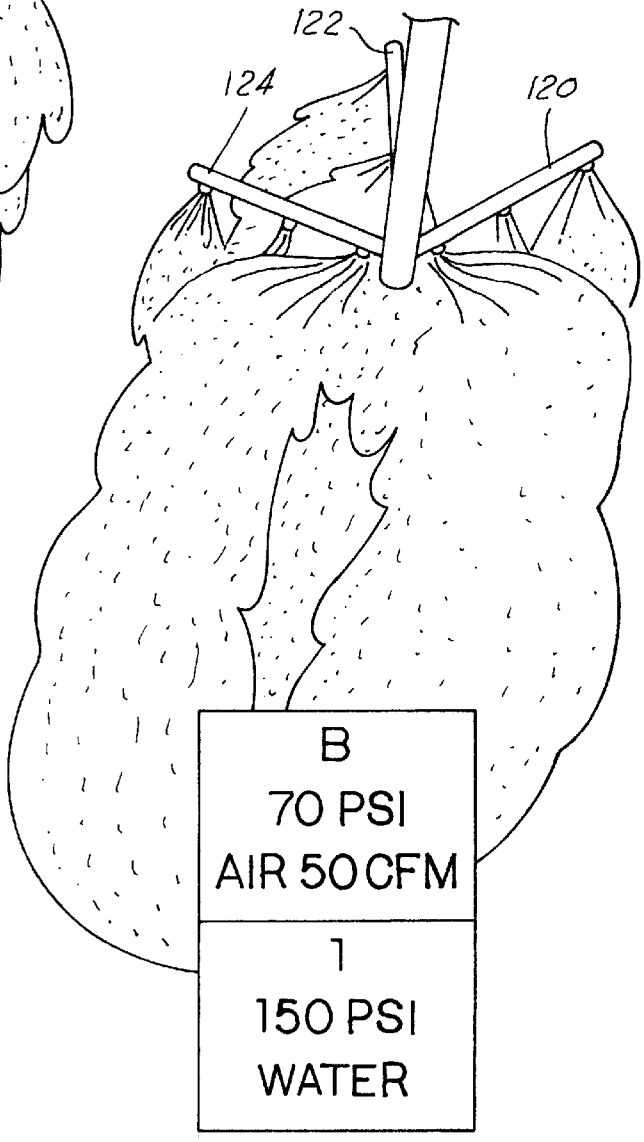
Figure 9A:
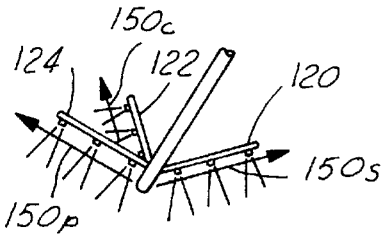
Figure 11:
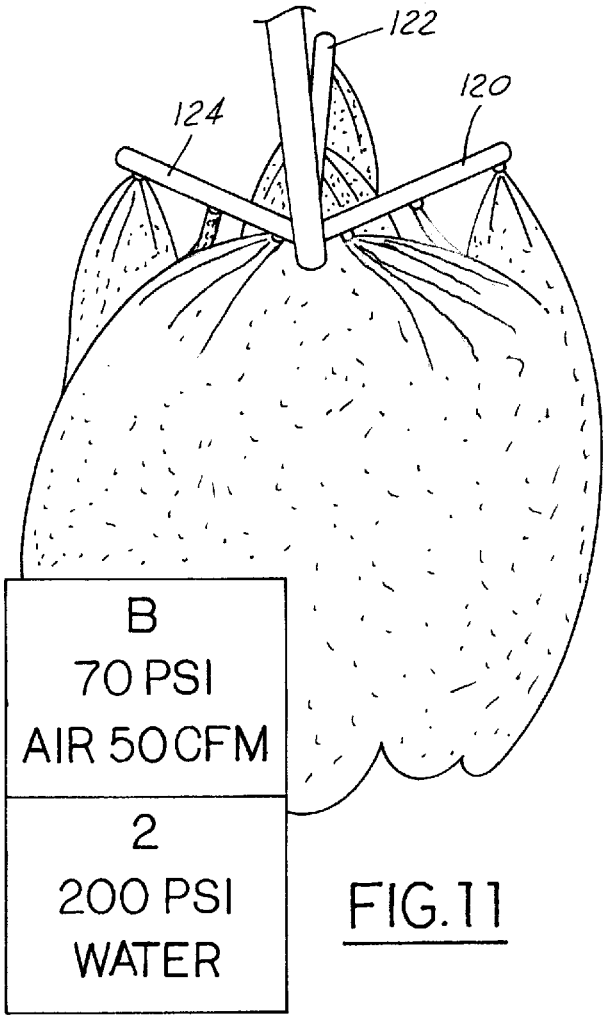
Figure 13:
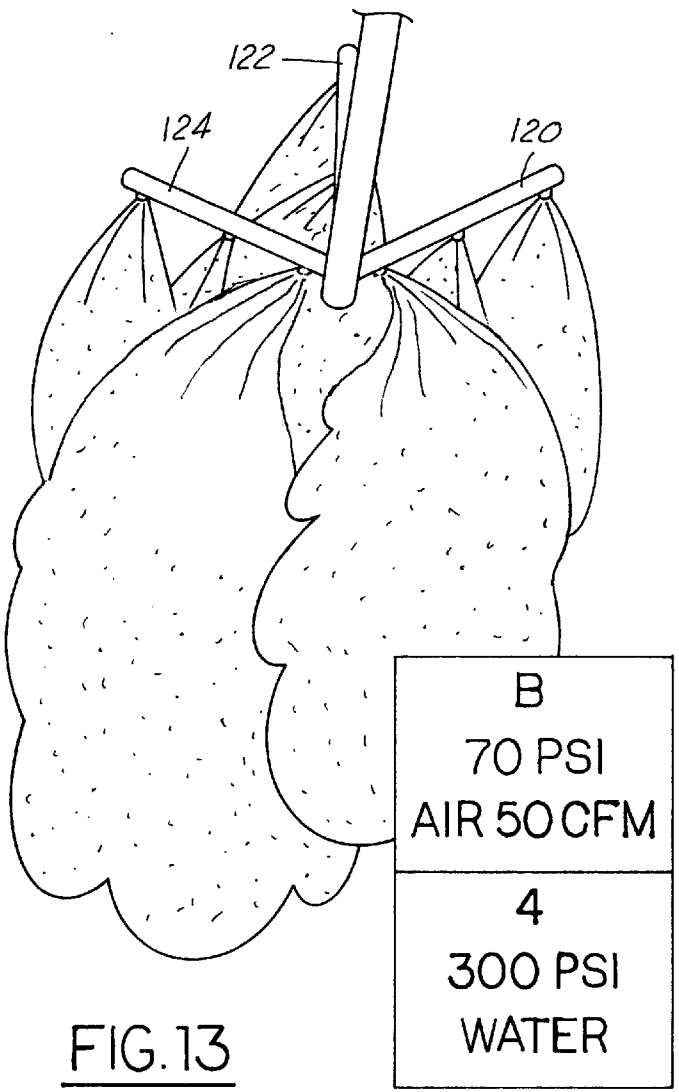
Figure 12:
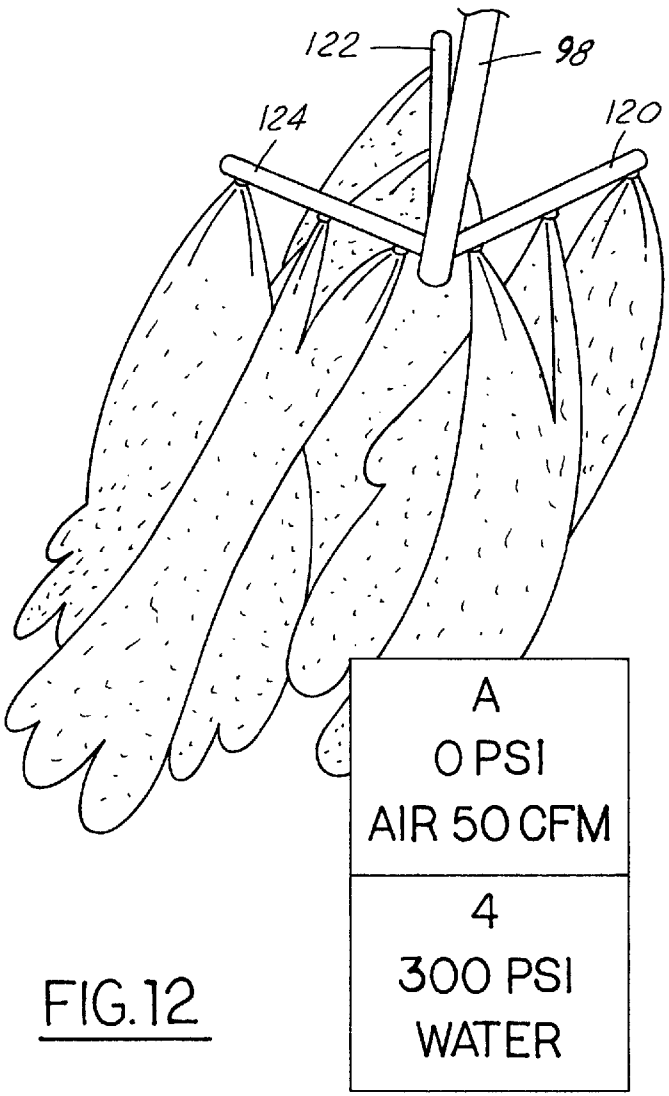

The surprising results achieved by combined feeding of compressed air and pressurized water to snow making tower 50 is seen in the test photos of FIGS. 9, 11 and 13. In the photo of FIG. 9 it is seen that when the compressed air supply is supplying compressed air at 70 psi to the inlet 108 of air conduit 100, and the water pressure is set at 150 psi, each of the three air jets $\mathbf{150}_s$, $\mathbf{150}_c$ and $\mathbf{150}_p$ respectively individually associated with each of the sub-booms 120, 122 and 124, instead of being battered down and obliterated by the inboard water sprays issuing from nozzles $N_1$, instead penetrates through the inboard water spray, and thence through the middle water spray issuing from the middle nozzles $N_2$ and even into and through the cone spray issuing from the outboard nozzles $N_3$, albeit with somewhat progressively diminishing air jet stream force, velocity and cfm. Hence, it will be seen that each air jet stream is effective to both atomize, disperse and create seeding particles by directly acting on each of the associated three water spray fogs issuing from the three nozzles of the associated sub-boom. Thus, in effect each nozzle water spray is affected as though acted on by its own compressed air jet, but nevertheless in actuality this compressed air jet issues from only one orifice common to all three water sprays. This mode of operation thus differs significantly from that of the separate compressed air orifices located one adjacent each companion water spray nozzle as in the previously mentioned Dupre U.S. Pat. No. 3,822,825.

The single air jets $\mathbf{150}_s$, $\mathbf{150}_c$ and $\mathbf{150}_p$ impinging on each of the associated three water sprays at respective sharp abrupt intersection angles close to 90° maximizes the dispersing and break up action caused by the battering impingement effect of the air stream on the water spray particles. In addition, the refrigerating effect of the expanding compressed air is able to act directly on each of the three water sprays issuing from the associated nozzle boom. Moreover, maximum seeding effect is believed to be created by the impingement of the air jet hitting the closest water spray, i.e., that issuing from inboard nozzle $N_1$. Hence, the water spray from these inboard nozzles $N_1$ carry the seeding effect of this close-by air jet impingement, where maximum seeding action occurs, into the center of the total spray fog thrown out and wind carried into ambient atmosphere. In addition, some of these inboard spray-generated seed particles will be carried transversely to water spray travel or throw into and through the middle spray issuing from nozzle $N_2$, where additional seeding particles are created by air jet impingement. Then some of these middle-spray-generated seeding crystals will be carried transversely to water spray travel or throw into the outboard water spray issuing from the outboard nozzle $N_3$, where again still further seeding action will also occur. Thus, a maximization of seeding action is obtained from a single air jet for three water nozzles, and water particle break up and fog production from each of the three nozzles is enhanced while only using one air jet stream. As a result, economy in the use of the compressed air to create the dual effects of water spray break up and seed generation is obtained while enhancing overall snow making performance.

It will also be seen that this same action and result occurs with each of the three sub-boom sprays in the same manner. However, by providing nine nozzles on three mutually divergent "sub-booms" instead of all the nozzles on one main boom, as in the aforementioned Dupre '825 patent as well as in the more recent Dupre U.S. Pat. No. 5,004,151, a further enhanced water spray and snow making pattern is formed due to this laterally dispersed array or "tree" of nine water nozzles, and due to all nozzles being oriented in the same general spray fog "throw" direction. As indicated previously, preferably the axis of the main pipe assembly 90 is oriented parallel to the wind direction with the water spray nozzles pointing downwind so that the combined plumes from the three sub-booms create a large and widely dispersed fog or mist carried downwind away from the nozzles. This preferred operational orientation greatly enhances dwell time and seeding interaction and the resultant production of snow as the atomized water particles and commingled seeding crystals fall to the ground.

The photo of FIG. 11 also illustrates, surprisingly, that generally the same foregoing enhanced snow making spray fog effect is created when the air pressure is held at 70 psi and the water pressure increased to 200 psi. Even more surprisingly, the photo of FIG. 13 shows that this effect still occurs when air pressure is held at 70 psi and water pressure is increased to 300 psi. At the air pressure of 70 psi and with the aforementioned three air jet nozzle orifices 140, 142 and 144 sized at a control diameter of 7/64 inches, the air consumption is approximately 50 cu. ft./min (cfm). Typically, the compressed air pressure available from the hydrant supply system varies from 70 psi up to 90 psi, and hence the photos of FIGS. 9, 11 and 13 generally represent the minimum break up and penetration effect achieved by the compressed air jets on water sprays generated at their respectively illustrated water pressures of 150 psi, 200 psi and 300 psi.

Again, by way of summary comparison, the compressed air and water spray system of the invention as embodied in the orientation and construction of the nozzle booms and nozzles of the first embodiment snow making tower 50 (as well in the further embodiments disclosed hereinafter) differs in method, principle and apparatus practice from both of the snow making pipe towers of the aforementioned Dupre '825 '151 patents. Instead of providing a paired air jet and spray nozzle, i.e. one air jet per one water spray nozzle, as in the Dupre '825 patent, the present invention achieves air jet coaction with three water spray nozzles while using only one air jet. On the other hand, instead of adding additional water nozzles oriented to intersect the fog produced by a paired combination of a water nozzle and air jet at a distance of about four feet out from the boom, as in the aforementioned Dupre '151 patent, the present invention in its preferred mode of operation does not add any additional or supercharging water nozzles as such. Rather, the invention provides a compressed air jet and water spray interaction for each water spray nozzle while using one air jet for the three nozzles on each nozzle sub-boom. Both improved snow making performance and greater operational economy is thus achieved by the three boom, nine nozzle divergent tree branch water spray array, in cooperation with the sharply angled intersections of the three air jet array employed in the present invention, as compared to that achieved in either of the aforementioned Dupre '825 and '151 patents.

Also, it might be expected that increasing the air pressure from 150 psi as shown in FIG. 9 to double that, namely 300 psi as shown in FIG. 13, would render the water spray issuing from the inboard nozzle $N_1$ impenetrable, or almost so, by the air jet stream issuing from the associated air jet orifice. However, surprisingly, it will be seen in comparing the effects of the water pressure shown in FIGS. 9, 11 and 13 that the air jet stream still is able to penetrate (and also deflect) the water spray from the inboard nozzle and then proceed onwardly into the water spray from the middle nozzle, and then even further onwardly into the water spray from the outboard nozzle even at the higher water pressures. It is theorized that, although the increase in water pressure would seemingly produce a more air-impenetrable water spray, the increased water pressure may well produce a reduction in water particle size by the increased atomizing of effect of the greater pressure drop through the spray nozzle at higher water pressure. Hence, the air-impenetrability of the inboard spray at higher water pressures apparently does not increase linearly with increasing water pressure. It may well be that the smaller water particles generated at higher water pressure may be more easily deflected so as to still allow air jet stream penetration through the middle to the outboard spray nozzles at these higher operational water pressures.

Of course, the pipe snow making tower 50 of the present invention may also be operated, if desired, following the principal of the aforementioned Kircher '061 patent. That is, by cutting back the air pressure to some lower value, say 25 psi, the air jet will be sufficiently weakened or diminished so as to primarily act only on the water spray issuing from the associated inboard water spray nozzle. This then would convert at least the outboard spray nozzle, and to some extent the middle spray nozzle, to operation as "additional" water nozzles for a "supercharging" effect when desired and when climatic snow making conditions are favorable. The air pressure cut back can be achieved by a suitable air throttling valve, such as by using the air valve at the hydrant or providing an additional air throttling valve in the air supply line, or preferably by using built-in air regulating systems as disclosed hereinafter.

The converse operation to that of the aforementioned water supercharging is also possible, i.e., "compressed air supercharging", for operation of the snow making pipe tower in adverse snow making climatic conditions. There is, of course, a practical limit as to how much the water pressure can be reduced below 70 psi while still achieving adequate spray break up by the atomization effect of the pressure water issuing through the spray nozzle, even though the increased ratio of compressed air to water increases the air jet break up effect on the water sprays, and even though the refrigeration effect of expanding compressed air for producing seed crystals is increased with this converse mode of operation.

It will be seen from the foregoing that the first embodiment snow making pipe tower 50 of the invention, while achieving both surprising and improved results in terms of enhanced snow making performance and reduced operating cost, also retains the advantages of the aforementioned Dupre '825 patent in providing economizer action between the water being supplied to the nozzle booms and the compressed air being supplied to the air jet chamber 146 during operation of the snow making tower. Typically the water temperature entering coupling inlet fitting 110 will be approximately 54° F. if taken directly from underground water-table-fed wells, whereas the temperature of the compressed air entering the inlet fitting 108 may be as high as 80° F. Preferably, however, well-drawn supply water for snow making is stored in outdoor ponds exposed to ambient air temperature, which usually will enable water inlet temperature to be lowered to about 42° F. On the other hand, the air temperature outside the boom pipe assembly 90 under snow making climatic conditions is presumably approximately a maximum of only 28°–32° F. and, of course, often ranges downwardly much lower than that to achieve optimum snow making conditions.

Therefore, as the column of water is travelling upwardly along and within the long (35 feet to 50 more feet) longitudinal length of the tower pipe it will rapidly lose its heat to ambient through the highly conductive wall of the aluminum material of water tube 92. This water cooling action is further enhanced during the subdivision of the water streams into the three sub-booms 120, 122 and 124 prior to reaching the associated water spray nozzles. Hence, the water flow as it reaches a spray nozzle will have been cooled to a temperature closely above freezing temperature, which of course promotes snow making in the water spray issuing from each water nozzle. Likewise, the air temperature is reduced to an efficient value of below 40° F. by the heat exchange economizer action of the air-pipe-within-water-pipe construction. Moreover, the air temperature of the column of air being conducted via air conduit 100 will inherently drop more rapidly due to the gaseous phase of this fluid medium, and also due to the small amount of expansion of the air occurring during its transit in tube 100 to the air jet orifices 140, 142 and 144.

Nevertheless, the compressed air is insulated from freezing ambient atmospheric temperatures by the surrounding body of water in the annular water channel 112. Hence the column of air cannot drop in temperature to a freezing temperature while in pipe tower transit to the air jet orifices. Thus freeze up of water particles carried in the compressed air stream is prevented until after the compressed air issues from the orifices 140, 142 and 146, thereby overcoming the problems of freeze-up clogging of the air jet orifices.

Snow making tower 50 also provides universal tower adjustment features for swinging about a vertical axis as well as pivoting about a horizontal axis for boom motion in both horizontal and vertical planes for selectively adjusting the snow making tower orientation, preferably to the aforementioned downwind orientation of the spray nozzles, and/or to elevate or lower the spray booms and to swing them over various areas where artificial snow fall is desired. This universal tower adjustment feature as initially provided in the aforementioned Tropeano et al U.S. Pat. No. 3,964,682 and later adapted to a pipe snow making tower in the Dupre U.S. Pat. Nos. 5,004,151 and 5,360,163, is also advantageous in enabling lowering of the spray nozzles for access thereto for deicing and maintenance at ground level, and for elevating the pipe tower for gravity water drain-out at shutdown.

Second Embodiment Snow Making Tower

FIGS. 19 through 27C illustrate components and sub assemblies of a second embodiment snow making tower construction which may be substituted for the dual-pipe air and water conduit pipe assembly 90 of the first embodiment snow making tower 50. One of the principal features of the second embodiment snow making tower is an improved form of a main boom air and water conduit 200 shown in radial cross section in FIG. 19. Conduit 200 is made as a one piece extrusion from aluminum alloy so as to have an outer wall 202 of circular cross section with an integrally formed continuous center web wall partition 204 extending the full axial length of wall 202, and web 204 is oriented in use in a vertical plane to provide a high strength-to-weight ratio beam modulus resistant to bending stresses created by the weight of the boom as well as the column of water entrained therein in operation.

Boom conduit 200 is also provided with a pair of tubular air conduits 206 and 208 extending the full axial length of conduit 200, and which are disposed one on each of the opposite sides of center web 204 and are integrally joined at their diametrically opposite sides to wall 202 and web 204. The four channels 209*a*, 209*b*, 209*c* and 209*d* formed between the outside of tubes 206 and 208 in the interior surfaces of circular wall 202 and center web 204 provide four water carrying conduits essentially surrounding the air conduits 206 and 208. It will be also seen that due to the integral interconnected formation of this conduit structure of conduit beam 200 enhanced heat transfer is obtained between both the water columns 209*a*–209*d* and outside ambient air, and between these water columns and the compressed air to be carried in tubes 206 and 208. The structural geometry of the two side-by-side integrally connected water tubes 206 and 208 also enhances beam longitudinal bending strength and cross sectional rigidity of beam 200, as well as promoting stiffness and providing antibursting strength in a plane perpendicular to web 204 and intersecting the center axis of beam 200. With this geometric construction as made in extruded form, beam 200 can be made with reduced wall thicknesses to save in material costs and to reduce the weight of the beam without sacrificing beam strength, as compared to that of water pipe 92.

Another feature of the second embodiment snow making tower is the provision of dual air supply internal pipe lines and individually associated arrays of triple air jet orifices to provide a greater range of compressed air jet action on the associated three water nozzles on each nozzle sub-boom. In this respect, the three nozzle booms and three water spray nozzles on each boom may be constructed identically to their construction and arrangement as described previously in conjunction with snow making tower 50 and hence such description is not repeated. Likewise, the mounting of boom 200 on cradle 66 may be the same as that employed in snow making tower 50, or as in the fourth, fifth or seventh tower embodiments described hereinafter.

Referring more particularly to FIGS. 20–24, 27A and 27C, the construction of the air inlet and water inlet components of the second snow making tower embodiment will now be described. These lower end water coupling components comprise a cylindrical collar 210 having an I.D. sized to slip onto the O.D. of circular beam wall 202 (FIG. 27A). Sleeve 210 is provided with a water inlet aperture 212 and fitted with a 1½" diameter Schedule 40 plumbing coupling cut at a 45° angle and welded onto collar 210 concentrically with an opening 212 to provide a water inlet angled coupling 214. The lower end air inlet coupling components include a dual air inlet pipe subassembly made up of a 1" O.D. Schedule 40 air inlet pipe 216 approximately eight inches long with male NPT threads 218 on its upstream exterior end, and a companion inlet air pipe 220 of a like construction, but having a 22.5° bend 222 so that its threaded outer end 224 is spaced away from threaded end 218 of pipe 216 in assembly. Pipes 216 and 220 fit through a ¼ inch thick circular plate 226 having a diameter equal to the I.D. of coupling collar 210 and provided with two off-center holes for closely receiving therethrough individually associated air inlet pipes 216 and 220.

To assemble the foregoing water and air inlet coupling components to beam 200 to form the assembly of FIG. 27A, coupling 210, with water inlet 214 attached, is first slid telescopically onto the exterior of pipe 202 far enough so that the inlet ends of air conduits 206 and 208 are exposed and accessible for welding. Then the subassembly of air inlet pipes 216 and 220 and plate 226 is loosely fitted to beam 200 by inserting the downstream ends of tubes 216 and 220 slidably into the associated beam conduits 206 and 208 to the position shown in FIG. 27A. Then each of the tubes 216 and 220 is welded to seal and join the same to the associated beam conduit 206 and 208, as indicated by the weld 230 in FIG. 27A. Then collar 210 is slid axially to the left as seen in FIG. 27A so that its downstream end overlaps plate 226, and then welds 232 and 234 are formed to respectively join one end of collar 210 to plate 226 and the other end to pipe 202.

Referring to FIG. 27C, one preferred example of exterior air hose connections to air inlet pipes 216 and 220 is illustrated in simplified form. A standard three-way hose coupling Tee-valve 236 has its inlet 238 quick-coupled by a standard cam-and-groove hose coupling fitting 240 to a compressed air hose supply line 242. One of the outlets 244 of valve 236 is threadably coupled to air inlet fitting 218. The other outlet 246 of valve 236 is coupled to the inlet of a short connecting air hose 248 by a coupling fitting 250 and another cam-and-groove fitting 252. The outlet end of connector hose 248 is connected to air inlet pipe 220 by yet another cam-and-groove fitting 254 and associated pipe coupling fitting 256.

Thus, with three-way valve 236 so installed, the same can be operated so that compressed air can be selectively supplied to either of the dual air inlet pipes 216 or 220, as may be desired, or air shut off simultaneously to both pipes. It is also to be understood that, if desired, a conventional four-way Tee-valve with one inlet and two outlets may be substituted for three-way valve 236 and coupled in the same manner to air inlet pipes 216 and 220. With a four-way valve, air can be selectively supplied to either air inlet pipe 216 or pipe 220, or to both pipes concurrently, and air supply to both pipes also simultaneously shut off. Three-way valve 236 has the conventional manual operating handle 260 for selecting the various modes of valve operation, and a typical four-way valve has a like operating handle.

Figure 25:
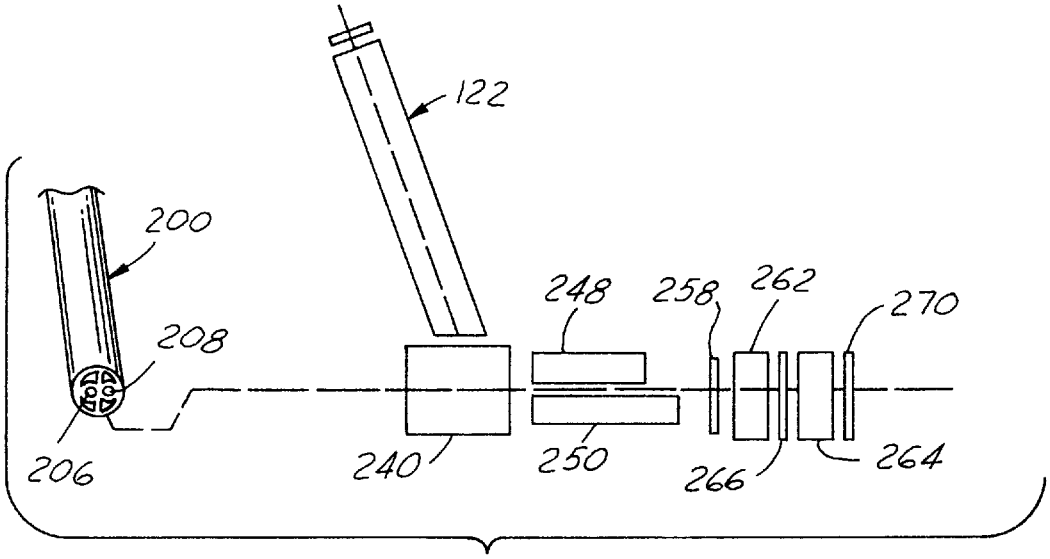
FIG. 25 is a fragmentary part elevational-part perspective exploded view of some of the components of the upper end of the main pipe assembly of the second embodiment snow making tower.
Figure 26:
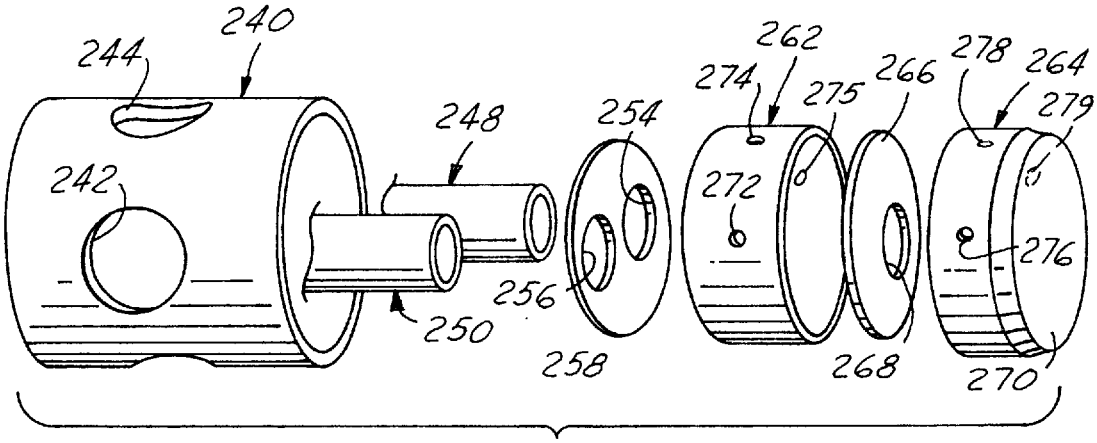
FIG. 26 is an exploded perspective view of the main pipe components shown in FIG. 25.

The fluid outlet coupling components for the upper end of beam 200 of the second embodiment snow making tower are shown in assembly in FIG. 27B and individually in FIGS. 25, 26 and 27. These components include a water manifold collar 240 provided with three side ports 242, 244, and 246 (FIG. 27) for communicating individually with the three nozzle booms 120, 122 and 124 that are mounted on the upper end of beam 200 in the manner of the first embodiment snow making tower 50. Two different length outlet air pipes 248 and 250 are respectively inserted telescopically at their up-stream ends into beam air conduits 206 and 208 respectively and coupled in sealed relation thereto by welds 252. Collar 248 is first slid back telescopically over the outside of pipe 202 to provide access for making these welds. Air tubes 248 and 250 both extend through respective holes 254 and 256 in a circular plate 258 that seats within the downstream end of collar 240 and is sealably welded thereto, as at 260. Two air distributing collars 262 and 264 are coaxially abutted in tandem and another circular plate 266 is fitted into the outer end of collar 262. The downstream end of the longer air tube 250 protrudes through the single port 268 in plate 266, as shown in assembly in FIG. 27B, wherein the parts are joined and sealed by the welds as shown therein, including an end plate cap 270 welded to the outer end of collar 264.

Air distributing collar 262 has three radially extending orifice passageways 272, 274 and 275 aligned individually respectively with the nozzle sub-booms 120, 122 and 124 in the manner of orifice passageways 140, 142 and 144 of the first embodiment (FIGS. 26 and 27B). Likewise, air distributing collar 264 has three radial air orifice passageways 276, 278 and 279 likewise aligned with associated nozzle sub-booms in the manner of orifices 140, 142 and 144, the (FIG. 26 and FIG. 27B.) Preferably the smaller air jet orifices 272, 274 and 275 of collar 262 are 7/64 inches in control diameter, whereas the three larger orifices 276, 278 and 279 of collar 264 are 9/64 inch in control diameter.

From the foregoing component construction and assembly, it will be seen that, in accordance with another feature of the second embodiment snow making tower, the compressed air system when provided with three-way valve 236 may have any one of three operational modes, namely (1) dual shutoff; (2) on "low-air" for generating three low power air jets, by air supply hose 242 communicating with air inlet 220 and thence, via beam air tube 206 and outlet air tube 248 fed into the air manifold chamber 267 (formed within collar 262 between plates 258 and 266) to produce three compressed air jets issuing from smaller orifices 272, 274 and 275; and (3) on "high-air" for generating three high power air jets, by hose 242 communicating with inlet air tube 216 and thence, via beam air tube 208 and outlet air tube 250 fed into the manifold air chamber 277 (formed within collar 264 between plates 266 and 270) to produce three air jets issuing from larger orifices 276, 278 and 279.

At 70 psi. inlet air pressure available in supply hose 242, when air tubes 216, 206 and 248 are feeding air to smaller diameter orifices 272, 274 and 275, the air consumption will be approximately 50 cfm. The air jets issuing from manifold chamber 267 under this condition are thus located, oriented and have the same force and effect as the air jets issuing from orifices 140, 142 and 144 of tower 50 described previously. However, when the compressed air supply is coupled to air inlet tube 216 and thence, via tubes 208 and 250, to the manifold air chamber 277 feeding larger diameter orifices 276, 278 and 279, more powerful air jets will issue and operate at a total air consumption rate of approximately 100 cfm. It is to be understood that the output capacity of the supply source for feeding compressed air to these two air chambers selectively is rated to more than maintain the 70 psi air pressure in each of the two end air chambers when so coupled to the air source, the rate of air consumption thus being controlled solely by the orifice size of the air jet orifices.

When a four-way valve (not shown) is substituted for the three-way valve 236 as indicated previously, a fourth operational mode becomes available wherein compressed air is supplied via air tubes 216, 206 and 248 to the smaller orifices 272, 274 and 275 simultaneously with air being supplied via air tubes 220, 208 and 250 to the larger diameter orifices 276, 278 and 279 so that a total of six air jets are simultaneously created, whereupon the total air consumption increases, in the foregoing preferred example, to about 150 cfm. Thus, during this fourth operational mode the most powerful compressed air seeding and spray breakup action occurs to enable snow making under adverse climatic conditions when snow making is most needed, albeit at higher energy costs. As conditions become more favorable for snow making the air supply to the smaller orifices 272, 274 and 275 may be cut off so that only three of the more powerful air jets are produced, and then as conditions improve even further, air to the larger orifices can be cut off and valve-coupled to the smaller orifices 272, 274 and 275, so that in this last stage the second embodiment tower operates identically to tower 50 as described previously. Then, at very cold temperatures all air can be cut off, if desired, and the snow making tower run in the water-only mode. Thus, the second embodiment snow making tower offers greater versatility and adjustability to meet a wider variety of snow making climatic conditions without substantially increasing the cost of construction of the snow making tower.

First Modification of Nozzle Sub-Boom and Water Nozzle Array

Figure 28:
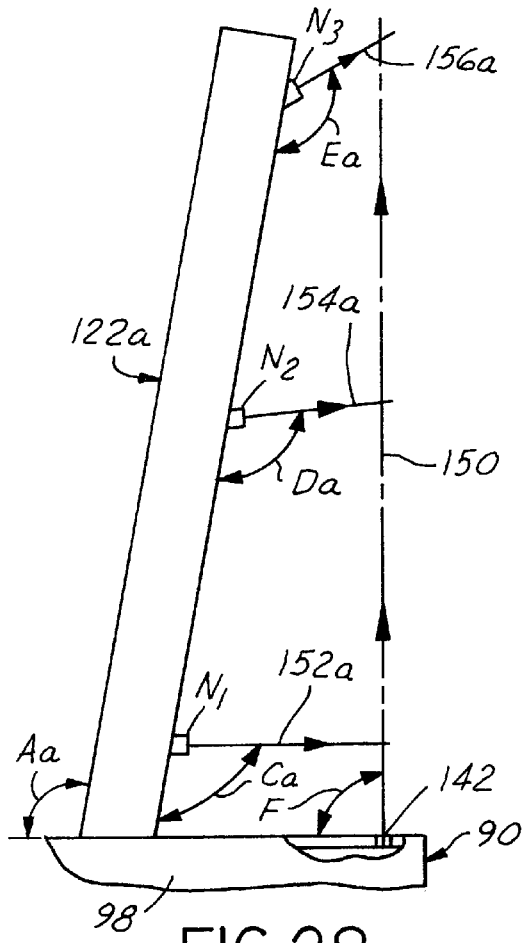
FIG. 28 is a fragmentary simplified diagrammatic side elevational view of a modified triple nozzle wing pipe and associated compressed air jet orifice of the main pipe, also constructed in accordance with the present invention.

FIG. 28 illustrates a modified orientation and angulation of the three nozzle sub-booms $\mathbf{120}_a$, $\mathbf{122}_a$, and 124*a* and associated nozzles $N_1$, $N_2$, $N_3$ that alternatively may be employed in the first and second tower embodiments. FIG. 28 illustrates only one of the modified nozzle booms, namely the center nozzle boom $\mathbf{122}_a$, it being understood that the associated starboard and port modified sub-booms $\mathbf{120}_b$ and $\mathbf{124}_b$ (not shown), would, like sub-boom 122*a*, be mounted in the same location on the extension 98 of the boom conduit assembly 90. However, instead of being oriented at angle A of FIG. 7, each of the modified sub-booms $\mathbf{122}_a$, $\mathbf{122}_b$ and $\mathbf{122}^c$ are raked forward at an obtuse angle $A_a$ of, for example 100°, as shown in FIG. 28. The angles $C_a$, $D_a$ and $E_a$ of the axes of nozzles $N_1$, $N_2$, $N_3$ relative to the axis of sub-boom $\mathbf{122}_a$, are likewise modified and, for example, and as shown in FIG. 28, may respectively be angles of 100°, 115° and 130°. However, as in the embodiment of FIGS. 6 and 7 the central axes of the water sprays 152*a*, 154*a* and 156*a* issuing from each of these nozzles are coplanar with the compressed air jet 150 issuing from orifice 142.

Hence, with the modified sub-boom and nozzle array orientation of FIG. 28, the three water sprays issuing from each nozzle boom are mutually divergent to provide a greater plume spread of the water spray in ambient to better promote heat exchange to ambient and more rapid freezing of the atomized water particles.

Secondly, it will be seen in the modification of FIG. 28 that compressed air jet 150 intersects the throat of the innermost spray 152*a* issuing from nozzle $N_1$ a greater distance away from nozzle $N_1$ than that of the intersection of compressed air jet 150 with the middle spray 154*a* issuing from nozzle $N_2$, and likewise intersects the middle spray farther away from nozzle $N_2$ than it does the uppermost spray 156*a* issuing from nozzle $N_3$. Hence, there is less deflection and more penetration of a larger percentage of the air column of air jet 150 emerging from the lowermost water spray 152*a* and intersecting the middle water spray 154*a*, and likewise a greater percentage of the air jet column or stream remains to impinge upon and physically react with the uppermost water spray 156*a*.

Second Modification of Nozzle Sub-Boom and Water Nozzle Array

Figure 29:
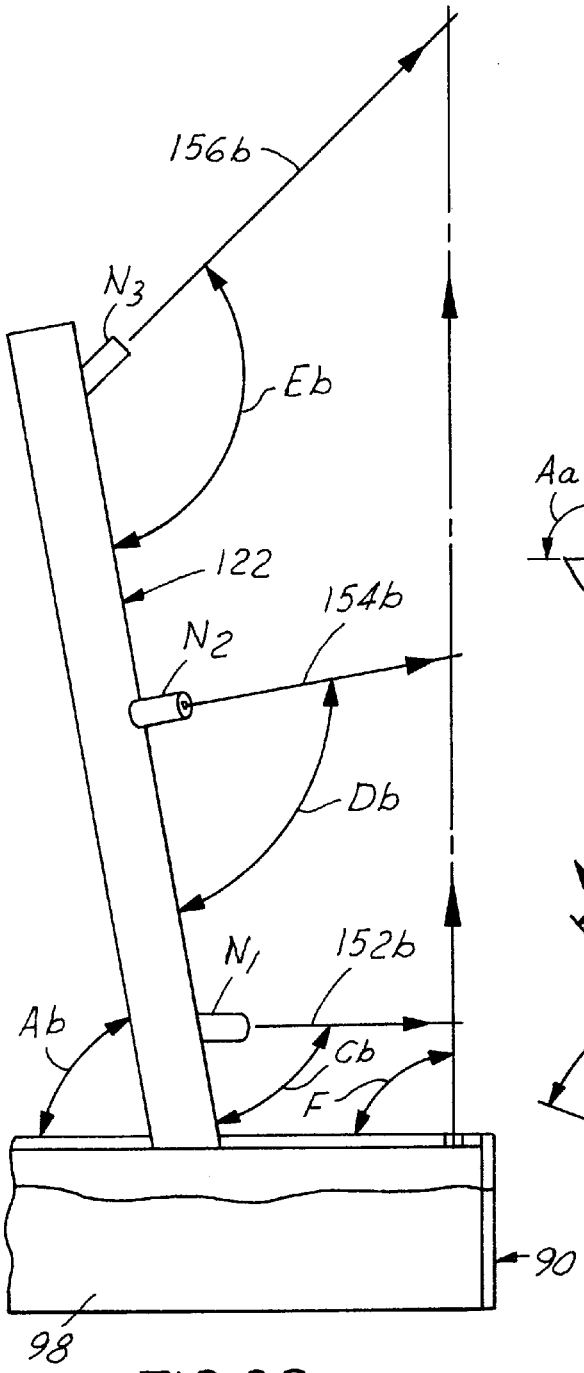
FIG. 29 is a simplified fragmentary diagrammatic side elevational view of another modification of a triple nozzle wing pipe and associated compressed air jet construction, also in accordance with the invention.
Figure 30:
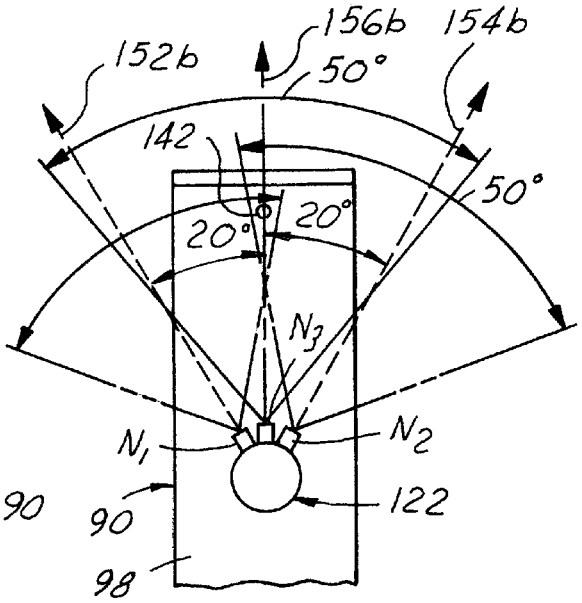
FIG. 30 is a fragmentary diagrammatic plan view of the water spray and air jet pattern produced by the modified construction of FIG. 29.

FIGS. 29 and 30 illustrate another modification of the mounting of water nozzles on center sub-boom 122, it being understood that this modified nozzle mounting is also employed on port and starboard sub-booms 124 and 120 and that all such nozzle-modified sub-booms are and located as shown in the first embodiment nozzle boom and nozzle array of FIGS. 4–7. However, in the FIG. 29 modification the included acute angle $A_b$ between the axis of sub-boom 122 and that of the main pipe assembly 90 is shown as 80° instead of 70° as in FIG. 7. Likewise, the included angles between the water spray central axes $\mathbf{152}_b$, $\mathbf{154}_b$ and $\mathbf{156}_b$ of nozzles $N_1$, $N_2$ and $N_3$ respectively are angle $C_b$–80°, angle $D_b$–90° and angle $E_b$–125°. Thus, it will be seen that each of the water sprays from the three nozzles on a nozzle boom are mutually divergent from one another and at greater divergent angles than in the modification of FIG. 28, due to the backward rake of the associated sub-boom 122 at angle Ab, versus the forward rake angle $A_a$ of the modification of FIG. 28. Hence, with the FIG. 29 sub-boom and nozzle angles as compared to FIG. 28 there is an even wider divergence between the fan plume of spray produced by each of the three nozzles on each sub-boom to further promote individual freezing of the water particles in each spray in ambient, and even less spray pattern intermingling in the resultant spray fog produced from the three sub-booms.

As a further feature of the second modification of FIGS. 29 and 30, and as best seen in FIG. 30, each of the spray nozzles is mounted at a mutually divergent angle with respect to the other two nozzles on the nozzle boom and relative to their respective angular positions about the axis of sub-boom 122. Thus, the uppermost nozzle $N_3$ has its orifice axis and spray axis 156*b* extending coplanar with the axis of the compressed air jet orifice 142. The middle nozzle $N_2$ has its axis 154*b* positionally rotated 20° to starboard of axis 156*b*, and the lowermost nozzle $N_1$ has its axis 152*b* positionally rotated 20° to port of axis 156*b*. In this embodiment nozzles $N_1$ and $N_2$ may again be fan-type nozzles, whereas the uppermost nozzle $N_3$ may again be a cone-type nozzle. Since each of these nozzles produces approximately a 50° spread in its spray pattern, as indicated diagrammatically in FIG. 30, it will be seen that the uppermost spray pattern from nozzle $N_3$ is centered on the air jet 150. However, the middle spray pattern from nozzle $N_2$ only has its port or left hand edge slightly overlapping with and intersected by air jet 150, and likewise the bottom spray pattern from nozzle $N_1$ has its right hand or starboard edge slightly overlapping with and intersected by air jet 150. Thus, although each spray pattern is acted on by dispersion impingement with air jet 150, and seed crystals likewise also formed therefrom by this interaction in each spray pattern, nevertheless the edgewise intersection of the two lower spray patterns with the air jet 150 allows more of the force and effect of the air jet to reach the uppermost water spray issuing from nozzle $N_3$. Moreover, the divergence of the three nozzles relative to one another about two axes provides a maximization of spray pattern separational orientation for greater overall dispersement into ambient air from the snow making tower. Nevertheless, the general "throw" orientation of the sprays is still all on one side of the "tree" of spray nozzles, consistent with the preferred downwind orientation of the longitudinal axis of pipe assembly 90.

It will also be understood in conjunction with the first and second spray nozzle embodiment orientations of FIGS. 28–30 that the angular orientation of the lower and middle nozzles $N_1$ and $N_2$ on sub-boom 122 may be adjusted to tilt the major axis of the fan slit orifices of these nozzles from an orientation perpendicular to the plane of the drawing to varying angles of incidence thereto and so adjusted relative to like nozzle orifice major axis inclination of center nozzles on the flanking port and starboard sub-booms to arrive at a fan spray pattern from all three sub-booms producing minimal spray pattern interference from the nine nozzles of the three sub-booms. In addition, the triple operational mode air jet combinations of the second embodiment snow maker (using either the smaller air jet orifices 274 or the larger air jet orifices 278 or both sets of orifices together) may also be combined with the modifications of the spray nozzle and boom orientations of the modifications of FIGS. 28–30. Also, as another modification, the axis of each of the air jet orifices 140–144, 272–275 and 276–279 may be inclined anywhere between the radial array described previously to an orientation parallel to the axis of the associated sub-boom. Of course, it will be well within the skill of those in the art, in view of the foregoing disclosure, to empirically adjust the foregoing sub-boom, spray nozzles and air jet orifice angulations relative to one another, as well as compressed air and water pressures and air/water ratios, to best optimize snow making performance for given climatic conditions, ski slope location of the tower, prevailing wind and terrain conditions, as well as available water and air supply system pressures.

Third Embodiment Snow Making Tower

Figures 31, 32, 33:
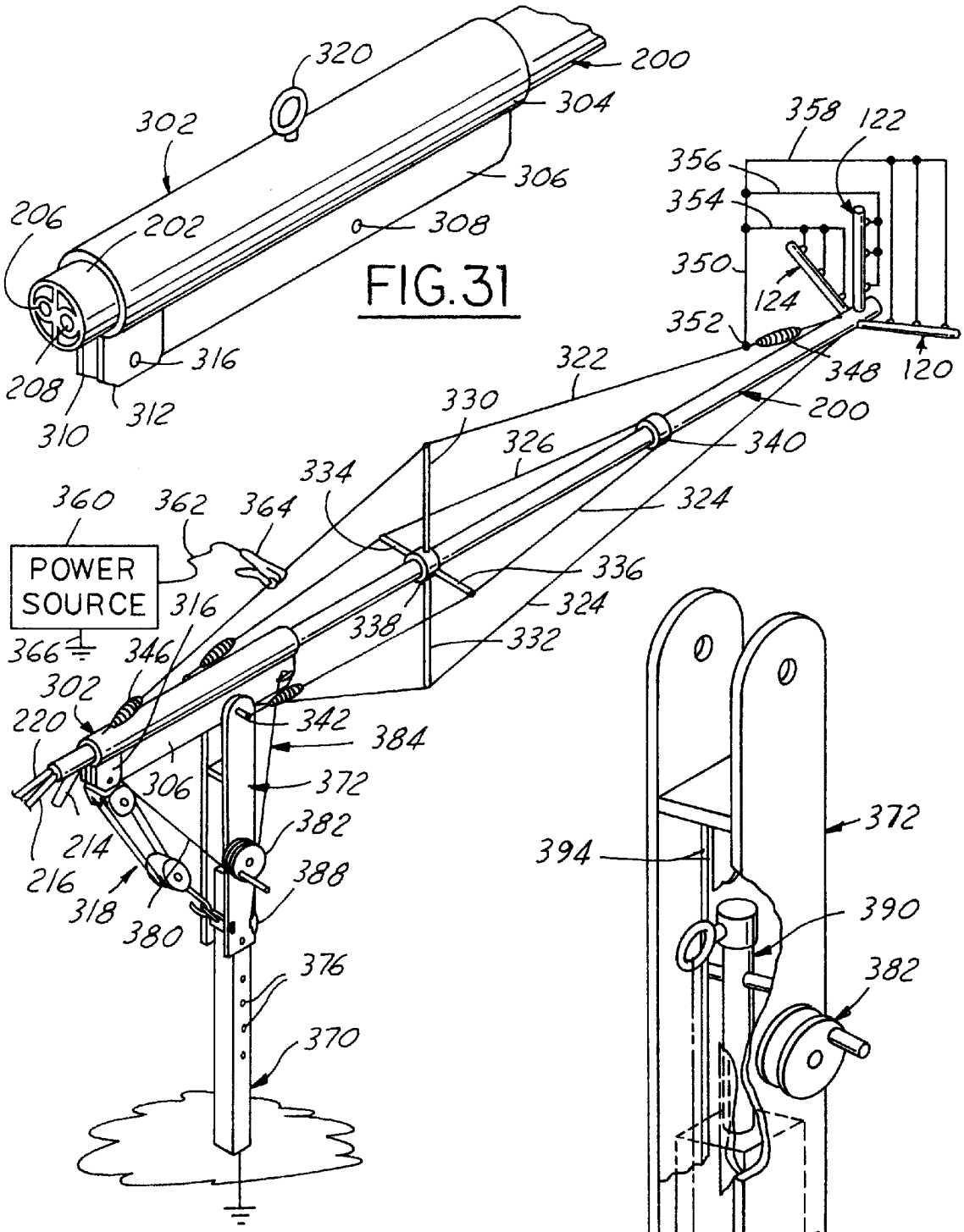
FIG. 31 is a fragmentary perspective view of a modified main pipe cradle support, also constructed in accordance with the present invention.
FIG. 32 is a part perspective, part schematic-part diagrammatic view of a third embodiment of an adjustable snow making tower, also constructed in accordance with the present invention.
FIG. 33 is a perspective view of the ground support pole and upper support framework telescopically mounted thereon as utilized in the third embodiment tower of FIG. 32.

FIGS. 31, 32 and 33 illustrate, in somewhat simplified, partially schematic and semi-diagrammatic form, a third embodiment snow making tower 300 also constructed in accordance with the present invention. Tower 300 utilizes the dual air tube water conduit main boom extrusion 200 of the second embodiment snow tower, but shown made entirely straight length without the bend 96 of the first embodiment tower 50. However, mast boom 200 may have such a bend integrally formed therein, if desired to provide a downwardly inclined forward extension, such as extension 98 of the first embodiment.

In accordance with one feature of tower 300 a modified boom cradle 302 is provided to replace box beam cradle 66 of the first embodiment snow tower 50. Cradle 302 consists of a cylindrical sleeve 304 which slides over the circular exterior of outer pipe 202 of conduit beam 200 and is welded thereto at its opposite ends. A longitudinally extending center rib plate 306 is welded to the center of the underside of sleeve 304 and is provided with a pivot hole 308 for receiving the trunnion pin for pivot mounting of the mast on the ground support. A pair of reinforcing plates 310 and 312 flank the rear end of rib plate 306 on opposite sides thereof so as to be spaced apart, and a through aperture 316 extends through plates 310, 312 and rib 308 to provide for insertion of a pivot pull bolt for attaching block and tackle rigging 318 as shown in FIG. 32. A hoisting eye 320 is welded to the top center of sleeve 304 for convenience in transporting the boom assembly snow making tower 300 when separated from its ground support structure, or alternatively for adjustably hoisting the boom assembly on the ground support structure as described hereinafter in conjunction with the embodiment of FIGS. 34–35B.

Tower 300 is provided with the array of nozzle sub-booms 120, 122 and 124 described in conjunction with the first embodiment tower 50 or the second embodiment tower 200, or may be provided with any of the modified nozzle sub-booms and nozzle modifications of FIGS. 28–30.

In accordance with another feature of tower 300, the boom conduit assembly 200 is further reinforced against bending moments by a guy wire type spreader and stay mast rigging as shown in FIG. 32. If desired, conventional large sail boat mast rigging and hardware may be utilized for this purpose to provide upper and lower stays 322 and 324, preferably made from conventional stainless steel woven or twisted multiple strand wire cable material that are rigged coplanar in a vertical plane, and a pair of shorter guy wire stays 326 and 328 that are rigged coplanar in a horizontal plane. Preferably, each of the opposite ends of each stay is adjustably fixed to mast conduit 200 by a conventional attachment hardware welded thereto and provided with tension adjusting tumbuckles (not shown).

The stays 322–328 are maintained in mutually spread-apart condition by four spreaders 330, 332, 334 and 336 telescoped into sockets provided in a spreader collar 338, that is sleeved on mast beam 200 and welded thereto. The upper ends of side stays 326 and 328 are attached to a rigging collar 340, likewise sleeved on and welded to mast pipe 200. If desired, the upper ends of the top and bottom stays 322 and 324 likewise may be attached to collar 340 so that they are spaced further away from the spray fog emitted from the nozzle sub-booms of the mast to render them less prone to ice up from spray fog blow-back. The lower end of top stay 322 can be attached to cradle pipe 304, and likewise the lower end of bottom stay 324. The side stays 326 and 328 are shown attached to the trunnion pivot rod 342 of the mast ground mount structure, but likewise alternatively may be attached to pipe 304.

The provision of the mast rigging reinforcing stays 322–328 substantially increases the strength-to-weight ratio of the entire mast structure and enables an extra-long (say 40'–60') conduit pipe main beam 200 to be utilized when so desired. The guy wire reinforcing of this rigging also enables the use of thinner wall circular cross-section standard piping conduit material when constructed in the manner of tower 50, or even when extruded in the form of conduit 200 of FIG. 19 or conduit 502 of FIG. 38A.

In accordance with another feature of tower 300, as shown in FIG. 32, upper stay 322 may be electrically insulated at its opposite ends from its turnbuckle attachment to cradle pipe 302 and from its turnbuckle attachment to the upper end of conduit pipe 200 by interposing conventional ceramic utility power line insulators 346 and 348. A suitable electrical circuit connection from stay 322 to each of the spray nozzles on each of the nozzle booms 120, 122 and 124 may be provided by insulated electrical wiring connected with its main lead 350 to stay 322 at connection 352 and having branch leads 354, 356 and 358 respectively leading to each of the nozzle sub-booms via suitable tap off leads leading individually to each of the three electrically conductive spray nozzles $N_1$, $N_2$ and $N_3$ on each of the spray booms as shown in the schematic wiring diagram at the upper end of mast 200 in FIG. 32.

With tower 300 so electrically wired, a suitable source of de-icing current, indicated as power source 360 in FIG. 32, may have one output lead thereof 362 connected by a conventional battery cable clamp 364 to a lower ground level accessible portion of upper stay 322, as shown in FIG. 32. The other lead 366 of the power source may be connected to earth ground or to the water pipe inlet coupling 214. When electrical power of suitable amperage and voltage, either AC or DC, as suitably regulated by the power source conventional controls, is supplied to the upper stay 322, an electrical circuit is completed from the power source via lead 362, clamp 364, stay 322, lead 350 and the parallel wiring branches to each of the nozzles on the three nozzle booms 120, 122 and 124. Since the materials of the mast construction are electrically conductive, including the spray nozzles, a return path circuit is completed from each nozzle into its associated nozzle sub-boom and thence via the main boom 200 back to either earth ground through the mast support ground structure, or to a ground connection at water inlet 214. The resistance heating effect of the applied electric current ($I^2$ R per Joule's Law) will heat each element of the circuit path in accordance with its individual ohmic resistance.

To insure proportionately greater heating at each of the water nozzles, the wiring connection thereto may be made by a turn of resistance wire wrapped around the barrel of each nozzle and then connected at its terminal end to the associated nozzle sub-boom. Generally, the material of stays 322–328, if they be stainless steel sail boat mast rigging type, are electrically conductive but not to the extent of the aluminum material of the boom pipe 200. Therefore, some electrical resistance heating will occur in the stay 322 as well as in the spray nozzles and associated sub-booms, and even in the main pipe 200, in the electrical return path to ground. The spreaders 330–336, if made of fiber glass rod material or reinforced plastic tubing can serve as insulators, although stainless steel rods may be used as an electrically conductive but high resistance parallel path to ground if desired. Short insulator sleeves on the stays may alternatively be used at the outer ends of the spreaders. To the extent that icing conditions on insulator 348 (or other insulators) temporarily provide a short circuit path to ground around the spray nozzles, the heating effect of electrical current will soon melt this ice and evaporate the water melt and thereby convert this path to its original high resistance characteristic. Likewise, the ohmic resistance at each of the nozzle connections will undoubtedly vary according to the amount of icing present, but the melting of the ice will tend to return the conditions to original circuit balance electrically and resistively after a given time period of applied de-icing current.

It will be understood that only the upper guy wire 322 may be provided on a given mast and the side stays 326 and 328 omitted, and even the lower stay 324 omitted if desired. With such a simplified rigging arrangement the electrical de-icing circuit still remains as stated previously. However, if rigged with four stays, as shown in FIG. 32, and if icing conditions exist on any of these stays, then clamp 364 can be removed from stay 322 and applied to the selected one or more of the other three stays to cause electrical resistance heating thereof and resultant de-icing of the same. For this purpose attachment of guy wire stays 326, 328 and 324 are not electrically insulated at their upper ends from their attachments to mast pipe 200.

The power source 360 may conveniently be a small portable gasoline engine driven generator unit transported on a snowmobile or the like if a system source of electrical power such as a fan snow machine power transmission line is not available with its associated field outlets to power a portable power regulator unit. The de-icing current can be applied to tower 300 whether fully elevated or pivoted down to ground level, and may be applied when compressed air and water are being applied to the tower or when shut down. Indeed, if de-icing electrical power is supplied to the rigging of mast 300 while the same is elevated and being supplied with compressed air and water to produce a water spray and compressed air fog, as in normal snow making operation, the unclogging effect of the electrical resistance heating can be observed and de-icing electrical power discontinued when all nozzles are operating to produce water spray in accordance with their design specification. Moreover, it is believed, but not yet tested, that by so applying minimal de-icing current of relatively high voltage to the mast while so operating may create an electrical ionization effect on the water particles issuing from the spray nozzles that may enhance snow making performance under certain climatic conditions. Another feature of the third embodiment snow making tower 300 resides in the construction of the ground support structure and pivoting equipment. As shown in simplified form in FIGS. 32 and 33 the ground mounted support pole 370 is a hollow box channel construction of square cross sectional configuration, and the upper support pipe 372 is a similar hollow plate box construction that telescopically mounts on pole 370 and is vertically adjustable therealong to selected fixed positions by means of a stop pin 374 (FIG. 33) inserted into an associated hole 376 located in a row of holes in the side of round pole 370. Due to the non-circular cross section of the ground support pole and support pipe 370 and 372, mast 300 is not rotatable about a vertical axis, but rather is held from swinging movement about a vertical axis by such noncircular ground mount configuration. However, the tower can be adjusted in 90° horizontal swing increments by lifting upper support box pipe 372 above and clear of the upper end of ground support pole 370, then rotating the tower 90° and then re-telescoping upper support pipe framework 372 back down onto support pole 370. For such use, a row of adjustment holes 376 are provided in each of the four sides of the ground box pole 370. Such adjustment may be accomplish by using a portable crane hoist hooked to left eye 320, with trunnion pin 342 left in place and mast 200 first pivoted down to ground level at its nozzle end. The nozzle end may then be hand carried to traverse the 90° rotation, and then the lower (fluid inlet) end of mast, with upper pipe framework 372 hanging therefrom, re-telescoped onto the ground pole 370. Of course, this horizontal plane angular incremental re-orientation about the vertical axis of pole 370 can be further subdivided by using a pentagonal, hexagonal, septagonal or octagonal cross-sectional configuration in the construction of framework 372 and pole 370.

Mast 300 also illustrates the feature of application of a block and tackle rigging 318 for adjusting the pivot angle of the mast in a vertical plane of pivotal motion. Block and tackle 318 may be a suitable four-run double block rigging with attached snap shackles that is releasably connected at its upper end to a cross pin carried by the plates 310 and 312 through holes 316 thereof and connected at its lower end to a suitable attachment eye 378 affixed to the side of upper support framework 372 at a suitable location facing the adjacent conduit-coupling end of the mast and located adjacent the lower end of support 372. The lead-off run 380 of block and tackle rigging 318 is wound onto the drum of a suitable geared and pawl-lock winch 382 of conventional construction and mounted to the side of the support pipe framework 372, as schematically illustrated in FIGS. 32 and 33. The leverage provided by the two-block rigging 318 as well as that of winch 382 provides sufficient force multiplication to enable normal hand cranking force manually applied to winch 382 to be sufficient to pivotally raise and lower mast 300 on its ground mount. The pawl-lock of the winch locks the rigging so that the mast is held against clockwise pivoting about trunnion shaft bolt 342 as viewed in FIG. 32.

Counter-clockwise motion of the mast that may be induced by strong wind gusts tending to whip the mast upwardly against gravitational forces is resisted by a suitable flexible wire rope lanyard 384 suitably secured to the upper end of cradle 302, as by a cleat 386, and likewise adjustably secured to the lower end of support 372 by another cleat 388.

As shown in FIG. 33, the ground support box pole construction 370 may be provided with a suitable fixed hoisting pole 390 carrying an eye-bolt 392 at its upper end that protrudes outwardly through a slot 394 in that side of support 372 facing rigging 318. When the ground support structure for the mast is so equipped, mast pole boom 200 may be first pivoted down to rest the nozzle boom tree end on the ground. Then rigging 318 is decoupled at its upper end snap shackle from the pull pin in plates 310, 312, and the upper snap shackle attached to eye 392. Winch 382 is then operated to raise or lower upper support framework 372 telescopically on the lower support pole framework 370, as desired, to adjust the elevation of trunnion shaft 342 above ground level, locking pin 374 being pulled and then re-inserted into a registered hole 376 when the desired adjusted elevation is reached. Then the upper block of rigging 318 is reattached to the pull pin in brackets 310 and 312 to enable normal pivotal adjustment of the mast. Of course, lanyard 384 is freed from cleat 388 during this adjustment procedure, and then re-attached after the mast is pivoted to desired elevation.

Fourth Embodiment Snow Making Tower Construction

FIGS. 34, 35, 35A and 35B illustrate a modified tower support construction 401 that may be used to vertically adjust the height of the tower pipe above ground elevation on its ground support structure, as well as to enable rotation of the tower about a vertical axis either through a 360° range or through a limited range of less than 360° as set by adjustable spring stops. The tower support construction shown in FIG. 35 may comprise the ground support pole 52 and a hollow cylindrical support pipe 400 similar to pipe 60 but slightly modified therefrom so as to have greater lateral spacing between the trunnion support plates 62a and 64a fixed onto the top of pipe 400. An air and water conduit pipe beam 92 is supported by a sleeve collar cradle 402, similar to cradle 302, but having trunnion axle pins 404 and 406 protruding from the opposite sides thereof and journalled in plates 62*a* and 64*a* for vertical plane pivoting of the pipe beam about the axis of the trunnion pins.

Upper support pipe 400 may be adjustably raised and lowered on ground pole 52, or completely lifted off of the ground pole for maintenance or movement to another location, by means of a conventional commercially available ratchet lever hoist 408, such as that made commercially by COFFING HOISTS, COFFING P.A. Model, with a 360° rotating handle 410 for one-handed operation. The ratchet-end hook 412 is attached to eye 320 of cradle 402 and the chain-free-end hook 414 is attached through a hole in a cross arm 416 of a suitable portable lifting pole 418. Pole 418, after attachment of hook 414 while the pole is unmounted and at ground level, is then lifted up with enough slack chain so that its bottom end may be inserted downwardly sequentially through the openings in a pair of coaxial support brackets 420 and 422 welded to the side of pipe 400 (FIGS. 35 and 35B). The bottom end of pipe 418 may be suitably rested on a load spreading pad or plate 424, if needed to prevent the pole from sinking under the weight of the load into the ground or the snow/ice ground cover.

With pole 418 thus mounted and hoist 408 so attached, handle 410 may be suitably manipulated to lift the pipe tower and upper support pipe 400 vertically on ground pole 52 to whatever height is desired. A series of adjustment holes may be provided in pipe 52 in the manner of pole 376 of pipe 370 described previously, and a height adjustment pin such as pin 374 provided for use in setting the adjusted height of upper pipe 400 on ground pole 52. Preferably, the support pin 374 and the pin holes in pipe 52 are located angular adjacent, but slightly offset, from brackets 420 and 422. Moreover, brackets 420 and 422 are located closely adjacent the mast pivoting mechanism (not shown), which may be the jackscrew 70 of the first embodiment mast 50, the block and tackle rigging 318 of the third embodiment mast 300, or the chain hoist 408 (lanyard 384 being provided if block and tackle or chain hoist or like boom flexible tension element pivot pull devices are employed). Thus all structure protruding outwardly from upper pipe 400 is to be located within a narrow angular range adjacent one another and generally adjacent the vertical plane through the axis of pipe 92.

In accordance with another feature of the mast support construction of FIGS. 35–35B, support pipe 400 is rotatable relative to ground pole 52 about the vertical axis thereof through 360° when hoist pole 418 is removed. If desired, depending on prevailing wind conditions, the mast may be left unrestrained for free rotation about this vertical axis so that the mast pipe boom can be automatically oriented downwind by the force of the wind acting on the main conduit pipe and by the air drag forces generated by the wind impinging on the nozzle sub-booms at the upper end of the pipe mast. Typically, this will induce a horizontal swing of the mast about the vertical swivel axis of the ground support pipe and pole, through some limited angular range in accordance with the prevailing wind shifts, usually not more than 60°. Suitable provision must be made for corresponding ground drag travel of the air and water supply hoses coupled to the mast in order to permit such limited swinging motion. Depending on ground conditions (snow and ice cover) providing some slack in these hose connections may suffice. Under other conditions, a loose drape of the supply hoses over a low ground support may accommodate such limited swinging motion of the mast. Of course, if an internal air and water pipe feed system is provided in the ground mount supports, such as that disclosed subsequently herein in connection with FIGS. 43 and 44, mast swinging about a vertical axis is not encumbered by supply hoses laid above ground and with their outlets connected to the mast air and water inlet couplings.

Figure 35A:
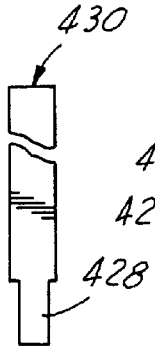
FIG. 35A is a fragmentary side elevational view of swivel stop spring leaf utilized in the tower of FIG. 35 and shown by itself.
Figure 35B:
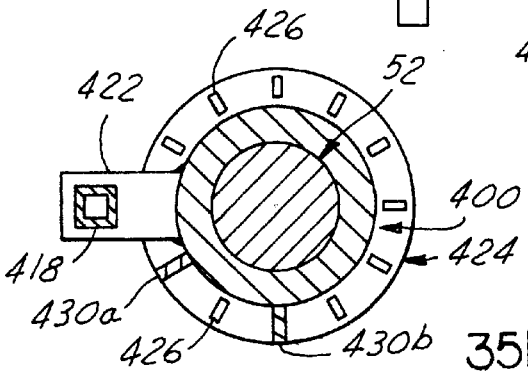
FIG. 35B is a cross sectional view taken on the line 35B—35B of FIG. 35.
Figure 35:
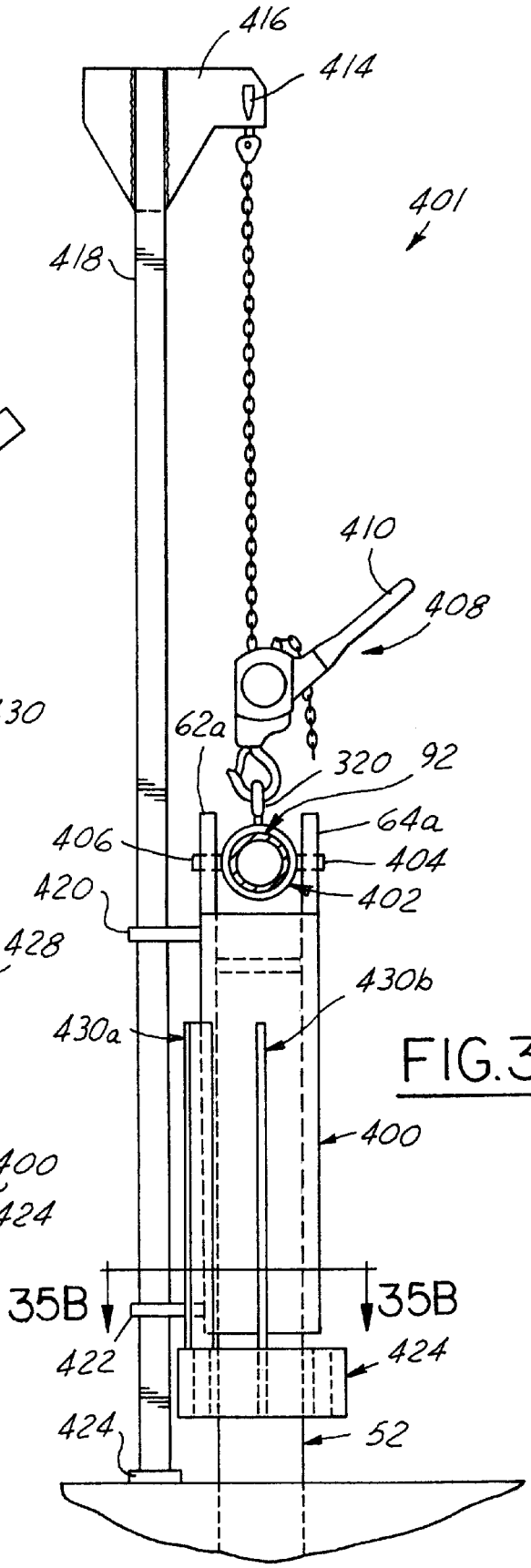
FIG. 35 is an elevational, and part sectional view of the fourth embodiment snow making tower, also constructed in accordance with the invention.

Another feature of the construction shown in FIGS. 35 and 35A and 35B is an adjustable spring stop structure for limiting the angular range of rotation of the mast about a vertical axis. This may take the form of an index ring or collar 424 which in assembly may be slid onto the outer surface of pipe 52 and affixed thereto by welding at a suitable elevation above ground level and below the lowermost height adjustable position of the lower end of support pipe 400. Collar 424 has an annular row of vertical slots 426 arranged at equal angular increments (FIG. 35B) and adapted to individually receive the mounting tang 428 of a plate leaf spring 430 inserted tang first downwardly into the slot. Two such leaf springs 430*a* and 430*b* are shown in FIGS. 35 and 35B as so in installed in swing limit positions on collar 424.

The two leaf springs are thus suitably selectively and removably positioned in associated slots 426 to serve as abutment stops in the travel path of pole bracket 422, at one end limit of rotation of upper pipe 400 about a vertical axis, and by abutment of the adjacent mast pivoting structure at the other end limit of such mast swinging rotation about a vertical axis. Due to the cantilever mounting of leaf springs 430 on collar 424, they provide a limited amount of spring flex when constructed of suitable material for this purpose, such as steel or glass/fiber composite materials, or even when made from salvaged scrap snow skis. If no rotary motion is desired after the tower is swung to a preferred orientation downwind, then leaf springs 430*a* and 430*b* can be positioned closely adjacent the protruding abutment structure on pipe 400.

In the case of snow making tower 50, with collar 424 mounted on pipe 52 the jackscrew 70 can serve as the protruding member for stop abutment with the leaf springs. Likewise, a hook eye (not shown) provided on support pipe 400 near its lower end when using block and tackle rigging 318 or chain hoist 408 will suffice as the protruding limit stop in cooperation with the leaf springs. When the ground support structure is so equipped with the index collar 424, the set screw 86 of FIG. 18 can be omitted, if desired, or this may be substituted for use as the protruding swing limit stop. The axial length of the leaf springs is made sufficient to accommodate the vertical adjustment travel of pipe 400 on ground pole 52. The resilience of the leaf springs is only made sufficient to absorb the pounding and shocks imparted by the protruding stop when the mast is swung somewhat rapidly about the swivel axis of the ground support by a rapid and strong wind shift.

Fifth Embodiment Snow Making Tower Construction

Figure 37:
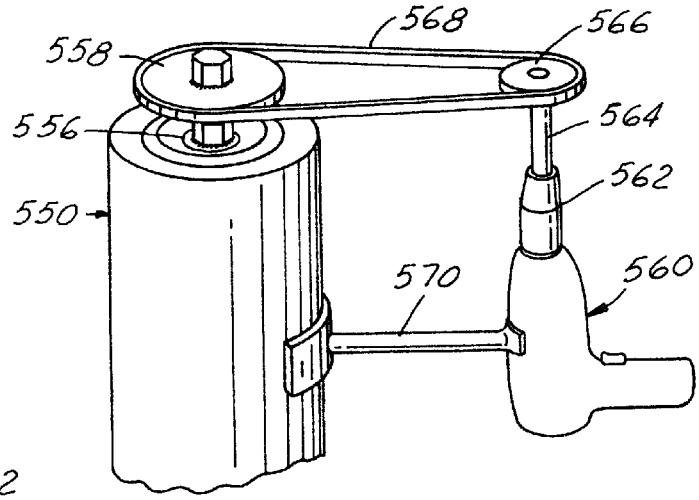
FIG. 37 is a fragmentary perspective view illustrating a portable drill motor and chain-and-sprocket tool employed with tower elevating support structure of FIG. 36.
Figure 36:
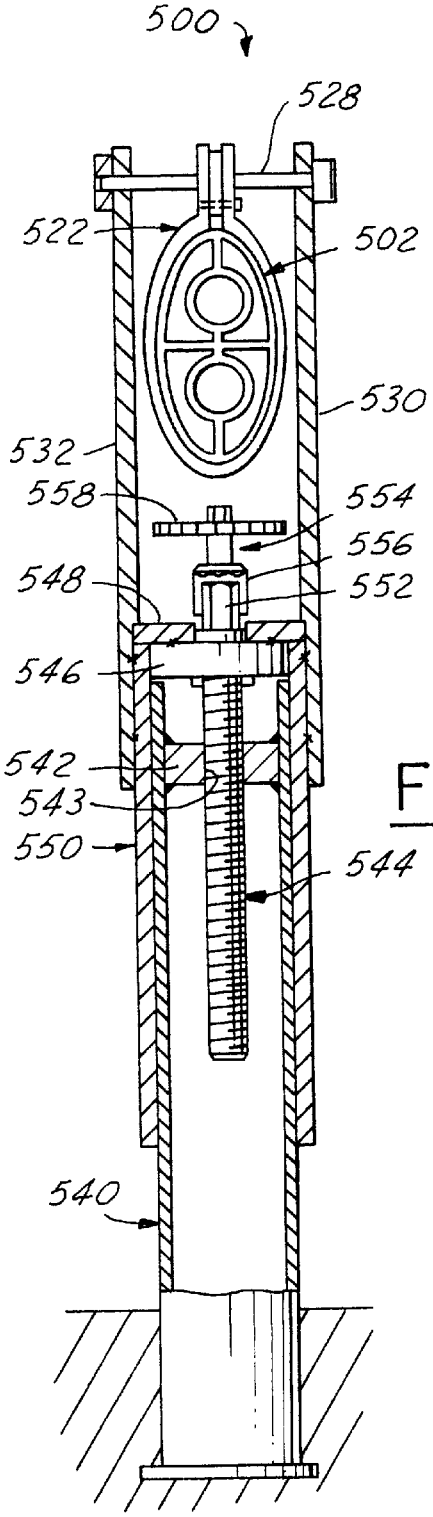
FIG. 36 is a vertical center sectional view of a tower ground support structure of a fifth embodiment adjustable snow making tower, also constructed in accordance with the present invention.
Figure 38A:
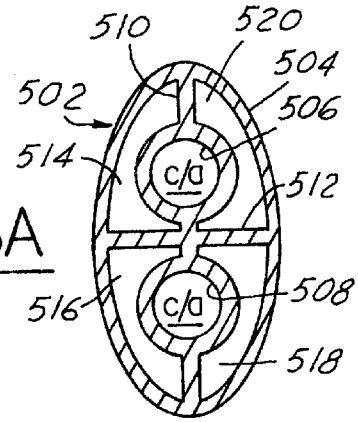
FIG. 38A is a radial cross sectional view of the main pipe boom of the embodiment of FIGS. 36–38.
Figure 38:
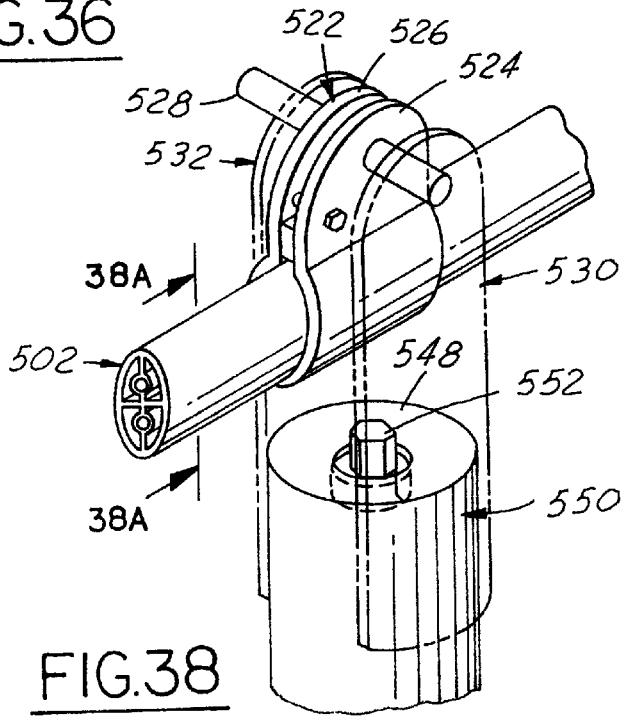
FIG. 38 is a fragmentary perspective view of the pipe support structure of FIGS. 36 and 37.

FIGS. 36, 37, 38 and 38A illustrate modified components of a fifth snow making tower construction 500 also in accordance with the present invention. Tower 500 provides a modified air/water conduit mast beam 502 formed as a one piece aluminum extrusion, preferably of high strength aluminum alloy like beam pipe 200 of the second embodiment tower, and characterized by an outer pipe wall 504 of elliptical or oval radial cross sectional configuration that is oriented in use with its major axis oriented in a vertical plane (as shown in FIGS. 38 and 38A). Pipe beam 502, like pipe beam 200, has two internal tubular air tubes 506 and 508 integrally formed as enlargements of a continuous integral central vertical web 510 and disposed respectively above and below a horizontal integral web 512 that in turn is coincident with the beam pipe ellipse minor axis and extending continuously longitudinally of beam pipe 502. It will be seen that this integrated cross sectional geometrical configuration provides four continuous water conduits 514, 516, 518 and 520 that help isolate the compressed air tubes 506 and 508 from exterior ambient temperatures.

As an air/water conduit for a snow making mast, beam pipe 502 thus functions similarly to pipe beam 200 but in an enhanced manner due to its higher strength-to-weight ratio elliptical configuration that better reinforces the beam against vertically applied bending moments. The cross web 512 also stiffens the beam pipe against bending sideways or in a lateral direction in response to cross wind forces, and also reinforces the pipe against fluid pressure bursting forces. It will also be seen that the cross-sectional geometry of beam pipe 502 provides excellent heat transfer and economizer characteristics in helping cool the water flowing through the pipe from its typical entrance temperature of 54° F. down to almost freezing by the time it reaches the spray nozzles. Likewise, this integral configuration enhances cooling of the compressed air from say an 80° F. entrance temperature down to temperatures in the mid 30° F. by the time the air reaches the compressed air orifice jets, while at the same time the water-jacketing prevents the air in the tubes from reaching freezing temperature and causing water-born particles in the compressed air to freeze, collect and thus clog the pipe air tubes and/or jet orifices.

Due to its elliptical cross sectional shape, and to avoid the expense of extruding a companion cradle sleeve to fit, beam pipe 502 may be strap suspended from a trunnion pin as illustrated in FIG. 38. A suitable strap collar cradle 522 may be press-brake formed from heavy sheet metal and contoured to wrap around pipe 502 and thereby conformed to its elliptical configuration.

Collar cradle 522 has upwardly protruding hanging ears 524 and 526 which may be bolted together so that strap 522 exerts a frictional clamping on pipe 502. Preferably, this affixation is augmented by welding strap 522 to pipe 502. A suitable trunnion shaft 528 passing through coaxial bores in ears 524 and 526 and through registering journal openings in the ground support carrier plates 530 532 provides the vertical plane pivotal suspension of pipe 502 from the ground mount structure.

Tower 500 also features a modified ground mount height adjustment structure in which the ground-embedded support pole 540 has its sub surface components constructed in the manner of ground pole 52. The upper end of pole 540 is modified to provide an interior mounted support wall 542 with an internally threaded central through-bore 542 that threadably receives an elevating lead screw 544. The upper end of screw 544 passes through and is journalled in a bearing 546 affixed to the underside of an end cap 548 of an outer upper support pipe 550 that slidably telescopes over ground support pole 540. The upper end of lead screw 544 has a hex nut head 552 protruding upwardly through a center aperture in cap 548. A chain sprocket fixture 554 is removably seated by its female socket lower end 556 on nut 552 and has an upwardly protruding stem fixedly carrying a chain sprocket 558. Thus it will be seen that by rotating sprocket 558, lead screw 544 will be rotated in support plate 542 and will screw up or down therein, depending upon its direction of rotation, to either raise or lower upper support pipe 550 telescopically on ground pole 540 to thereby adjust the elevation of the trunnion support of mast pipe 502 above ground level.

Lead screw 544 may be rotated directly with a socket wrench by first removing sprocket fixture 554 from nut 552 to expose the latter. Preferably, however, as shown in FIG. 37 a portable drill motor 560 having its own battery pack, and chuck-mounting a gear reduction unit 562 carrying a bit 564 with a chain drive sprocket 566 on its upper end, may be used to power-elevate support pipe 550. A drive chain 568 is trained at one end around sprocket 558 and at the other end around sprocket 566 to drivingly couple drill motor 560 to lead screw 544. Drill motor 560 is reversible, and may be equipped with a suitable bracket brace 570 to help in manually support the drill motor against upper support pipe 550 to thereby assist the operator in hand holding the drill motor during this raising and lowering procedure.

In the event that nut 552 and/or lead screw 544 should become ice frozen during long periods of non-use, it will be seen that a suitable de-icer lubricant solution can be poured down through the clearance between nut 552 and the opening in cap 548 so as to run down through bearing 546 and along the threads of screw 544 to de-ice the same.

Sixth Embodiment Snow Making Tower Construction

A sixth embodiment snow making pipe tower construction 600, also in accordance with the invention, is partially illustrated in FIGS. 39, 40, 41, 42, 42A and 42B. Tower 600 may be constructed generally in the manner of tower 50 described previously, but preferably uses an entirely straight air/water conduit beam 602 in place of the beam 90 having its angled extension 98 joined at the bend angle junction 96. Conduit beam 602 may be mounted in the manner of pipe 90 on a ground support structure, or is mounted in the manner of the modifications described previously hereinabove, and carries the three nozzle sub-booms and nine spray nozzles at its upper end in the manner of tower 50. The cylindrical outer pipe 604 of beam 602 is constructed in the manner of pipe 92 of tower 50, but its opposite end construction is modified for mounting an interior centrally disposed compressed air tube conduit 606.

As one feature of conduit beam 602, air tube 606 is journalled within outer pipe 604 for rotation about its own axis so that the air tube functions as both a compressed air conduit to the air jets interacting with the snow boom nozzles as well as a rotary valve to provide three modes of air/water spray ratio adjustment operation that can be controlled from the lower end of the mast. Thus, as shown in FIG. 40, the lower end of outer pipe 604 is provided with a threadibly mounted journal disk 608, which may carry suitable water pressure seals (not shown) at its outer periphery. Air tube 606 is rotatably journalled in a central through-bore 610 of disk 608 which in turn is internally grooved to carry two O-ring or other suitable pressure packing seals 612 and 614 that slidably and sealably engage pipe 606. A thrust washer 616 may be affixed to the pipe 606 to bear against the interior face of disk 608 and may carry a rubberized fabric washer interposed between washer 616 and disk 608 to augment water sealing and to serve as a fluid-pressure-forced seal to help prevent pressurized water escaping from chamber 112 through the journal mount of tube 606 in disk 608.

A control handle in the form of a spring rod 618 carrying a manipulating knob 620 at its upper end is fixed at its lower end to a collar 622 in turn affixed to tube 606. Rod 618 releasably and yieldably engages selectively three sets of catch detents 624, 626 and 628 angularly spaced around the end edge of water pipe 604 to thereby adjustably hold pipe 606 stationary but releasable by manipulation of control knob 620. Detents 624, 626 and 628 may merely take the form of cam bumps and rod 618 made slightly resilient and mounted so as to be stressed as it bears against the edge of pipe 604 to provide the spring force for the detent action. The exterior inlet end of air pipe 606 is provided with a conventional swivel hose coupling (not shown) for connection to a conventional air hose to accommodate rotation of the air tube relative to the air hose.

As shown in FIG. 39, air tube 606 is centrally supported coaxially in water tube 604 by a series of perforated plastic or aluminum support disks 630 which may be loosely received within water pipe 604 and carried on air tube 606 by suitable hose clamps 632 that enable rotation of air tube 606 relative to disk 30. A suitable plurality of disks 630 are provided at given axial positions spaced lengthwise along tube 606 at, say, ten foot increments. Four (or more) large through-hole ports 634 are provided in disk 630 to permit passage of water therethrough with a minimum pressure drop. Thus, in addition to serving as supports and intermediate journals for air tube 606, the spaced-apart series of perforated support disks 630 also function to promote turbulence in the flow of water up the pipe. Such turbulent flow promotes heat transfer for cooling of the water by the sub-freezing ambient atmospheric temperatures to which pipe 604 is exposed exteriorally, and also assists in more rapid cooling of the compressed air being conducted in tube 606 to the air jet nozzles at the upper end of the mast.

As shown in FIG. 41, a modified end cap 640 is provided at the upper end of water pipe 604 in place of cap 104 of tower 50. Cap 640 may be fabricated from a cylindrical pipe section 642 and has an end cap disk 644 welded to its outer end. A ported sleeve collar 646 is abutted and welded at its outer end to the inner surface of cap 644 coaxially therewith. Three air jet tubes 650, 652 and 654 are inserted through holes drilled radially through collar 642 and are inserted at their inner ends into three radial through-passages formed in sleeve 646. Preferably, tubes 650, 652 and 654 are copper tubes for maximum heat conductivity and may be sealably welded or braze-mounted to both collar 642 and collar 646. Air jet tubes 650, 652 and 654 are oriented to function in the manner of the compressed air jet-forming radial orifices 140, 142 and 144 of cap 104 of tower 50 as described previously, and thus have the same angular orientation, alignment and water spray interaction with the associated nozzle sub-booms as described previously.

The upper end of air tube 606 is journalled into collar 646 for rotation therein about its longitudinal center axis between its three control positions, and is suitably pressure sealed by one or more O-rings 656 or other suitable conventional pressure seal packings provided in collar 646 and located axially between the air tubes 650–654 in the inner end of collar 646.

As shown diagrammatically in FIGS. 42A, 42B and 42C the upper end of air tube 606 is provided with four angularly spaced radial passage ports 660, 662, 664 and 666, and collar 646 is provided with an air blow-out port 668 all suitably angularly located relative to one another so that rotation of air tube 606 by handle control 618–620 will cause the portion of air tube in collar 646 to function as a rotary valve to provide three operational modes. When the handle is rotated counter-clockwise a (as viewed in FIG. 40) from its position shown in FIG. 40 and into yieldable, releasable engagement with detents 624, the rotary valve shuts off communication of air within tube 606 with all of the air tubes 650, 652 and 654, as well as with the water chamber 112 (FIG. 42A).

When the control handle is rotated clockwise from the "air off" position to releasably latch with the detents 626 in the "air-on" position, the three air ports 660, 662 and 664 in tube 606 align with the three associated air tubes 650, 652 and 654 (FIG. 42B) so as to discharge compressed air from tube 606 out via the air jet tubes into ambient to form the three air jets $\mathbf{150}_c$ and $\mathbf{150}_p$ for respective intersecting impingement with each of the water sprays issuing from each associated nozzle boom, as described previously in conjunction with tower 50 operation.

When the control handle 618–620 is rotated further clockwise from the air-on position to releasably latch with the blow-out detents 628, this rotates air tube 606 so as to rotate the blow-out port 666 in the air tube into alignment with the blow-out port 668 in collar 646 (FIG. 42C), and closes tube ports 660, 662 and 664. Assuming that the water supply hose first has been disconnected from water inlet coupling 110 prior to so manipulating the control valve, the water chamber 112 in the mast boom will be drained by gravity flow of water down the mast pipe 604 and out the now-open water inlet 110. Once this drainage flow is commenced, the air tube may be rotated to the "blow-out" position to admit compressed air to the water chamber 112 to help force the remaining water downwardly of the main pipe 604 and out inlet 110. This blowout valve position will also admit compressed air to each of the nozzle booms 120, 122 and 124 and so as to air-expel residual water and then to blow out air through the three sub-booms and the water nozzles thereon to thereby blow out the water nozzles while main pipe 604 is still being air-boost drained of water at its lower end. Thus as main water tube 604 is emptied of water the compressed air will also help expel the remaining residue of water from this tube. Hence both the main water tube 604 as well as the sub-booms 120, 122 and 124 and associated water spray nozzles are dried out by the compressed air blow-out flow to thereby prevent freeze up of these water conduit passageways at tower shut down. If it is desired to augment or prolong nozzle drying after the main pipe 604 has been drained of water, water inlet 110 may be suitably plugged with a stopper, or a valve added for this purpose, so that all of the air being expelled through the blow-out port 668 is directed to the nine water spray nozzles for as long as necessary to insure complete dryness at that end of the system.

It is to be understood that additional control arm holding detent positions may be provided between the full-air-on detents 626 and the air-off detents 624 to provide a graduated range of compressed air flow rates for adjusting the compressed air/water output ratio for generating the water spray fog in ambient atmosphere downstream of the water spray nozzles to thereby vary compressed air consumption as needed in accordance with prevailing climatic snow making conditions.

It is also to be understood that the construction of air tube 606 and encircling collar 646 in cap 640 may be modified so as to render air tube 606 non-rotatable about its axis. This modification is shown diagrammatically in FIG. 42D wherein a larger diameter collar 646*a* is substituted for collar 646. A rotatable valve port sleeve 609 is inserted concentrically between the upper end portion of air tube 606 and collar 646*a* so as to extend axially co-extensively with collar 646. Sleeve 609 then sealably protrudes at its outer end through and beyond end wall 644 of cap 640, and a suitable control knob (not shown) arrangement is provided on the exteriorally exposed end of valve sleeve 609. Valve sleeve 609 is provided with the four valve ports 660, 662, 664 and 666, instead of such ports being provided in air tube 606. Communication of compressed air from the interior of tube 606 to each of these sleeve valve ports is provided by a radial passage 611 leading to circumferentially continuous external groove 607 in the periphery of tube 606 that continuously registers with the valve ports in sleeve 609. Suitable O-ring seals or packings (not shown) are provided as needed in the manner described previously in conjunction with FIG. 41, and on both of the axially opposite sides of the air tubes 650–654.

Figure 42D:
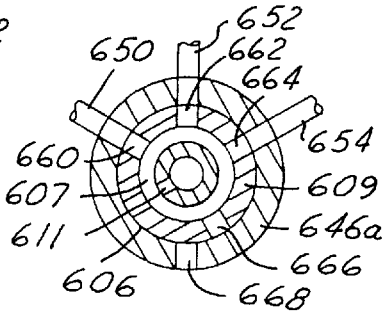
FIG. 42D is a diagrammatic cross sectional view of a modified rotary valve construction that may be substituted in mast 600.

With the modified rotary valving construction of FIG. 42D, all of the aforementioned operational modes of air-off, air-on and air-blow-out, as well as graduated air-on positions, may be provided on the exterior hand-operated control arrangement at the outboard end of the main boom pipe instead of at the lower end of the pipe as shown in FIG. 40. To operate this modified valving system, the snow making main pipe boom 600 must, of course, be pivoted downwardly to bring the nozzle end of the boom close to ground level so that an operator can manually reach the control knob for rotating valve sleeve 609. After the compressed air control is set to the desired position, the boom is then re-elevated for operation in whichever mode has been selected.

From the foregoing it will also now be understood that a similar rotary valve sleeve arrangement may be provided in a modification of the dual air tube embodiment of FIG. 27B. A rotary valve sleeve (not shown), similar to sleeve 609, is telescoped over one of the air tubes 248 or 250 to control admission of compressed air to its associated manifold air chamber and air jet ports, or to shut off such communication, any by providing a blow-out port valving arrangement communicating with the water chamber in collar 240 to provide a blow-out mode. An additional rotary valve sleeve can be provided on the air tube 248 with the same suitably lengthened toward partition 266 to accommodate the concentrically encompassing rotary valve sleeve.

Seventh Embodiment Snow Making Pipe Tower Construction

Figure 43:
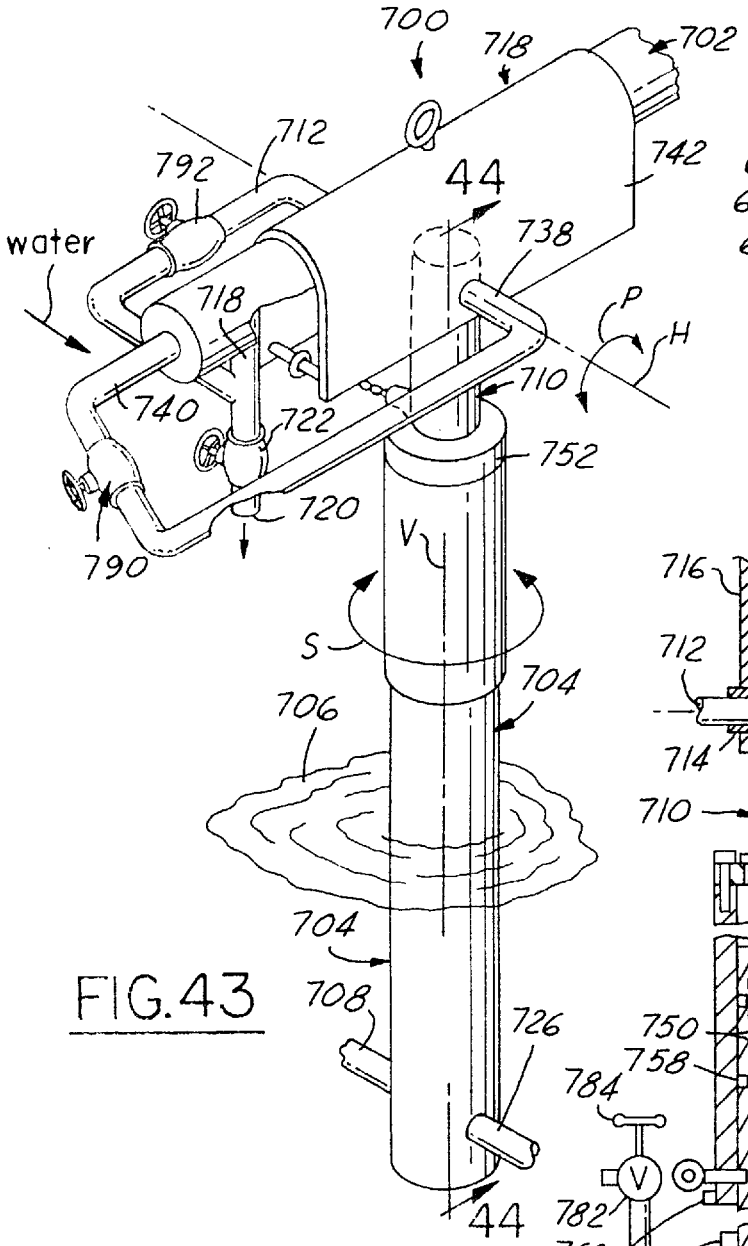
FIG. 43 is a simplified perspective view of a seventh embodiment snow making tower construction of the invention.
Figure 44:
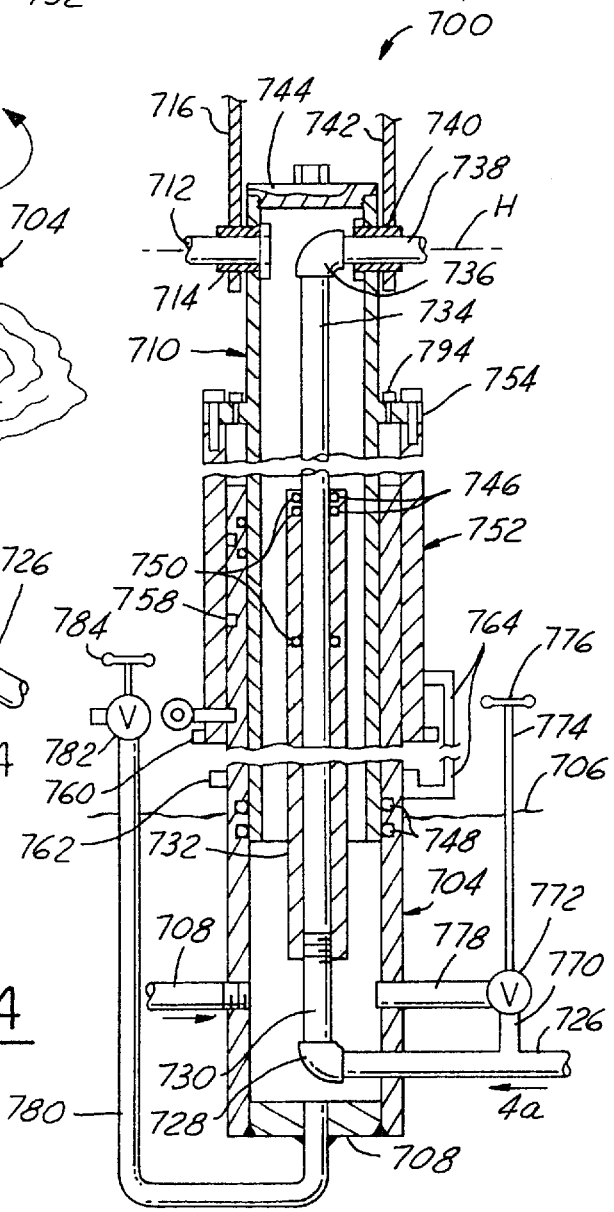
FIG. 44 is a fragmentary cross sectional view taken on the line 44–44 of FIG. 43.

FIGS. 43 and 44 illustrate a seventh embodiment snow making pipe tower construction 700 also constructed in accordance with the present invention. Tower 700 employs a main pipe conduit boom 702 that may be constructed generally in accordance with any of the previously described main pipe boom constructions. Boom 702 is pivotally adjustable about a horizontal axis H, as indicated by the arrow P in FIG. 43, and is also pivotable about a vertical axis V for swinging in a horizontal plane, as indicated by the arrow S in FIG. 43. The compressed air supply and pressurized water supply to the main pipe 702 is provided internally through the ground mount structure of the mast.

Referring in more detail to FIGS. 43 and 44, a ground-mounted support pole in the form of a cylindrical pipe 704 is buried at its lower end below the ground surface 706 and is provided with an end cap 708 at its lower end. Pipe 704 is non-rotatably fixed in the ground and may have suitable anchor structure as indicated previously. Pressure water is supplied to the lower interior of pipe 704 by a water supply pipe 708 preferably buried underground below the frost line.

An upper support pipe in the form of a water pipe 710 has its lower end slidably telescoped within lower pipe 704 and protrudes at its upper end therefrom to carry the main boom pivot support structure. An outlet water pipe 712 protrudes sealably through a trunnion journal bearing 714 that in turn pivotally supports a side plate 716 of a cradle tube support 718 (FIG. 43), journal 714 being coaxial with pivot axis H.

The downstream end of water pipe 712 communicates with a water inlet fitting 718 communicating with the interior water channel of main conduit pipe assembly 702, similar to inlet 110 in FIG. 2 of tower 50. A water drain stem tube 720 also communicates with water inlet 718 via a shut-off valve 722.

As shown in FIG. 44, compressed air is supplied to the main pipe conduit boom assembly 702 via an underground air supply pipe 726, also preferably buried below the frost line. Air pipe 726 extends sealably through the side wall of lower support pole/water tube 704. Pipe 726 is coupled by an elbow 728 to a vertical extension pipe 730 in turn threadably coupled at its upper end to an air supply sleeve 732 extending axially within both water pipes 704 and 710. Sleeve 732 telescopically, slidably and sealably receives an air coupling pipe 734 that extends upwardly within upper support pipe/water tube 710 to an elbow 736 in turn coupled to an air outlet pipe 738. Pipe 738 provides an exterior air piping run (FIG. 43) to the air inlet coupling 740 that is connected to the internal air tube within mast boom conduit assembly 702 (not shown). Another trunnion journal bearing 740 is fitted through pipe 710 and through a side plate 742 that completes the pivot support structure of cradle 718. Journals 712 and 740 are suitably fluid-pressure sealed at their inner ends that are disposed with the interior of the water column in pipe 710 to prevent leakage of pressure water (or air) through these journal trunnion supports.

The upper end of the upper, support pipe/water pipe 710 is provided with a removable cap 744 for assembly and maintenance access. Suitable pressure packing seals 746 and 748 are provided in internal grooves in ground pipe 704 for slidably sealing water pipe 710 telescopically therein. Likewise, suitable pressure packing seals 750 are provided in internal grooves in sleeve 732 for slidably receiving and sealing upper air pipe 734 telescopically therein.

An external support collar pipe 752 telescopically slides on the exterior of lower ground support water pipe 704 and is bolted at its upper end to an annular external flange 754 of upper water pipe 710. Sleeve collar 752 may be provided with a height-selecting insertable pin 756 (FIG. 44) adapted to selectively register with a row of vertical blind holes 758 provided in the upper exterior of lower water pipe 704 for fixedly supporting and holding collar 752 and the associated inner water pipe 710 at selected adjusted vertical elevations in the range of telescopic motion of collar 752 on pipe 704.

A safety limit stop to prevent disengagement of inner water pipe 710 from outer water pipe 704 at its upper extreme limit of telescopic travel is also provided. This limit stop construction may take the form of a ring 760 welded to the exterior of collar 752 at a suitable elevation thereon, and a cooperative ring 762 welded to the exterior of lower water pipe 704. One or more stop bail straps 764 are fixed to lower ring 762 and extends exteriorally along collar 752 to a suitable elevation, and is provided at its upper end with a dog leg adapted to catch ring 760 at the desired upper end limit of travel of collar 752 on lower water pipe 704. Of course, other suitable stop-limit safety catch constructions may alternatively be provided to fix the upper limit of telescopic travel, and likewise suitably constructed not to interfere with rotation about the vertical axis V of the subassembly of collar 752 and inner water pipe 710 relative to the stationary ground water pipe 704.

Tower 700 is also provided with a water blow-out system utilizing the compressed air supply from pipe 726. For this purpose, a branch pipe 770 is coupled between conduit 726 and a shut-off valve 772 that is operated by a control rod 774 extending above ground to a control knob 776. The outlet of valve 722 is coupled via a pipe 778 to the communicating interior water chambers of pipes 704 and 710. Preferably, a water drain-out and air blow-out pipe 780 is coupled at one end to the interior water chamber through lower end cap 708 and leads to an above ground valve 782 provided with a manual control knob 784 and associated discharge outlet for expelling air-forced water onto the ground.

During snow making operation valves 772 and 782 are normally closed. At system shut-down the hydrant valve supplying water supply line 708 is shut off, but the hydrant valve supplying compressed air to line 726 is left on. Then water drain valve 782 is opened to allow water in the sub-booms in the main pipe water conduit and in the ground support water pipes 710 and 704 to drain by gravity out through valve 782 to spill on the ground. In the meantime, compressed air is still being supplied to the compressed air jet orifices at the upper end of the boom to help dry out any residual moisture from this portion of the system.

After a suitable drain-out period has elapsed, a normally open shutoff valve 790 provided in external air supply pipe 738 (FIG. 43) is shut off. Then blow-out valve 772 is opened by operating control rod 774 to admit compressed air to the water chamber within water pipes 704 and 710. The compressed air will then be fed via the ground support pipe water chambers, thence via water supply pipe 712 to the water conduit chamber of boom 702 and thence via the sub-booms to the snow making nozzles to thereby blow out air dry this portion of the water supply system of the snow making tower 700. After a sufficient air blow-out time interval has elapsed for this purpose, a normally open shut-off valve 792 provided in the external water supply line 738 may be closed so that the blow-out air pressure admitted via branch pipe 778 to the interior chambers of the water pipes 704 and 710 can be utilized to force out the remainder of the water standing in pipe 704 via the water discharge line 708. Then blow-out valve 772 and spill valve 782 are re-closed, then shut-off valves 790 and 792 re-opened, and lastly the air supply to supply line 726 shut off at the hydrant to complete the shut-down operation of the snow making system.

Figure 34:
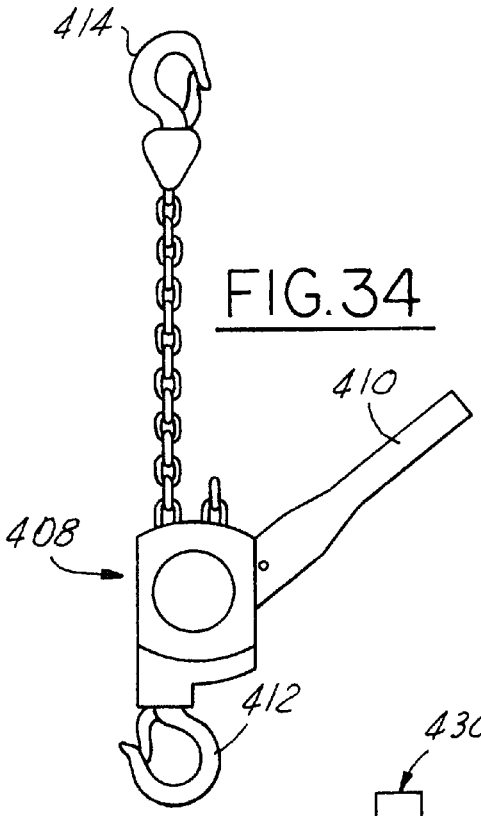
FIG. 34 is a side elevational view of a conventional ratchet lever hoist ("come-along") utilized in a fourth embodiment of a snow making tower illustrated in FIG. 35.

It is also to be understood that tower 700 can be provided with the adjustable exterior mounted swivel stops for limiting swinging of the main beam pipe 702 so as to maintain an angular range of downwind mast orientation with changes in wind direction by providing the index collar 424 and spring leaves 430*a* and 430*b* as previously described in conjunction with tower 400 of FIGS. 34–35B. It will be seen that the internal supply of water and compressed air through the ground mount structure of tower 700 provides enhanced cooperation with such limited downwind orienting, swinging of the mast since there are no water and air supply hoses laid above ground that are directly coupled to any mast pipe beam supply inlet fittings that could otherwise thereby to restrain such swinging rotation about the vertical axis V.

It will also be seen that tower 700 provides a fluid-operated ram-type tower height adjustment feature. The upper support pipe/inner water pipe 710, along with its external collar 752, may be elevated to whatever vertical height above ground is desired within the design adjustment range by removing pin 756 and pressurizing the interior water chambers of the upper and lower water pipes 710 and 704 by supplying pressurized water via inlet pipe 708 while exterior valve 792 is shut off. A more gradual elevation and lowering motion may alternatively be obtained by using compressed air supplied via line 726 by shutting off exterior air valve 790 and opening blow-out valve 772 to admit compressed air to the empty water chambers in pipes 710 and 704. After the upper pipe 710 has been so fluid-ram elevated to whatever height is desired, pin 756 is re-inserted into a registering blind hole 758 to fix the adjusted height of the tower ground support structure.

Typically, such tower height adjustment above the ground snow and ice level need not be performed more than two or three times in a season. However, the raising and lowering of the mast boom structure by this built-in fluid jack system can also be advantageously used to lower the structure for easy operating and/or maintenance access thereto by the personnel operating at ground level.

If desired, for de-icing purposes, removable plugs 794 may be provided in flange 754 for injecting liquid lubricant de-icing solution into the clearance spaces between collar 752, pipe 704 and pipe 710. End cap 744 can be removed for like purposes. Of course, providing the compressed air and snow making water supply via supply lines buried below frost level, as well as the aforementioned compressed air blow-out system drying feature, contributes substantially to a snow making system that is free of water freeze-up clogging problems. However, if desired, air and water supply hoses may be ground-laid and suitably coupled at ground level into suitably modified supply pipes 708 and 725.

As a further important feature, ground support ram de-icing can also be quickly accomplished by utilizing the warm compressed air supplied via blowout valve 772 and branch pipe 778 to the interior chambers of pipes 704 and 710 with shut-off valve 792 closed and spill valve 782 opened, to thereby utilize the heat of the compressed air to melt ice and otherwise dry out the interior of these ground support water pipes.

MODIFIED TOWER PIVOT ELEVATING JACK AND CRADLE CONSTRUCTION

Figure 45:
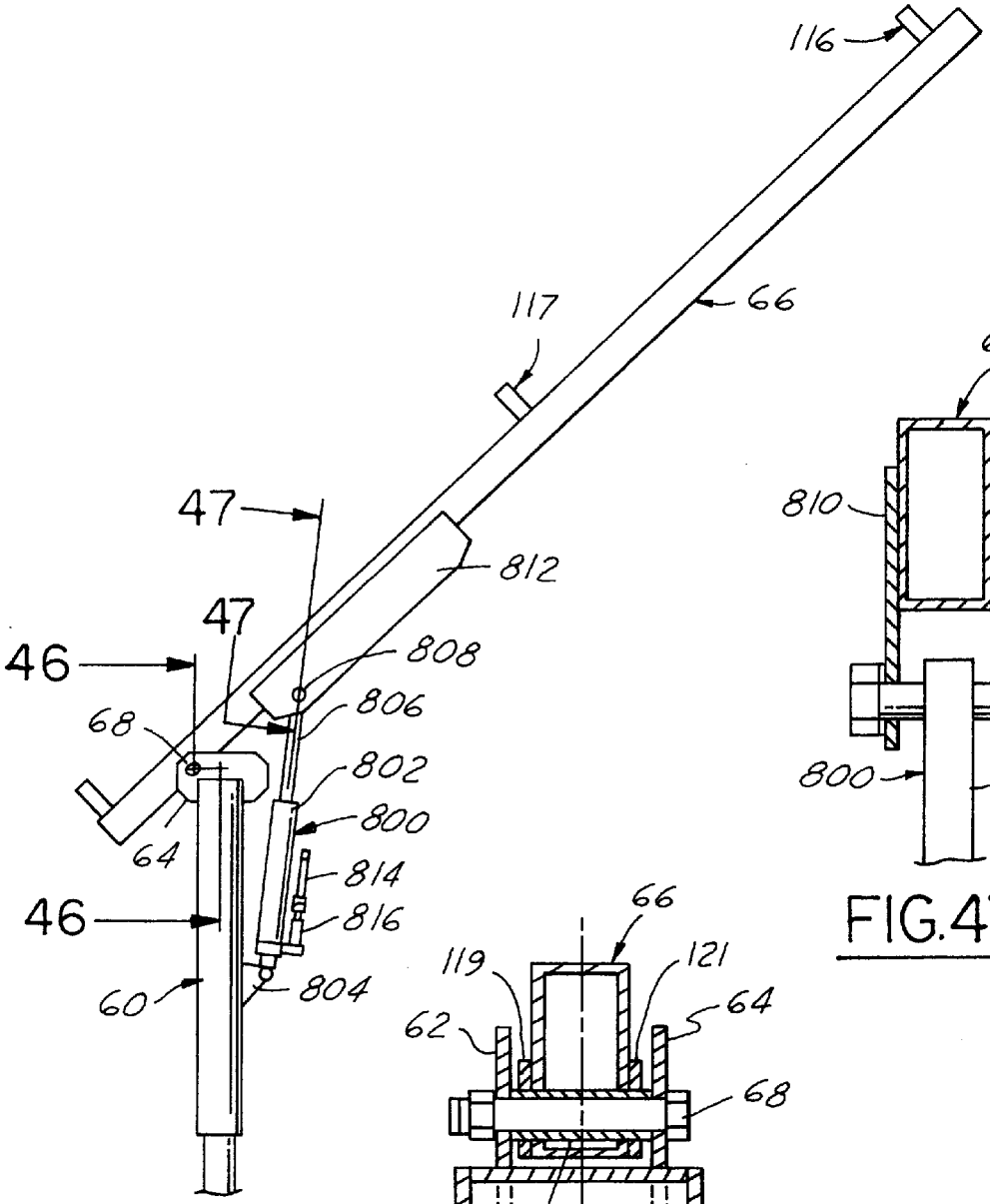
FIG. 45 is a fragmentary side elevational view illustrating the ground support pole, associated support pipe telescopically mounted thereon and the box beam pipe cradle as initially illustrated in FIGS. 14–17, but with the jackscrew subassembly of FIGS. 14 and 17 omitted in favor of a hydraulic jack and associated lifting bracket plates fastened to the opposite sides of box beam pipe cradle.
Figure 47:
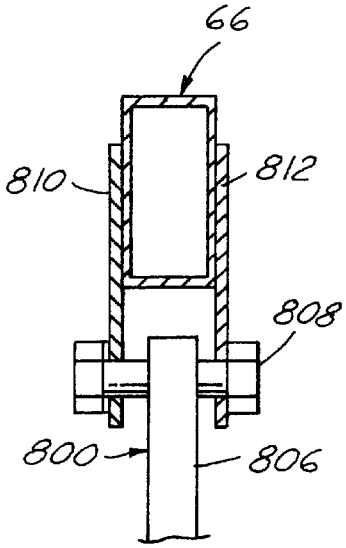
FIG. 47 is a fragmentary cross-sectional view taken on the line 47—47 of FIG. 45.
Figure 46:
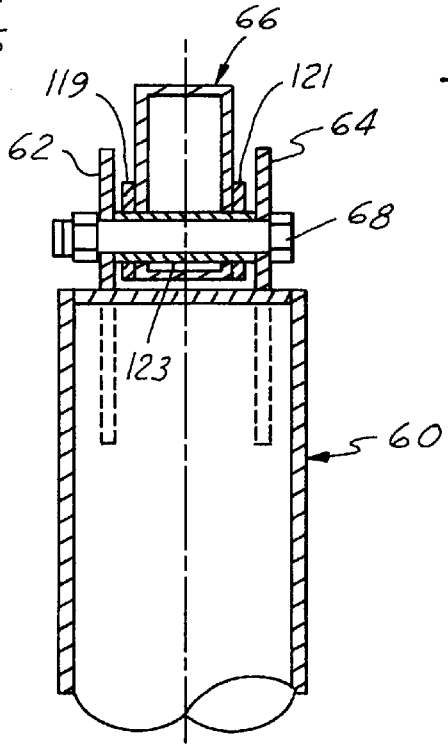
FIG. 46 is a fragmentary cross-sectional view taken on the line 46—46 of FIG. 45.

FIGS. 45–47 illustrate both further details of the construction shown in FIGS. 14–18, as well as a best mode modification of the same, wherein jackscrew 70 is replaced by a commercially available, double-acting manually operated hydraulic jack 800. Jack 800 may be a three-ton hydraulic jack provided with a long ram and clevis that is economically commercially available typically for automotive use, but wherein hydraulic fluid for the jack is replaced by aviation hydraulic fluid designed for operation at very low, sub-freezing temperatures as normally encountered by aircraft operating at high altitudes. The lower end of a cylinder 802 of ram 800 is pivotally mounted on a triangular plate 804 welded to the forward side of support pipe 60. The upper end of a piston rod 806 of jack 800 is pivotally coupled to cradle 66 by a bolt 808 inserted through coaxial apertures in a pair of lifting plates 810 and 812 (FIGS. 45 and 47) welded one to each of the opposite sides of the box beam of cradle 66, and at a location forwardly of, but adjacent support bracket plates 62 and 64. Jack 800 is operated by a pump handle 814 that operates a hydraulic pumping unit 816 of ram 800. It has been found that use of hydraulic jack 800 is preferred over the screwjack 70 in terms of speed and convenience of operation, and that mounting the jack 800 on the forward side of pipe 60 instead of on the rearward side as in the case of jack 70 further adds to operating convenience.

Another modification that has been found to be preferable is the addition of another clamp 117 mounted on the box beam of cradle 66 midway between clamps 114 and 116 and constructed in like manner. It has also been found preferable to reinforce the pivot mounting area of beam cradle 66 by addition of a pair of apertured reinforcing plates 119 and 121 (FIG. 46) welded to the opposite sides of the beam of cradle 66 and aligned coaxially with the pivot apertures of the beam to receive therethrough the bushing tube 123 through which the shank of pivot bolt 68 is sleeved for pivotally supporting box beam cradle 66 on bracket plates 62 and 64.

From the foregoing description and accompanying drawings, it will now be apparent to those skilled in the art that the snow making pipe tower constructions of the various embodiments of the invention amply fulfill the aforestated objects, as well as providing many additional advantages and features set forth hereinabove. It also will be appreciated that each of the seven embodiments of snow making tower constructions, with their associated separately described features and modifications, can be readily altered in construction to adopt features from one embodiment to another to optimize the snow making tower combination of features as desired to meet a wide variety of installation conditions of various ski resort snow making systems to best optimize overall snow making performance for a particular system.

What is claimed is:

1. In snow making apparatus of the type utilizing a snow making tower comprising an elongated hollow main water conduit mounted from ground support means with its longitudinal axis angled upwardly from horizontal in operation, water spray discharge nozzle means provided adjacent the upper end of said main water conduit, said main water conduit being operable for supplying pressurized water to said water spray discharge nozzle means for discharge in the form of a spray therefrom, an air conduit provided within and extending longitudinally generally for the full length of said main water conduit, coupling means adapted to couple a supply of compressed air for supplying pressurized air to the lower end of said air conduit, air jet discharge means communicating with the upper end of said air conduit and located generally adjacent said water spray discharge nozzle means and being positioned relative thereto to cause an air jet to be directed into the throat of the discharged water spray in ambient atmosphere;

the improvement in combination therewith wherein said water spray discharge nozzle means comprises a plurality of first water spray nozzles, and wherein a first branch water conduit is provided having a first axial end communicating with said main water conduit and extending longitudinally therefrom at an angle of about 90°, plus or minus about 20°, to the longitudinal axis of said main water conduit, said first branch water conduit being closed at a second axial end thereof positioned remote from said main water conduit, said first water spray nozzles being mounted on and spaced axially along said first branch water conduit and individually communicating therewith, said first water spray nozzles being oriented with their respective nozzle spray axes aimed to direct water spray issuing therefrom generally all in one direction forwardly away from said upper end of said main water conduit, said air jet discharge means comprising a first air jet orifice oriented to direct a first air jet generally at about 90°, plus or minus about 20°, to said spray axes of said first water spray nozzles for creating a first single air jet intersecting the water spray pattern issuing from all of said first water spray nozzles.

2. The apparatus of claim 1 further including a second branch water conduit having a first axial end communicating with said main water conduit and extending axially therefrom at an angle of about 90°, plus or minus about 20°, to the longitudinal axis of said main water conduit, said second branch water conduit diverging from said the first branch water conduit in a direction radially outwardly from the main conduit axis and being closed at a second axial end positioned remote from said main water conduit, said water spray discharge nozzle means also comprising a plurality of second water spray nozzles mounted on and spaced axially along said second branch water conduit and individually communicating therewith, said second water spray nozzles being oriented with their respective nozzle spray axes aimed to direct water spray issuing therefrom generally all in said one direction forwardly away from said upper end of said main water conduit, said air jet discharge means further comprising a second air jet orifice oriented to direct a second air jet generally at about 90°, plus or minus about 20°, to said spray axes of said second water spray nozzles for creating a second single air jet intersecting the water spray pattern issuing from all of said second water spray nozzles.

3. The apparatus of claim 2 further including a third branch water conduit having a first axial end communicating with said main water conduit and extending axially therefrom at an angle of about 90°, plus or minus about 20° to the longitudinal axis of said main water conduit, said third branch conduit diverging from said first and second branch water conduits in a direction radially outwardly from the main conduit axis, and being closed at a second axial end positioned remote from said main water conduit, said water spray discharge nozzle means also comprising a plurality of third water spray nozzles mounted on and spaced axially along said third branch water conduit and respectively individually communicating therewith, said third water nozzles being oriented with their respective nozzle spray axes aimed to direct water spray issuing therefrom generally all in said one direction forwardly away from said upper end of said main water conduit, said air jet discharge means further comprising a third air jet orifice oriented to direct a third air jet generally at about 90°, plus or minus about 20°, to said spray axes of said third water spray nozzles for creating a third single air jet intersecting the water spray pattern issuing from all of said third water spray nozzles.

4. The apparatus of claim 3 wherein said branch water conduits are oriented such that each of the second axial ends thereof are disposed in operation at an elevation located above the elevation of the respectively associated first axial ends of said branch water conduits so that at system shut down water will drain from said nozzles via said branch water conduits back into said main water conduit under the influence of the force of gravity.

5. The apparatus of claim 4 wherein said branch water conduits are each forwardly raked relative to the longitudinal axis of said main water conduit such that the axes of each of said branch water conduits define an obtuse included angle between the rear side of the branch conduit and the water conduit of about 100°.

6. The apparatus of claim 4 wherein said branch water conduits are each rearwardly raked relative to the longitudinal axis of said main water conduit such that the axes of each of said branch water conduits define an acute included angle between the rear side of the branch conduit and the water conduit of about 70°.

7. The apparatus of claim 4 wherein the water spray axes of those of said nozzles mounted on each of said branch water conduits are slightly convergent relative to one another and said water spray axes are generally oriented in a common plane that includes the axis of the associated said branch water conduit, and associated one of said air jet orifices.

8. The apparatus of claim 4 wherein the water spray axes of those of said nozzles mounted on each of said branch water conduits are slightly divergent relative to one another and are generally oriented in a common plane that includes the axis of the associated said branch water conduit and associated one of said air jet orifices.

9. The apparatus of claim 4 wherein each of said pluralities of said first, second and third water spray nozzles each comprise at least three water spray nozzles, and wherein said at least three water spray nozzles on each branch conduit are oriented slightly divergent relative to one another about the axis of the associated branch conduit.

10. The apparatus of claim 9 wherein those two of said water spray nozzles mounted on each associated branch conduit that are disposed closest to the associated said air jet orifice are oriented so that their axes diverge oppositely from a plane defined by the axis of the associated branch conduit and that of the main water conduit, whereas the remaining third one of said water spray nozzles on each said branch conduit that is disposed most remote from said main water conduit is oriented with its nozzle axis directed co-planar with said last-mentioned plane, and wherein each said single air jet associated with each said branch conduit intersects the edge of the water spray pattern issuing from said two closest nozzles on the associated branch conduit and intersects the center area of the spray pattern issuing from the aforesaid most remote nozzle on the associated branch conduit.

11. The apparatus of claim 4 wherein the axes of said first and third branch conduits extend from the main water conduit axis generally diametrically oppositely relative to one another and are inclined above horizontal at an angle of about 10° to horizontal in operation, and wherein the axis of said second branch conduit is oriented in operation so as to extend generally in a vertical plane disposed between said first and third branch conduits.

12. The apparatus of claim 11 wherein the water spray cone angle of each of said water spray nozzles defining the spray pattern respectively issuing therefrom is in the order of 50°.

13. The apparatus of claim 1 wherein said air conduit means comprises first and second tubular air conduits arranged side by side within the interior of said elongated hollow main water conduit, and wherein said air jet discharge means also includes a supplemental air jet orifice oriented to direct a supplemental air jet closely adjacent and generally parallel to said first air jet and oriented in a plane defined by said first air jet and the longitudinal axis of said main water conduit, and wherein said first and second tubular air conduits are operably coupled for respectively communicating with said first and supplemental air jet orifices for supplying pressurized air thereto, and air control valve means for controlling the supply of pressurized air to said first and said supplemental air jet orifices respectively via said first and second tubular air conduits.

14. The apparatus of claim 13 wherein said air control valve means comprises a three-way valve having an inlet adapted to be coupled to a supply of compressed air and having first and second outlets coupled respectively to an inlet of said first tubular air conduit and air inlet of said second tubular air conduit, said air control valve means being operable for coupling the supply air to one or the other of said first and second tubular air conduits or to neither, and wherein said first and said supplemental air jet orifices are of different diameters relative to one another to generate substantially differing flow rates of compressed air in creating the air jets issuing respectively therefrom when supplied with compressed air at a same given pressure.

15. The apparatus of claim 13 wherein said air control valve means comprises a four-way valve having an inlet adapted to be coupled to a supply of compressed air and having first and second outlets respectively coupled to an inlet of said first tubular air conduit and air inlet of said second tubular air conduit, said air control valve means being operable for shutting off flow of air to both of said tubular air conduits, for selectively admitting air to one or the other of said tubular air conduits and for admitting air simultaneously to both of said tubular air conduits, and wherein the respective diameters of said first and supplemental air jet orifices differ from one another to create differential flow rates between said first and supplemental air jets when supplied with the compressed air at a same given pressure from said supply of compressed air.

16. The apparatus of claim 13 wherein said first and second tubular air conduits and said main water conduit are formed as a common co-extrusion from heat conductive metallic material.

17. The apparatus of claim 16 wherein said first and second tubular air conduits are arranged side by side and a center rib extends within said main water conduit in a rib plane oriented perpendicular to an imaginary plane defined by the axes of said tubular air conduits, and wherein the sides of said tubular air conduits adjacent said rib are integrally joined thereto and said rib is integrally joined at its opposite longitudinal edges thereof to a wall defining said main water conduit, and wherein the sides of the tubular air conduits most remote from said rib are integrally joined to an adjacent portion of said wall defining said main water conduit.

18. The apparatus of claim 16 wherein said main water conduit has a generally elliptical cross-sectional configuration having a major axis extending in a vertical plane, and wherein a reinforcing cross rib extends transversely within said main water conduit so as to be oriented horizontally in cross-section to thereby form a reinforcing strut extending along the minor axis of said generally elliptical cross-sectioned configuration of the said main water conduit, and wherein said first and second tubular air conduits are disposed spaced one above and the other spaced below said cross rib and are joined by sub-ribs to said main water conduit wall and to said cross rib, said sub-ribs being oriented in a vertical plane in use.

19. The apparatus of claim 1 wherein said air conduit means comprises an air tube mounted for rotation internally of said water conduit for rotation about its axis and being journalled adjacent its upper end in a valve block having valve passageways communicating with said air jet discharge means and constructed and arranged such that rotation of said air tube about its axis is operable to control flow of air to said air jet discharge means.

20. The apparatus of claim 1 wherein said air conduit means comprises an air tube extending within said water conduit tube and supported therein fixed against rotation about its axis, and said tower includes at the upper end of said air tube a rotary valve operable for controlling admission of air from the upper end of the air tube to said air jet discharge means.

21. The apparatus of claim 20 wherein said rotary valve comprises a valve port sleeve encircling the upper end of said air tube and being rotatable relative thereto, said sleeve having a radial port communicating with a passageway groove cooperatively formed between said sleeve and said air tube, said air tube having a radial passageway communicating the interior of said air tube with said passageway groove, a stationary collar sealably encircling said sleeve and having a radial port opening for registry with said sleeve port, and a metal tube mounted at one end thereof in said port and extending therefrom to said air jet orifice means as formed in a wall defining said main water conduit, said collar and tube being surrounded by water contained in said main conduit.

22. The apparatus of claim 1 wherein said main water conduit and said air conduit are formed as a co-extrusion with a reinforcing rib disposed interiorly of said main water conduit and exteriorly of said air conduit, said rib being made of heat conductive metallic material.

23. The apparatus of claim 19 wherein said valve block comprises a ported sleeve telescopically receiving a cooperatively ported upper end of said air tube and disposed to be surrounded by water contained in said main water conduit, said valve passageways comprising a metal tube extending between an associated valve port in said sleeve and said air jet discharge orifice means as formed by an orifice in a wall defining said main water conduit, said tube likewise being surrounded by water in said main water conduit.

24. The apparatus of claim 19 wherein said air tube is supported by and journalled in a plurality of apertured discs located at axially spaced locations along the interior of said main water conduit.

25. In an adjustable snow making tower of the type comprising a substantially vertical support pole having a bottom end anchored in a ground surface, a support pipe having upper and lower ends and coaxially received on said pole for support thereon, a support cradle pivotally connected to said pipe adjacent the upper end of said pipe for pivotal movement in a vertical plane substantially from horizontal to vertical, an elongated pipe snow making tower having an upper end and a lower end with nozzle means at the upper end of the tower adapted for conveying water and air under pressure to said nozzle means from a remote source for discharge into ambient atmosphere through said nozzle means for manufacturing snow in subfreezing conditions, said pipe tower being secured at its lower end to said support cradle for pivotal movement therewith, a drive mechanism connected between said pipe and said support cradle for selectively driving said support cradle with said nozzle means mounted thereon through said pivotal movement, and adjustment means for adjusting the vertical position of said pipe relative to said support pole;

the improvement in combination therewith wherein said adjustment means includes force multiplication hoisting means for lifting said pipe on said pole while said tower is supported on said cradle and while said cradle remains pivotally connected to said pipe.

26. The tower of claim 25 wherein said hoisting means comprises a flexible tension element and cooperative force multiplying take-up mechanism for drawing toward one another a pair of opposite coupling members of the hoisting means by take-up of the flexible tension element, and further including a ground supported lifting pole having an upper attachment point for one of said pair of coupling members of said hoisting means that is located above at least a portion of said support pipe, said support pipe having a lower attachment point for the other of said coupling members of each hoisting means whereby take up of the flexible tension element when the hoisting means is coupled between said first and second attachment points is operative to lift said support pipe upwardly along said support pole and vice versa.

27. The tower of claim 26 wherein said hoisting means comprises a double block type block-and-tackle rig.

28. The tower of claim 27 wherein said hoisting means includes a winch for winding a free run of the block-and-tackle rig thereon, said winch being mounted for operation on said support pipe.

29. The tower of claim 26 wherein said lifting pole comprises a pipe mounted within said support pole and having an upper end protruding above said support pole and provided with said upper attachment point disposed within the confines of said support pipe, said support being constructed and arranged to enable access for coupling said hoisting means to said upper attachment point on said lifting pole from the exterior of said support pipe.

30. The tower of claim 26 wherein said lifting pole is supported in upright position exteriorally of said support pole and support pipe so as to extend upright in side-by-side relation to said pole and pipe, said lifting pole having on its upper end said hoisting means upper attachment point disposed above the entire assemblage of said tower, said cradle and said support pipe and said support pole, and said hoisting means second attachment point comprising a lifting hook secured to said cradle.

31. The tower of claim 26 wherein said hoisting mechanism is removably coupled between said first and second attachment points for operation in the mode of raising and lowering said pipe on said pole, said hoisting mechanism being detachable from said first and second attachment points and re-attachable between said cradle and said support pipe for operation as said drive mechanism for exerting tension force on the lower end of said tower to pivotally raise said tower upwardly by take-up of said hoisting mechanism, and vice versa for pivotally lowering said tower.

32. The tower of claim 26 wherein said hoisting mechanism comprises a pawl and ratchet type, pivot-handle-operated chain fall type take-up mechanism with the flexible element thereof comprising a link chain.

33. The tower of claim 25 wherein said drive mechanism includes a flexible tension element and cooperative force multiplying take-up mechanism, and a releasable lanyard coupled between said support pipe and said pipe tower and disposed on the opposite side of said support pipe from a cradle attachment point for said flexible element drive mechanism for preventing upward pivotal movement of said tower caused by lifting forces exerted thereon other than by said drive mechanism.

34. The tower of claim 25 wherein said hoisting means comprises an elevating jackscrew mounted centrally of said support pipe and support pole, said jackscrew having threaded engagement with first nut means mounted on said support pipe and threaded engagement with second nut means mounted on said support pole whereby rotation of said jackscrew in one direction will lift said support pipe on said support pole, and vice versa.

35. The tower of claim 34 wherein said jackscrew protrudes above a clamp plate mounted on the upper end of said support pipe and terminates in an accessible multi-faceted nut adapted to receive a wrench for applying rotational torque to said jackscrew for operation of the same.

36. The tower of claim 35 wherein the hoisting mechanism includes a power assist means comprising a wrench socket member adapted for removable coupling on said multifaceted jackscrew nut and having a drive pulley for rotatably driving said nut via said socket member, a portable drive motor with a drive pulley operably coupled thereto, and a drive train flexible element trained around said drive motor pulley and said pulley on said socket member.

37. The tower of claim 25 wherein said hoisting means comprises a hydraulic ram mechanism in which said support pole is constructed as a cylinder element of said ram and said support pipe is constructed as the opposite and relatively movable cylinder piston element of said ram, and wherein the working fluid for said ram comprises said pressurized water being fed to said tower nozzle means via the lower end of said tower, and including valve means for controlling admission and release of water to said ram elements for controlling the raising and lowering action of the ram, and a means for locking said ram in adjusted lifted positions.

38. The tower of claim 37 including air conduit means extending within the interior of said support pipe and support pole ram elements and including a telescopically coupled sealed section for accommodating expansion and contraction of said ram elements during the lifting motion.

39. The tower of claim 38 wherein said water supply and air supply are adapted to be fed to said ram elements via underground air and water supply lines that are buried below the ground frost line.

40. The tower of claim 38 wherein the pivotal mount of the pivotal connection of the cradle to said support pipe comprises first and second hollow journal conduits coaxially aligned with one another and coaxial with the pivot axis of said cradle on said support pipe, said first journal conduit serving as a water outlet conduit from the upper end of said support pipe and being operably communicatively coupled to a main water supply conduit of said tower feeding said nozzle means, said second journal conduit being operably communicatively coupled to said telescopic air conduit means within the interior of said support pipe and being externally coupled to said air conduit means of said tower.

41. The tower of claim 40 wherein said air and water supply lines to and from said ram elements of said support pipe and support pole are constructed and arranged with a plurality of valve means for controlling admission of the water and air under pressure to the nozzle means from the remote source to effect the following modes of operation:

(a) admitting and releasing supply water to the interior of said ram elements for varying the volume of water therein to cause raising and lowering of the support pipe on the support pole;

(b) supplying air and water to said nozzle means for manufacturing snow with said support pipe and support pole held in adjusted snow making position;

(c) draining water to ambient from said ram elements and water conduit means of said tower via said ram elements of said support pipe and support pole at system shut down;

(d) causing the air supply means to admit air to the water chamber of said ram elements to blow water out of the same at system shut down and to blow air through the water conduit means of said pipe tower; and (e) optionally raising and lowering said ram element support pipe and support pole by utilizing the pressure air admitted to the water chambers for system water blow out and air drying.

42. The tower of claim 25 wherein said support pipe and support pole are constructed and arranged to permit rotation of said support pipe about the vertical axis of said support pole, and said support pole and support pipe are provided with rotational limiting stop means for holding the pipe snow making tower within a given angular range of traverse corresponding to angular rotation about the vertical axes of said support pole and said support pipe.

43. The tower of claim 42 wherein said rotation limiting means comprises a collar fixed to said support pole below said support pipe and having a angular row of upwardly opening mounting slots formed therein, a rotation stop leaf spring inserted at its lower end in a selected one of said slots in said index collar and cooperating with an element protruding from the outer surface of said support pipe disposed for interference abutment therewith to serve as a limit stop to thereby define the angular range of rotation of said support pipe and said support pole permitted by said limit stop.

44. In an adjustable snow making tower of the type comprising a substantially vertical support pole having a bottom end anchored in a ground surface, a support pipe having upper and lower ends and coaxially received on said pole for support thereon, a support cradle pivotally connected to said pipe adjacent the upper end of said pipe for pivotal movement in a vertical plane substantially from horizontal to vertical, an elongated pipe snow making tower having an upper end and a lower end with air jet water spray nozzle means at the upper end of the tower and conduit means adapted for separately conveying water and air under pressure respectively to said nozzle air jet and water spray means from a remote source for discharge into ambient atmosphere through said air jet water spray nozzle means for manufacturing snow in subfreezing conditions, said pipe tower being secured at its lower end to said support cradle for pivotal movement therewith, and a drive mechanism connected between said support pipe and said support cradle for selectively driving said support cradle with said pipe tower and nozzle means mounted thereon through said pivotal movement, the improvement in combination therewith wherein said elongated pipe snow making tower is permanently affixed to said support cradle to prevent rotation of said tower about its axis, and wherein said nozzle means at the upper end of the tower comprises water spray nozzle means in the form of a plurality of sub-boom branch conduits protruding transversely from the main axis of the water pipe at the upper end thereof, each of said sub-booms carrying a plurality of water spray nozzles, and wherein all of said water spray nozzles are oriented to discharge water spray generally forwardly from the upper end of said tower and oriented in a direction away from said support pole and pipe ground support structure for the tower.

45. The tower of claim 44 wherein said drive mechanism comprises a two-way hydraulic jack permanently pivotally secured at opposite ends between said support cradle and said support pipe.

46. The tower of claim 45 wherein said two-way jack is located on the forward side of said support pipe.

47. The tower of claim 44 wherein said tower comprises a main water conduit in the form of a hollow aluminum pipe having an air conduit extending longitudinally therein and defining a longitudinally continuous conduit spaced from the interior surface of said hollow pipe to define a water conduit space in said tower, and wherein said support cradle comprises a collar sleeve member at least partially encircling said pipe and having a pivot bracket plate protruding radially therefrom constructed and arranged to serve as the pivot mounting structure for said cradle on said support pipe.

48. The tower of claim 47 wherein said bracket plate of said cradle sleeve protrudes below said sleeve such that said tower pipe is supported above said pivot connection.

49. The tower of claim 47 wherein said bracket plate of said cradle sleeve protrudes above said collar sleeve whereby said pivot connection is disposed above said tower pipe with said tower pipe hanging via said cradle collar sleeve from said pivot connection.

50. The tower of claim 44 wherein said elongated pipe snow making tower is provided with guy wire type spreader and mast stay rigging arrangement for reinforcing said tower pipe against bending moments gravitationally exerted thereon by the weight of said tower pipe and supply water conducted therein.

51. The tower of claim 50 wherein said guy wire mast stay rigging arrangement includes an upper stay and associated spreader maintaining said upper stay spaced above said main tower pipe, the opposite ends of said upper stay being coupled to said pipe tower via electrical insulated connectors, said upper say being made of electrically conductive material, and including nozzle defrost means including an electrical heating circuit operatively coupled in a circuit loop having one end coupled to said upper stay and the other end coupled to resistance heating elements individually associated with water spray nozzles, said circuit having an electrical return path via said snow making pipe to ground to complete an electrical water spray nozzle de-icing heating circuit via said upper stay.

52. The tower of claim 50 wherein said rigging includes upper and lower guy wires and port and starboard lateral guy wires and associated spreaders for each of said guy wires to brace said pipe tower against bending moments exerted in the plane defined by said upper and lower guy wires and in the plane defined by the lateral guy wires.

53. In a method of making snow when the atmosphere has a temperature lower than the freezing point of water, comprising the steps of:

supplying water under pressure to a first zone of discharge above ground;

discharging the supplied water through a first nozzle into the ambient atmosphere in the form of a spray directed in a given throw direction from said first zone, discharging the supplied water through a second nozzle positioned adjacent to said first nozzle into the ambient atmosphere in the form of an additional second spray also directed generally in said throw direction from said first zone, independently supplying air under pressure to a second zone of discharge above ground, discharging the supplied air under pressure into ambient atmosphere in the form of a jet stream directed from said second zone into and through said sprayed water from said first nozzle and thence into said sprayed water from said second nozzle to thereby form first and second plumes of atomized water to produce snow.

54. The method of claim 53 including the step of providing a third nozzle positioned on the side of said second nozzle remote from said first nozzle, discharging the supplied water also through said third nozzle into the ambient atmosphere in the form of an additional third spray directed generally in said throw direction from said first zone, causing said jet stream to penetrate through the sprayed water from said second nozzle and then into said sprayed water from said third nozzle to thereby create a third plume of atomized water to produce snow.

55. The method of claim 54 including the step of continually insulating said air supplied to said second zone of discharge for at least substantially its entire supply length of exposure above ground by coextensively surrounding the same to said second zone of discharge with said water supplied under pressure.

56. The method of claim 55 including the step of supplying said air and said water to said second and first zone of discharge, respectively, through heat conducting metal conduits.

57. The method of claim 56 including the further step of orienting said first, second and third nozzles such that their spray axes are coplanar and slightly mutually convergent relative to one another.

58. The method of claim 56 including the further step of orienting said first, second and third nozzles such that their spray axes are coplanar and slightly divergent relative to one another.

59. The method of claim 56 wherein the step of supplying said water to said first zone of discharge comprises conducting the water supply for all said nozzles through a common conduit to a point substantially in the vicinity of said second zone and then subdividing the water flow into three sub-boom conduits extending with their longitudinal axes transverse to the longitudinal axis of the main water conduit, arranging said sub-booms in a mutually divergent array wherein each sub-boom is inclined upwardly from its connection to the common conduit, and further providing three sets of said first, second and third nozzles, one set on each of said-sub-booms, and providing the air jet stream as first, second and third air jet streams individually associated with the three nozzles of each nozzle set on each sub-boom.

60. The method of claim 59 including the steps of pivotally supporting the main conduit for swinging motion in a vertical plane on a ground support structure to elevate the sub-booms for snow making operation, and also mounting the main conduit for free rotation about a vertical axis to enable horizontal traverse of the sub-booms through at least a limited range of swinging movement to enable wind forces acting on the sub-booms to orient the main conduit and said nozzles in a downwind direction and to swing the main conduit about said vertical axis to change said downwind orientation to track directional changes in the wind.

61. The method of claim 59 including the step of orienting each of said sets of first, second and third nozzles on each of said sub-booms such that their spray axes are coplanar and slightly mutually convergent relative to one another.

62. The method as set forth in claim 59 including the step of orienting each of said first, second and third sets of said nozzles on each of said sub-booms such that their spray axes are coplanar and slightly divergent relative to one another.

* * * * *